US010898989B2

(12) United States Patent
Li

(10) Patent No.: US 10,898,989 B2
(45) Date of Patent: Jan. 26, 2021

(54) GRINDING WHEEL ASSEMBLY

(71) Applicants: SAINT-GOBAIN ABRASIVES, INC., Worcester, MA (US); SAINT-GOBAIN ABRASIFS, Conflans-Sainte-Honorine (FR)

(72) Inventor: Jiashu Li, Worcester, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 319 days.

(21) Appl. No.: 15/940,453

(22) Filed: Mar. 29, 2018

(65) Prior Publication Data

US 2018/0290264 A1 Oct. 11, 2018

Related U.S. Application Data

(60) Provisional application No. 62/480,072, filed on Mar. 31, 2017.

(51) Int. Cl.

| | |
|---|---|
| ***B24D 5/16*** | (2006.01) |
| ***B24D 5/06*** | (2006.01) |
| *B24B 9/00* | (2006.01) |

(52) U.S. Cl.

CPC ..... *B24D 5/16* (2013.01); *B24D 5/066* (2013.01); *B24B 9/00* (2013.01)

(58) Field of Classification Search

CPC ..... B24D 5/16; B24D 5/066; B24D 13/20; B24B 9/00; B24B 9/10; B24B 45/00

See application file for complete search history.

(56) References Cited

U.S. PATENT DOCUMENTS

| | | | | |
|---|---|---|---|---|
| 1,404,339 | A * | 1/1922 | Bockshe | B24D 5/16 403/254 |
| 2,268,599 | A | 1/1942 | Kinney et al. | |
| 2,746,217 | A * | 5/1956 | Breisch | B24D 5/06 451/483 |
| 3,353,306 | A | 11/1967 | Seymour et al. | |
| 6,769,964 | B2 * | 8/2004 | Tunstall | B24B 9/10 451/285 |
| 8,607,435 | B2 * | 12/2013 | Yeh | B23B 31/1075 279/8 |

(Continued)

FOREIGN PATENT DOCUMENTS

| | | |
|---|---|---|
| DE | 2851737 A1 | 7/1980 |
| JP | H071342 A | 1/1995 |

(Continued)

OTHER PUBLICATIONS

International Search Report and Written Opinion for PCT/US2018/025215, dated Jul. 19, 2018, 12 pages.

(Continued)

*Primary Examiner* — Dung Van Nguyen

(74) *Attorney, Agent, or Firm* — Abel Schillinger, LLP; Joseph Sullivan

(57) ABSTRACT

A grinding wheel assembly is disclosed and includes an arbor in which a pull stud may be installed. Further, the arbor can include a head assembly that includes a mounting plate, a cover plate, and an abrasive body disposed there between. The abrasive is removably engaged with the mounting plate and the cover plate.

20 Claims, 53 Drawing Sheets

(56) References Cited

U.S. PATENT DOCUMENTS

| | | | |
|---|---|---|---|
| 9,997,000 | B2 | 6/2018 | Kimura et al. |
| 10,040,160 | B2 * | 8/2018 | Zandonella Necca ..... B24D 13/20 |
| 2004/0023599 | A1 | 2/2004 | Tunstall |
| 2013/0217315 | A1 | 8/2013 | Wiand et al. |

FOREIGN PATENT DOCUMENTS

| | | | |
|---|---|---|---|
| JP | H09155736 | A | 6/1997 |
| JP | 2001105310 | A | 4/2001 |
| JP | 2001105330 | A | 4/2001 |
| JP | 2002-200565 | A | 7/2002 |
| JP | 2003326515 | A | 11/2003 |
| JP | 2016209980 | A | 12/2016 |
| JP | 60-75504 | B2 | 2/2017 |

OTHER PUBLICATIONS

Material Data Sheet for P A 6.6 GF30, 2 pages, Schmidt + Bartl, DE.

* cited by examiner

BEST AVAILABLE IMAGE

GRINDING WHEEL ASSEMBLY

CROSS-REFERENCE TO RELATED APPLICATION

This Application claims priority under 35 U.S.C. § 119(e) to U.S. Provisional Patent Application No. 62/480,072, entitled "GRINDING WHEEL ASSEMBLY," by Jiashu Li, filed Mar. 31, 2017, which is assigned to the current assignee hereof and is incorporated herein by reference in its entirety.

BACKGROUND OF THE INVENTION

Field of the Disclosure

The present invention relates, in general, to grinding wheels and multi-piece grinding wheel assemblies.

Description of the Related Art

Abrasive grinding wheels can be used to smooth and contour the edges of certain flat materials, e.g., sheets of glass, for safety and cosmetic reasons. Such abrasive grinding wheels may include diamond-containing abrasive wheels and may be used to shape the edges of materials for various industries, including but not limited to automotive, architectural, furniture, and appliance industries.

The industry continues to demand improved grinding wheel assemblies, particularly for applications of grinding the edges of flat materials.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
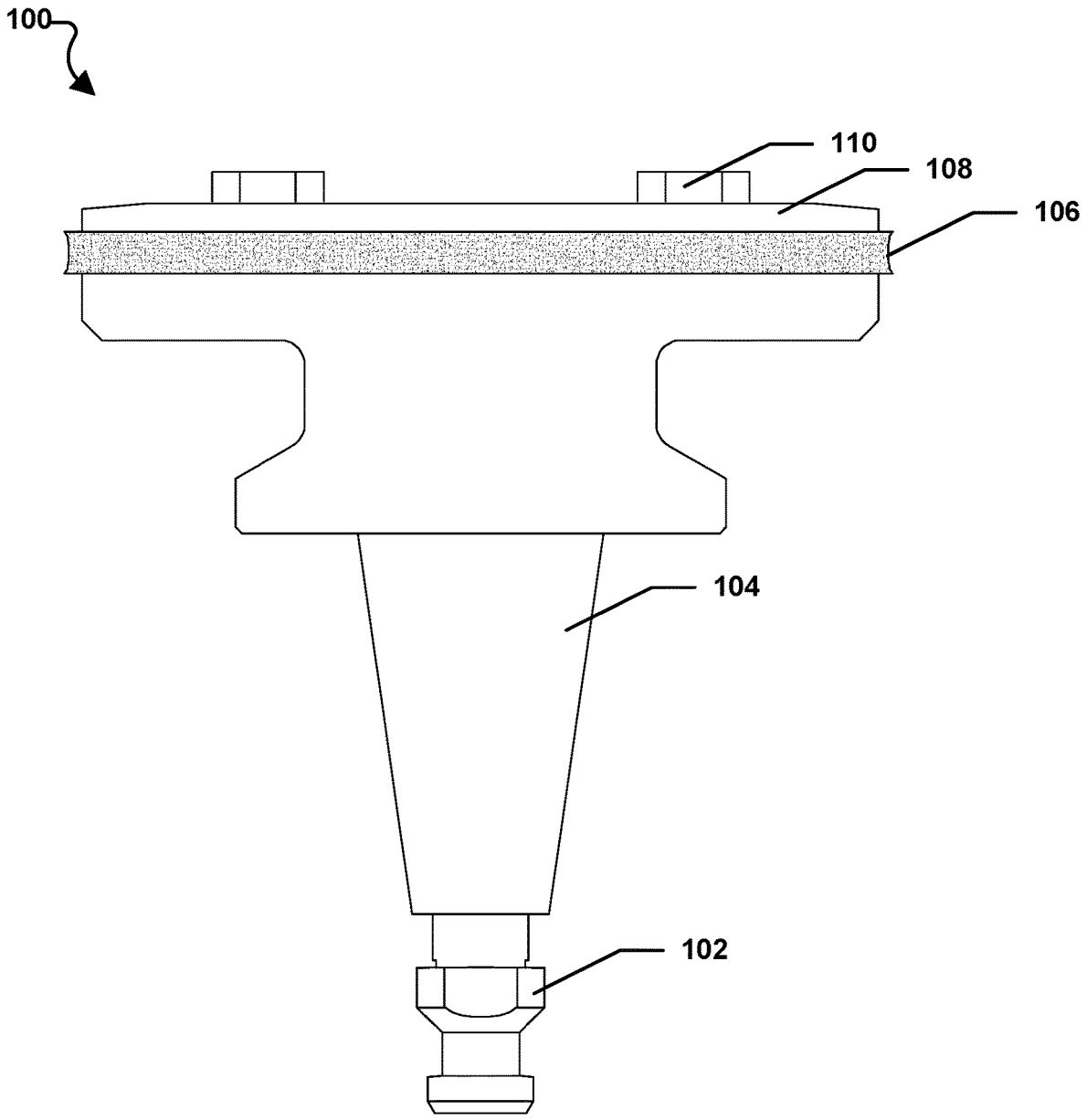
FIG. 1 includes an illustration of a side plan view of a grinding wheel assembly in accordance with an embodiment.
Figure 2:
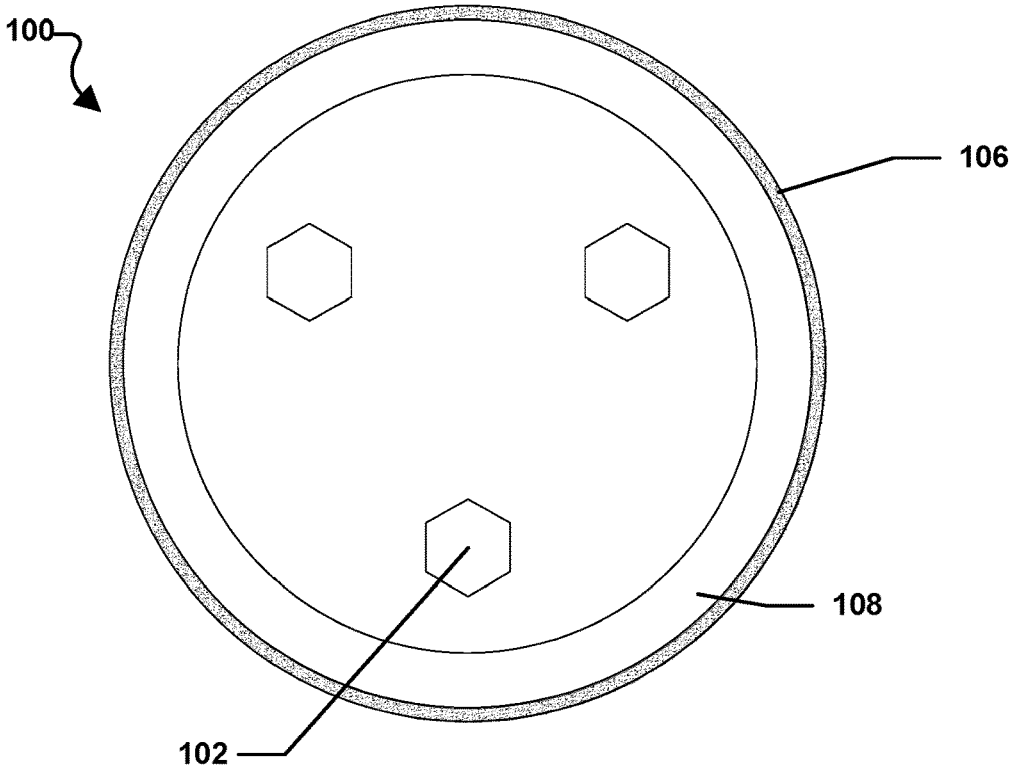
FIG. 2 includes an illustration of a top plan view of a grinding wheel assembly in accordance with an embodiment.
Figure 3:
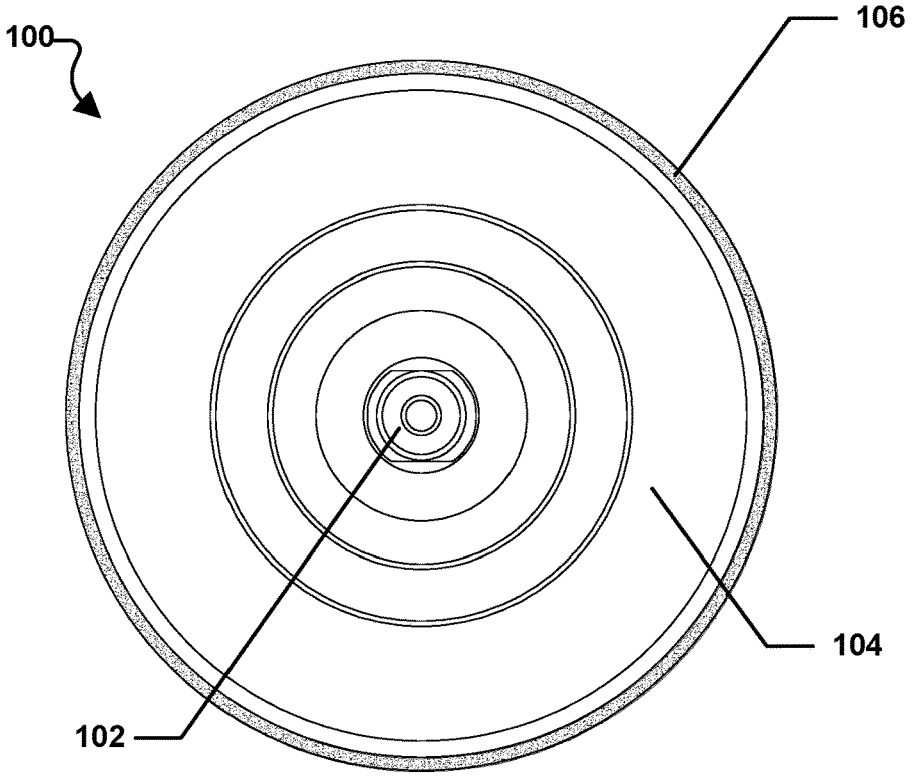
FIG. 3 includes an illustration of a bottom plan view of a grinding wheel assembly in accordance with an embodiment.
Figure 4:
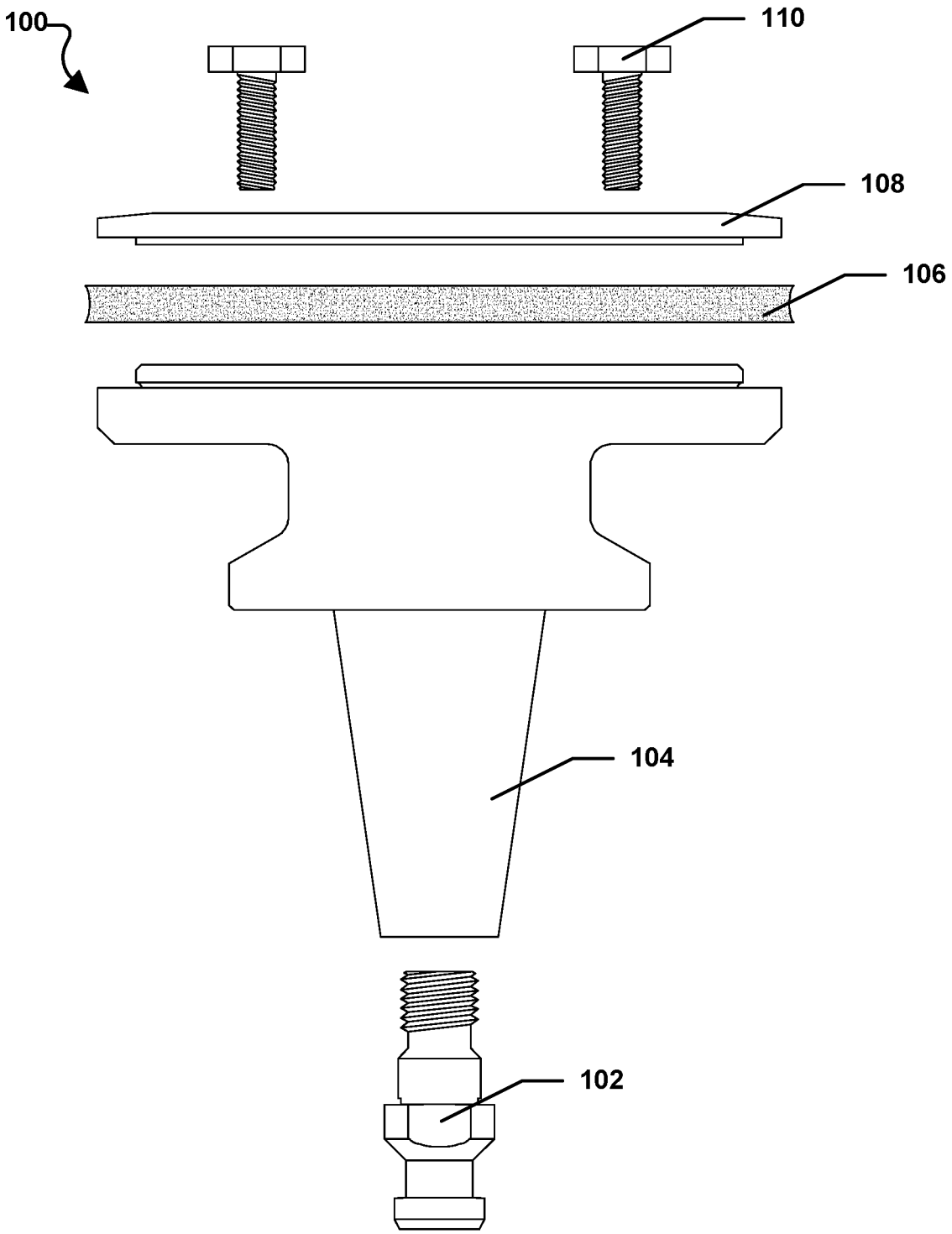
FIG. 4 includes an illustration of an exploded side plan view of a grinding wheel assembly in accordance with an embodiment.
Figure 5:
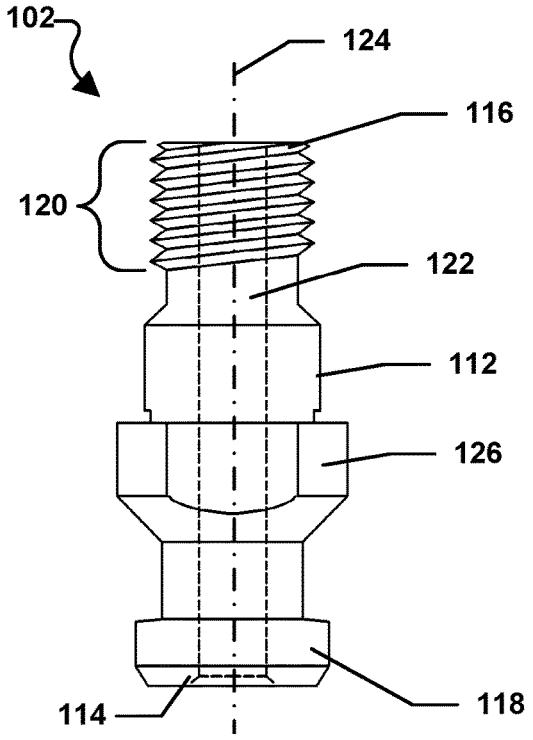
FIG. 5 includes an illustration of a side plan view of a pull stud for a grinding wheel assembly in accordance with an embodiment.
Figure 6:
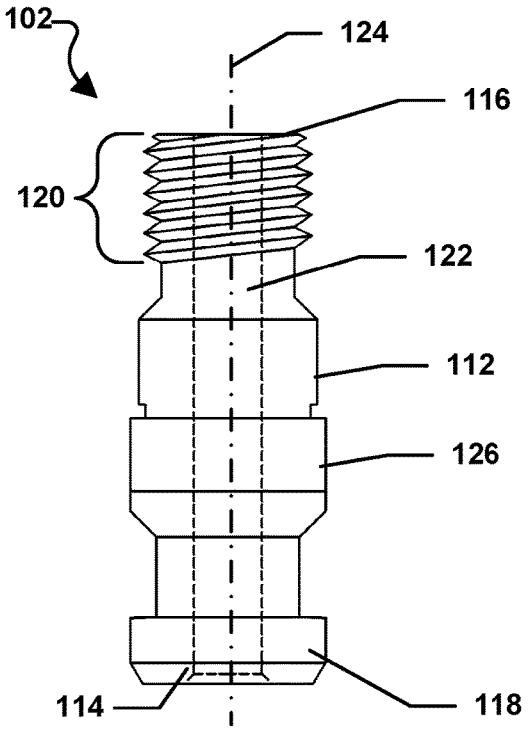
FIG. 6 includes an illustration of a side plan view of a pull stud for a grinding wheel assembly in accordance with an embodiment.
Figure 7:
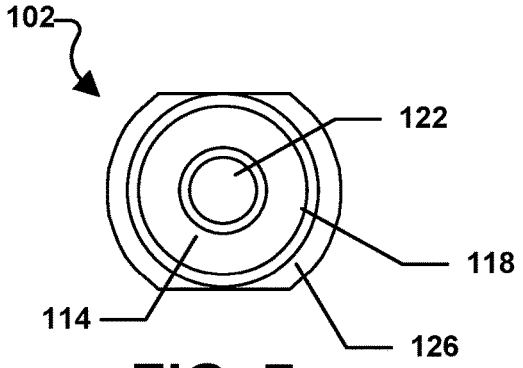
FIG. 7 includes an illustration of a bottom plan view of a pull stud for a grinding wheel assembly in accordance with an embodiment.
Figure 8:
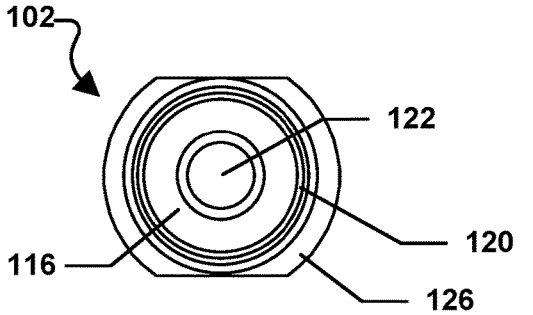
FIG. 8 includes an illustration of a top plan view of a pull stud for a grinding wheel assembly in accordance with an embodiment.
Figure 9:
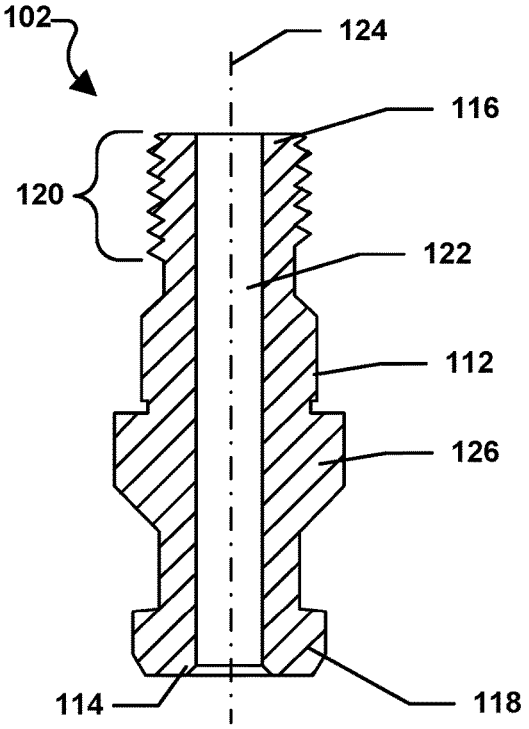
FIG. 9 includes an illustration of a cross-section view of a pull stud for a grinding wheel assembly in accordance with an embodiment taken along line 9-9 in FIG. 8.

The following is generally directed to grinding wheel assemblies that are particularly suitable for grinding and smoothing the edges of brittle materials, such as glass.

Embodiments are directed to abrasive articles which may be in the form of grinding wheels. In one aspect, a grinding wheel assembly can include an abrasive body mounted in a head assembly that can be easily removed and replaced after the abrasive body is no longer providing sufficient abrasion during use. The grinding wheel assembly can include an arbor in which a pull stud can be installed. The arbor can further provide support for an abrasive body. In one aspect, the arbor can include a mounting plate and the abrasive body can be held between the mounting plate and a cover plate. The mounting plate, the abrasive body, and the cover plate can form a head assembly. In another aspect, a head assembly can include a separate mounting plate, an abrasive body, and a cover plate. The head assembly may then be attached to a mounting plate on the arbor. The grinding wheel assembly can be particular suitable for operations of grinding the edges of glass, such as automobile glass and flat glass. Further, the grinding wheel assembly can allow for relatively quicker removal and replacement of the abrasive body after the abrasive body is no longer useful. The pull stud, the arbor, the mounting plate, and the cover plate need not be replaced after the abrasive body is no longer useful.

Grinding Wheel Assembly

Referring initially to FIG. 1 through FIG. 4, a grinding wheel assembly is illustrated and is generally designated 100. As shown, the grinding wheel assembly 100 can include a pull stud 102, an arbor 104, an abrasive body 106, a cover plate 108, and at least one fastener 110, e.g., a threaded fastener. A threaded fastener with a hexagonal head is depicted in the FIGS., but it is to be understood that any other type of threaded fastener may be used. For example, socket head cap screws may be used. In particular, standard grade 12.9 M8 socket head cap screws may be used to fasten the cover plate to the arbor 104. Alternatively, standard grade 12.9 M10 socket head cap screws or standard grade 12.9 M12 socket head cap screws may be used. The pull stud 102, the arbor 104, and the cover plate 108 can include a metal or a metal alloy. For example, the metal can be stainless steel or titanium. Further, the metal can include a hardened metal, such as hardened steel. It is to be understood that the material utilized for the pull stud 102, the arbor 104, and the cover plate 108 will minimize wearing of these elements during use. The abrasive body 106, however, will wear during grinding operations performed on the edges of various workpieces. After the abrasive body 106 is sufficiently worn, the abrasive body 106 may be removed and replace with a new abrasive body. Alternatively, the abrasive body 106 may be removed and the outer periphery of the abrasive body 106 may be reground. Thereafter, the abrasive body 106 may be reinstalled and used to perform further grinding operations.

Pull Stud

FIG. 5 through FIG. 9 depict the various details of the pull stud 102 that is configured to threadably engage the arbor 104. As illustrated, the pull stud 102 can include a body 112 that can define a proximal end 114 and a distal end 116. Further, the body 112 of the pull stud 102 can include a head 118 adjacent to, or formed at, the proximal end 114 of the body 112. The head 118 can be configured to engage a drive assembly (not shown). The body 112 of the pull stud 102 can also include threads 120, i.e., screw threads, formed along a portion of the body 112 of the pull stud 102 adjacent to the distal end 116 of the pull stud 102.

FIG. 5 through FIG. 9 also illustrate that the pull stud 102 can include a central bore 122 formed along a central axis 124 of the pull stud 102. In particular, the central bore 122 can be formed along the entire length of the body 112 of the pull stud 102. Further, the body 112 of the pull stud 102 can include a nut 126 formed between the head 118 and the screw threads 120. The nut 126 can extend radially outward from the body 112 of the pull stud 102 and the nut 126 can be configured to engage a wrench (not shown) or other tool (not shown) in order to tighten the pull stud 102 within the arbor 104.

Arbor

FIG. 10 through FIG. 13 illustrate the details of the arbor 104. As shown, the arbor 104 can include a body 130 that can define a proximal end 132 and a distal end 134. The body 130 of the arbor 104 can include a generally frusto-conical drive shaft 136 that can extend from the proximal end 132 of the body 130 to a central flange 138 that extends outwardly from the body 130. Further, the body 130 of the arbor 104 can include a mounting plate 140 that can extend radially outward from the body 130 at, or near, the distal end 134 of the body 130 of the arbor 104.

Figure 10:
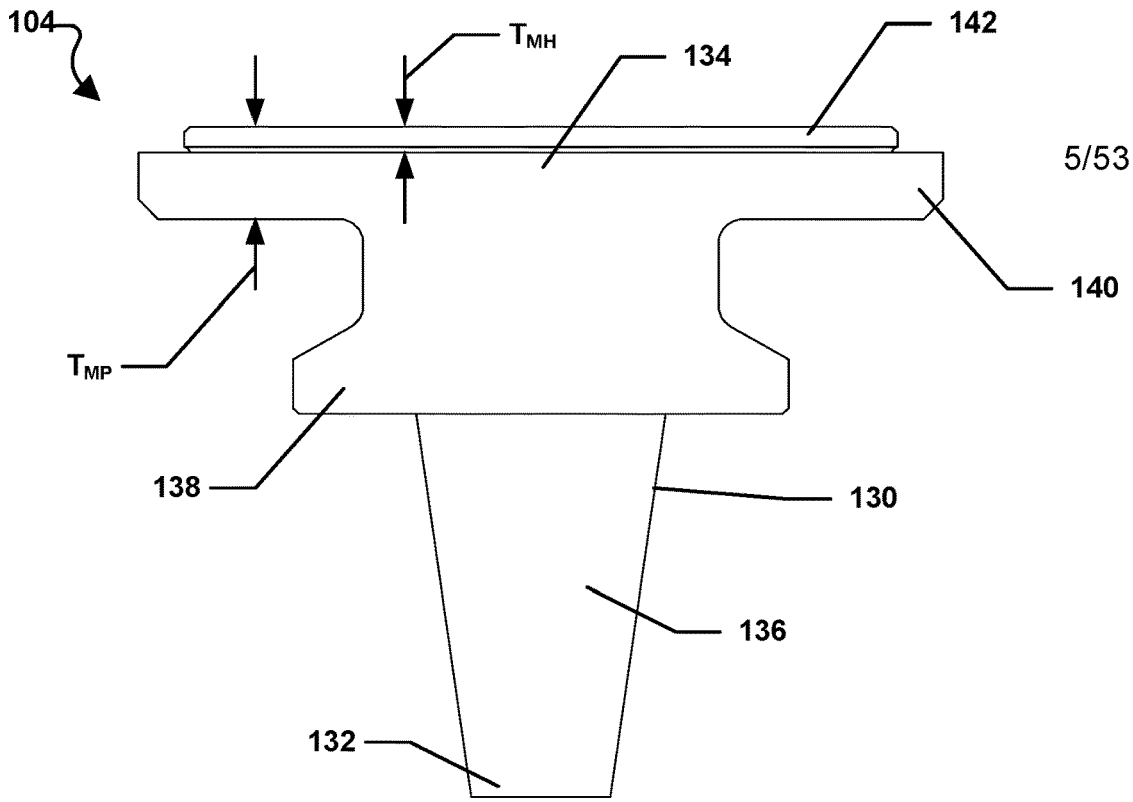
FIG. 10 includes an illustration of a side plan view of an arbor for a grinding wheel assembly in accordance with an embodiment.
Figure 11:
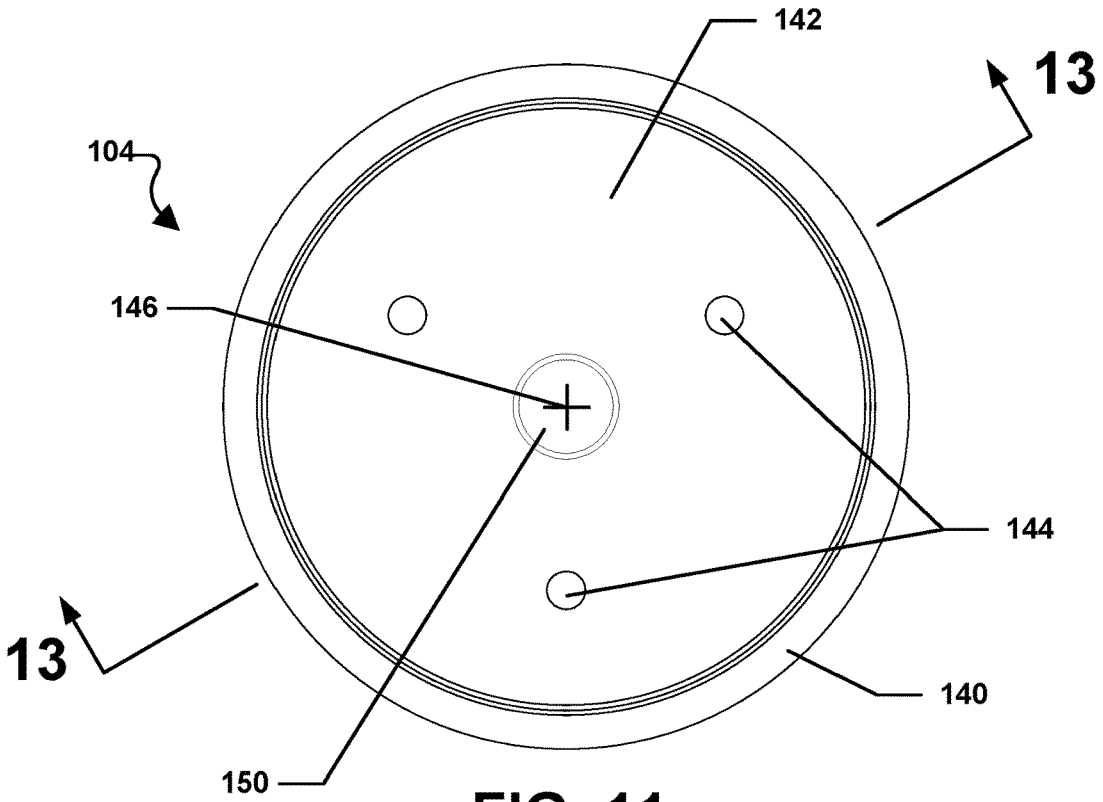
FIG. 11 includes an illustration of a top plan view of an arbor for a grinding wheel assembly in accordance with an embodiment.
Figure 13:
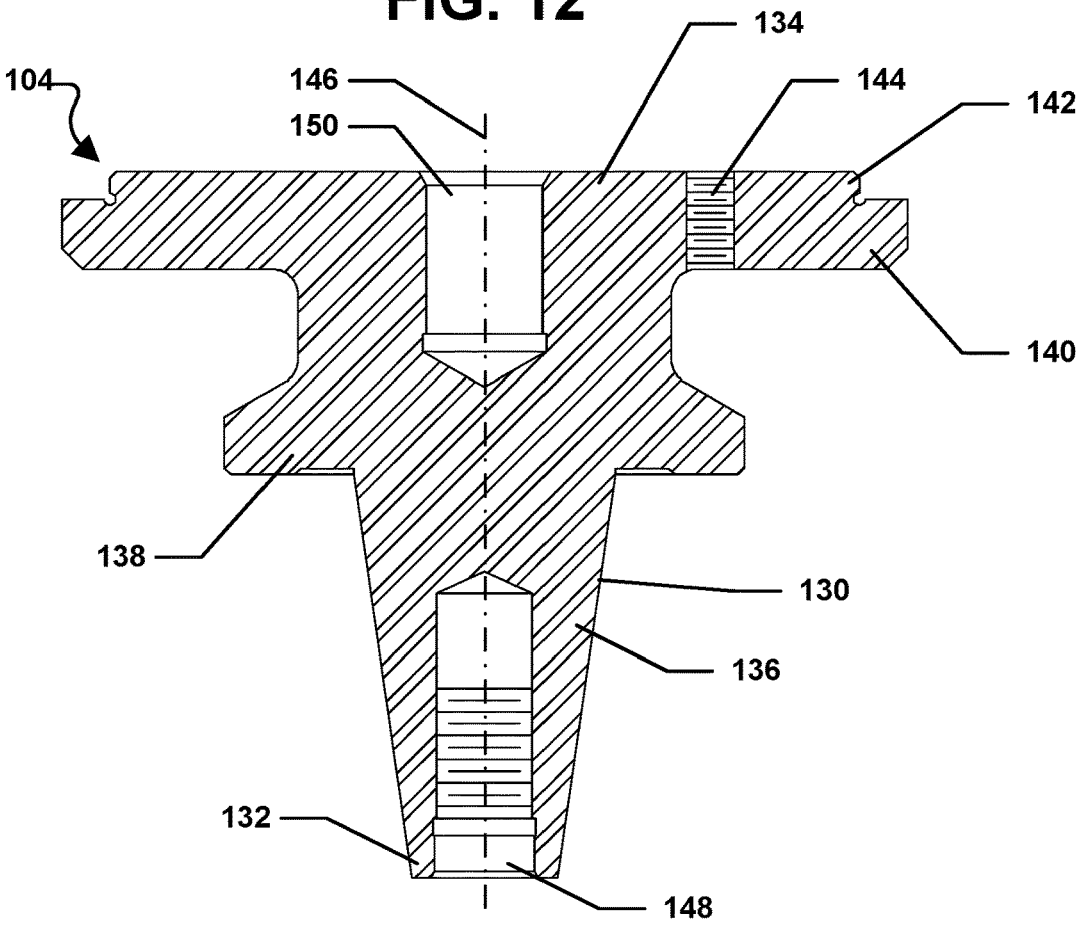
FIG. 13 includes an illustration of a cross-section view of an arbor for a grinding wheel assembly in accordance with an embodiment taken along line 13-13 in FIG. 11.

FIG. 10, FIG. 11, and FIG. 13 indicate that the mounting plate 140 can include a mounting hub 142. The mounting hub 142 can be generally cylindrical and can extend axially away from the distal end 134 of the body 130 of the arbor 104, e.g., from a contact surface of the mounting plate, wherein the contact surface of the mounting plate 140 is configured to engage a portion of the abrasive body 106 (FIG. 1) and the mounting hub 142 is configured to receive the abrasive body 106 (FIG. 1) there around. In a particular aspect, the mounting hub 142 can be configured to receive and engage the abrasive body 106 (FIG. 1) as described in greater detail herein.

Figure 24:
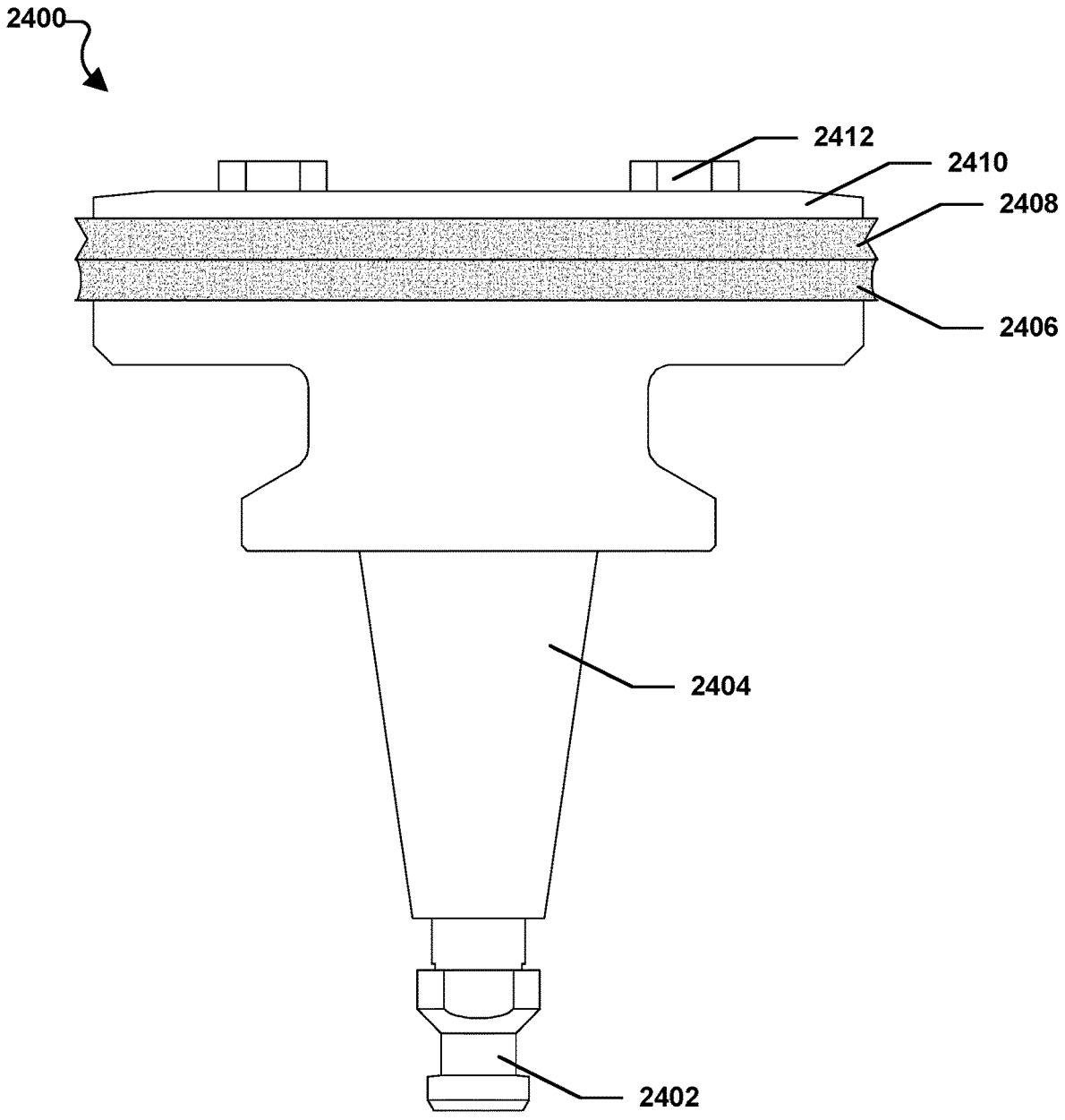
FIG. 24 includes an illustration of a side plan view of a grinding wheel assembly in accordance with an embodiment.
Figure 25:
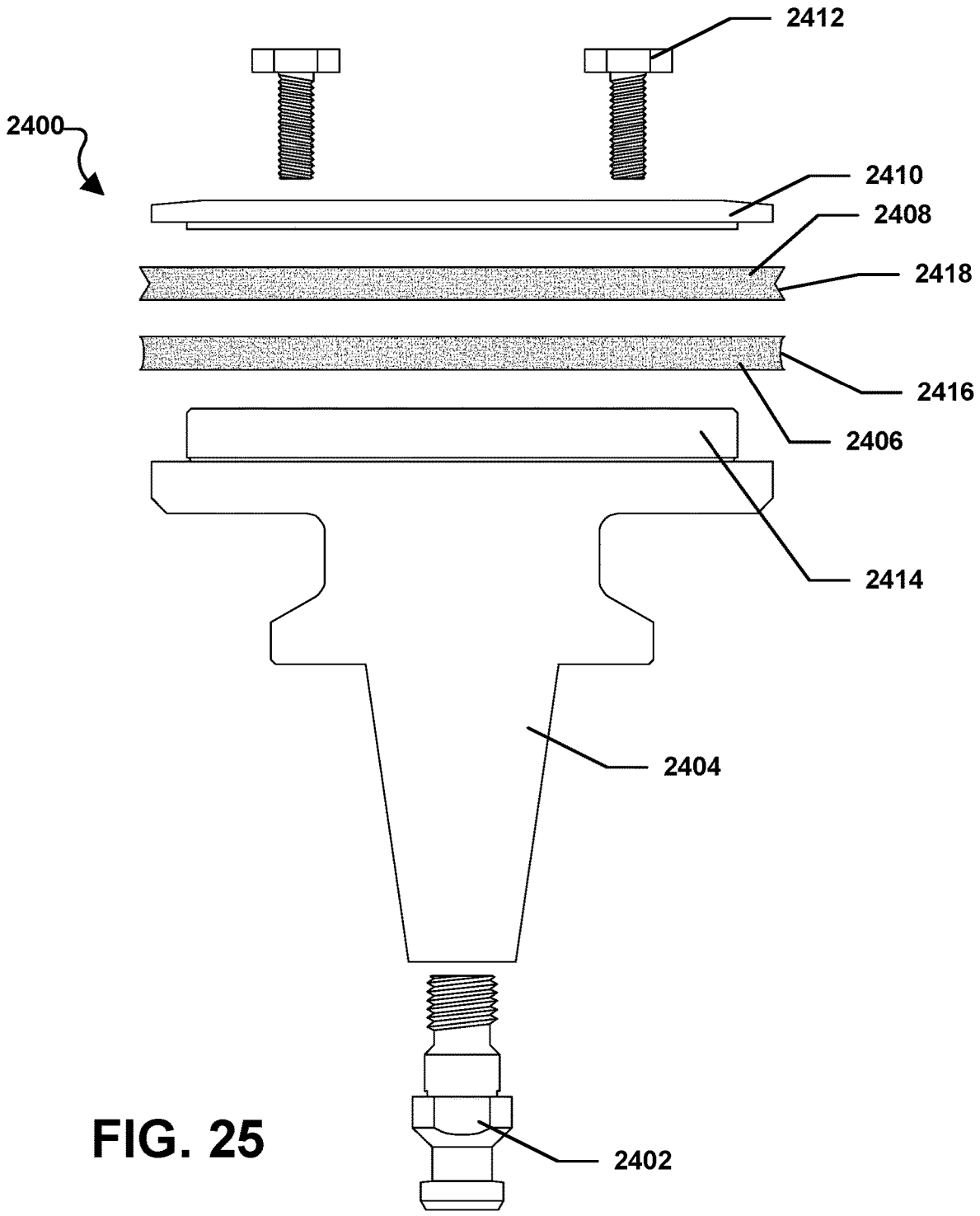
FIG. 25 includes an illustration of an exploded side plan view of a grinding wheel assembly in accordance with an embodiment.
Figure 26:
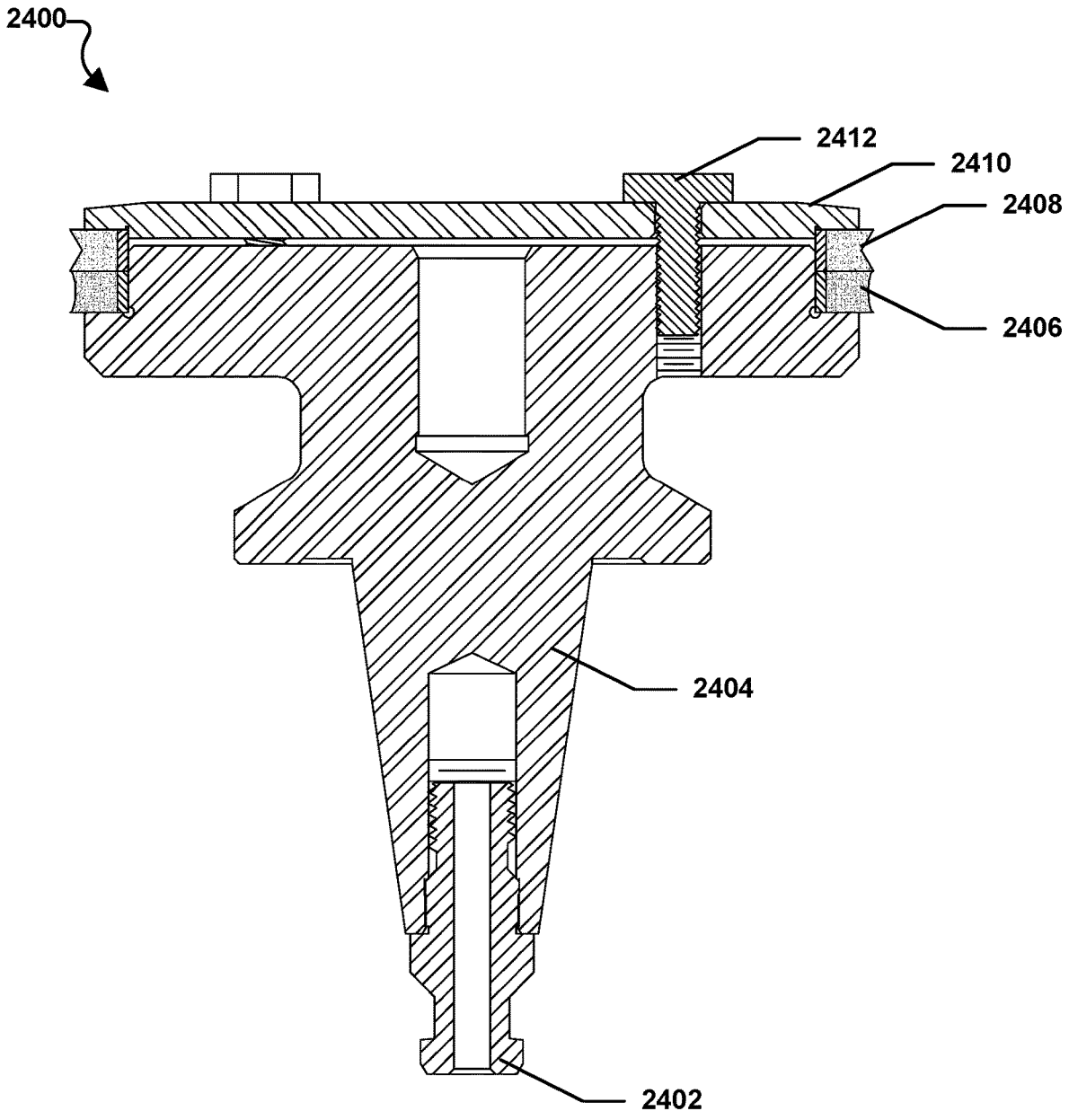
FIG. 26 includes an illustration of an exploded cross-section view of a grinding wheel assembly in accordance with an embodiment.
Figure 27:
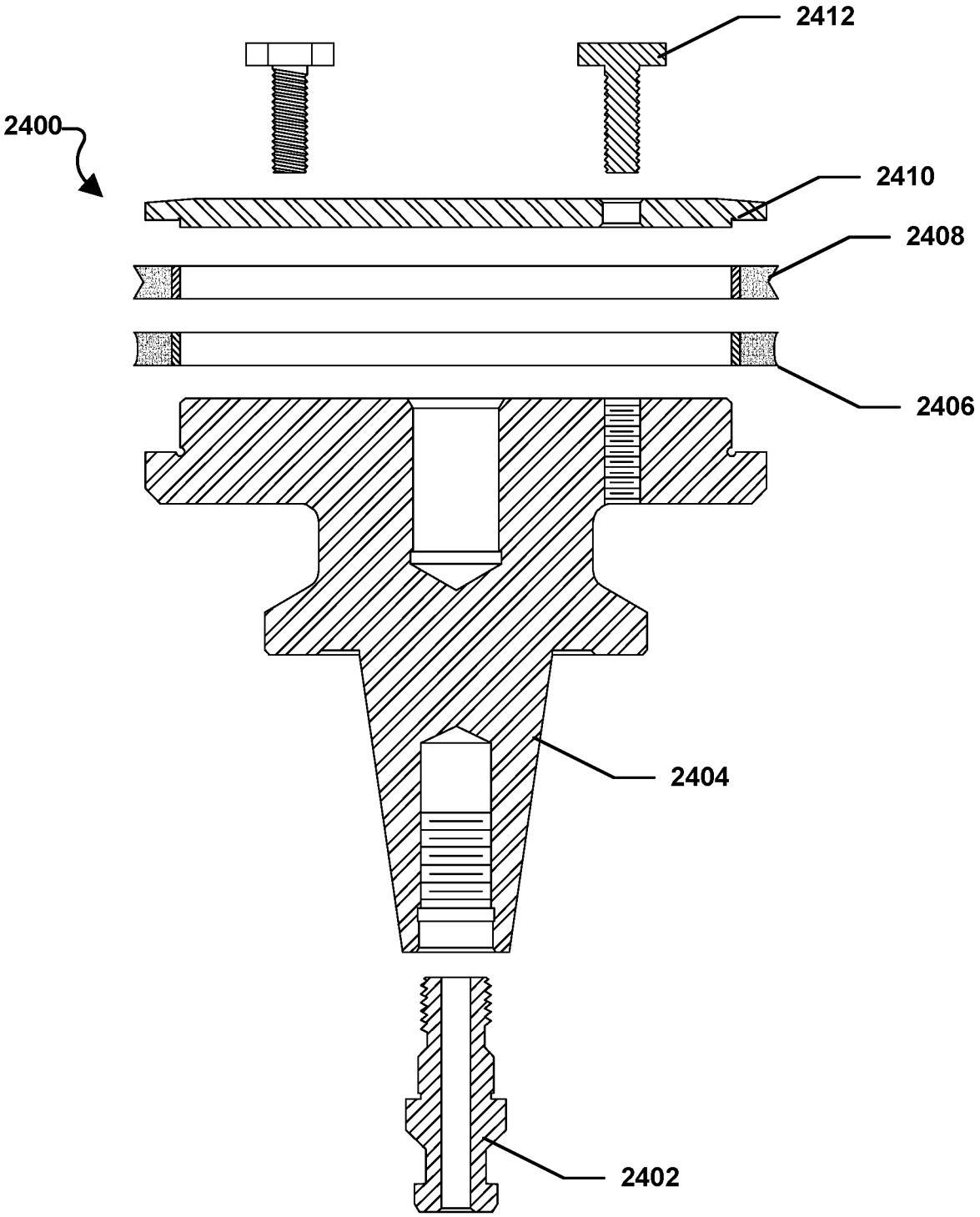
FIG. 27 includes an illustration of a cross-section view of a grinding wheel assembly in accordance with an embodiment.
Figure 28:
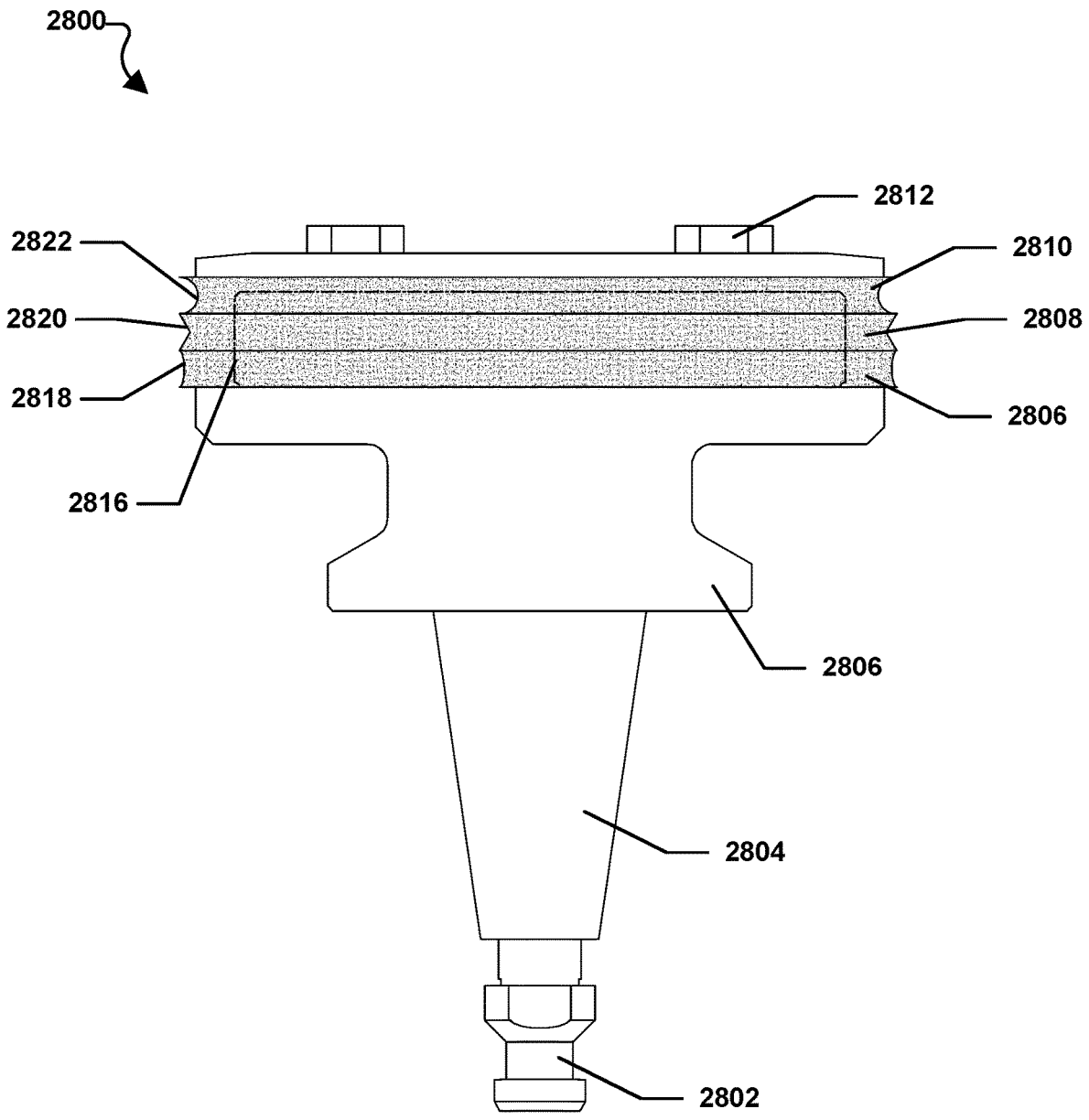
FIG. 28 includes an illustration of a side plan view of a grinding wheel assembly in accordance with an embodiment.
Figure 29:
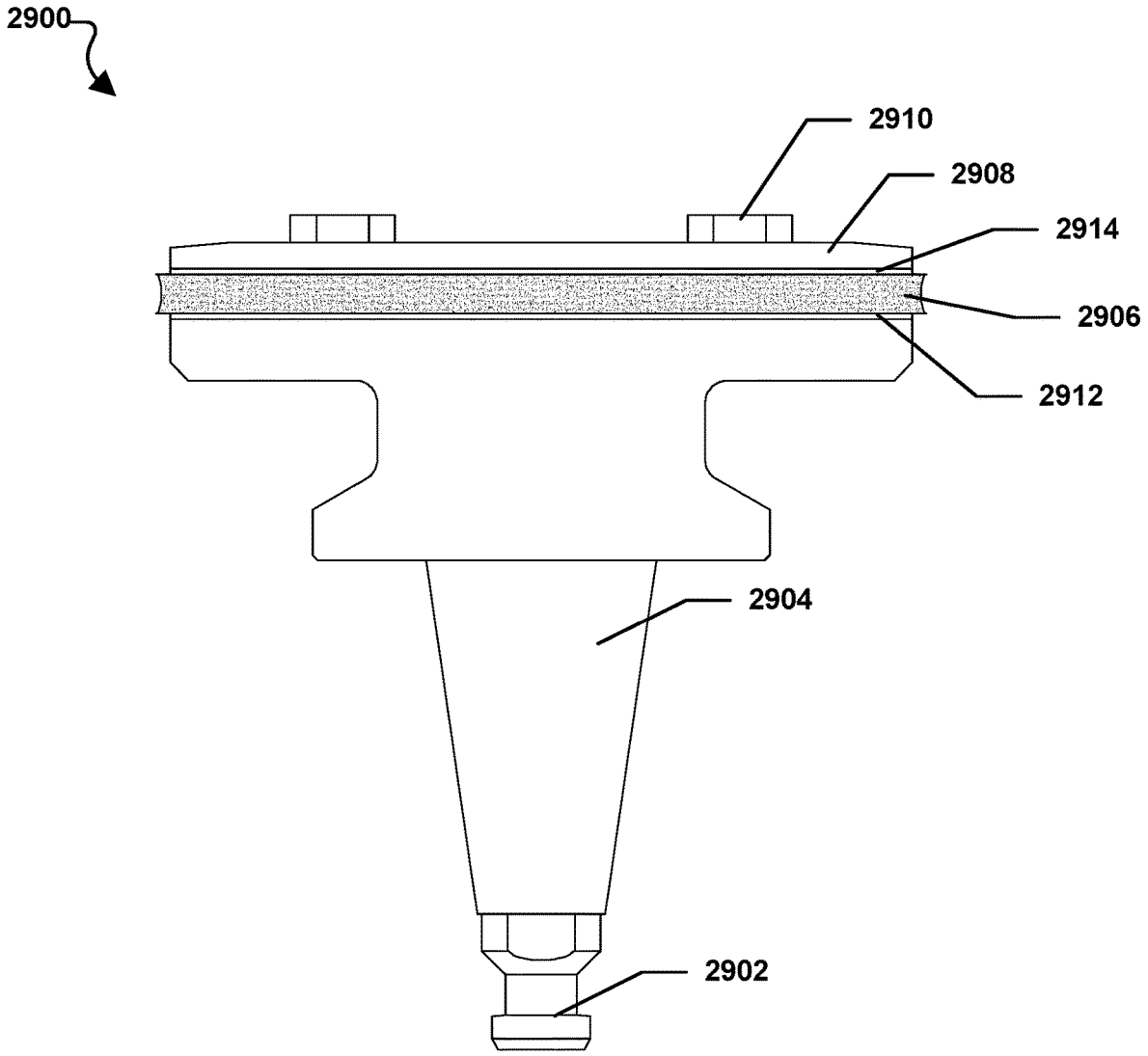
FIG. 29 includes an illustration of a side plan view of a grinding wheel assembly in accordance with an embodiment.
Figure 30:
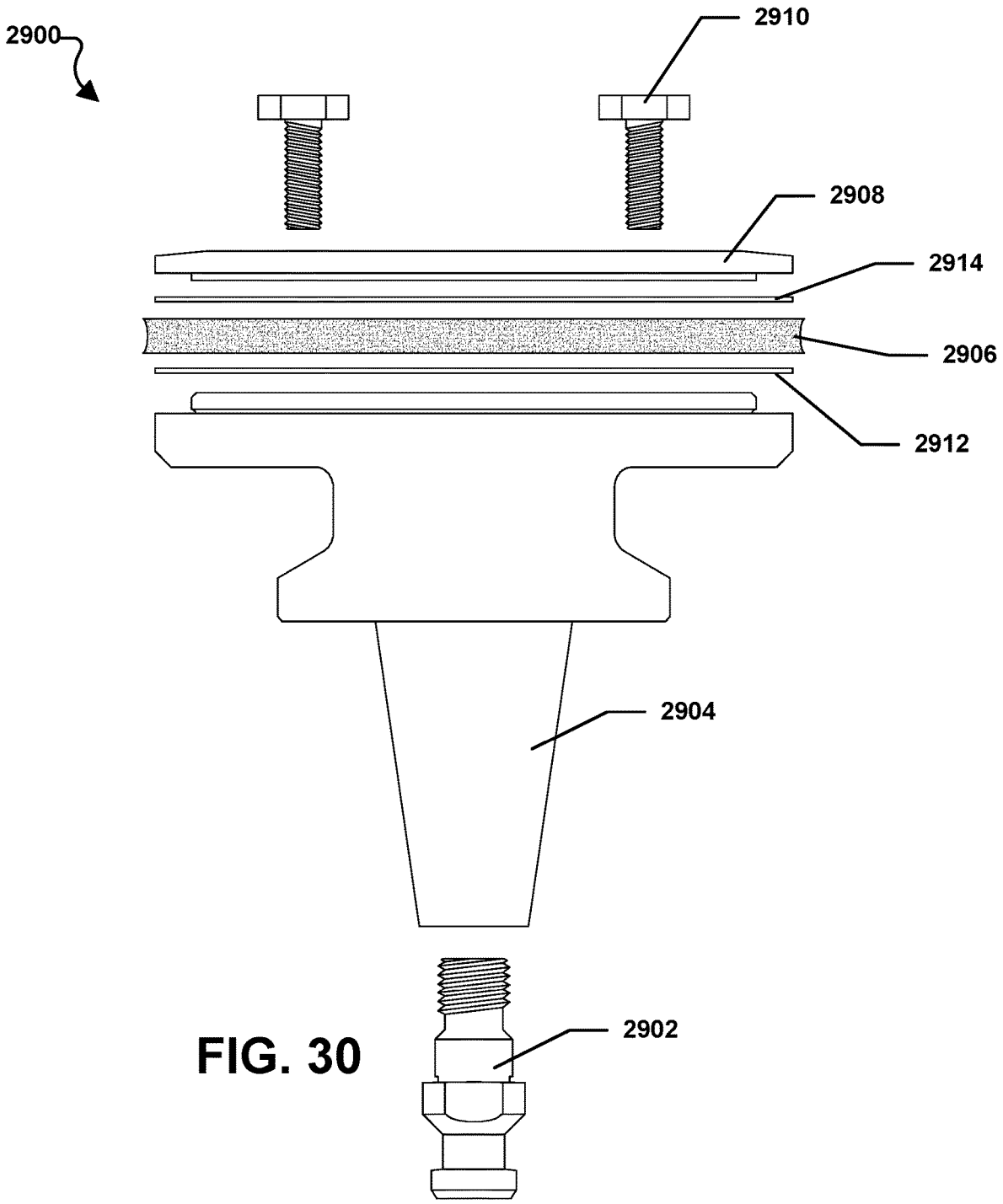
FIG. 30 includes an illustration of an exploded side plan view of a grinding wheel assembly in accordance with an embodiment.
Figure 31:
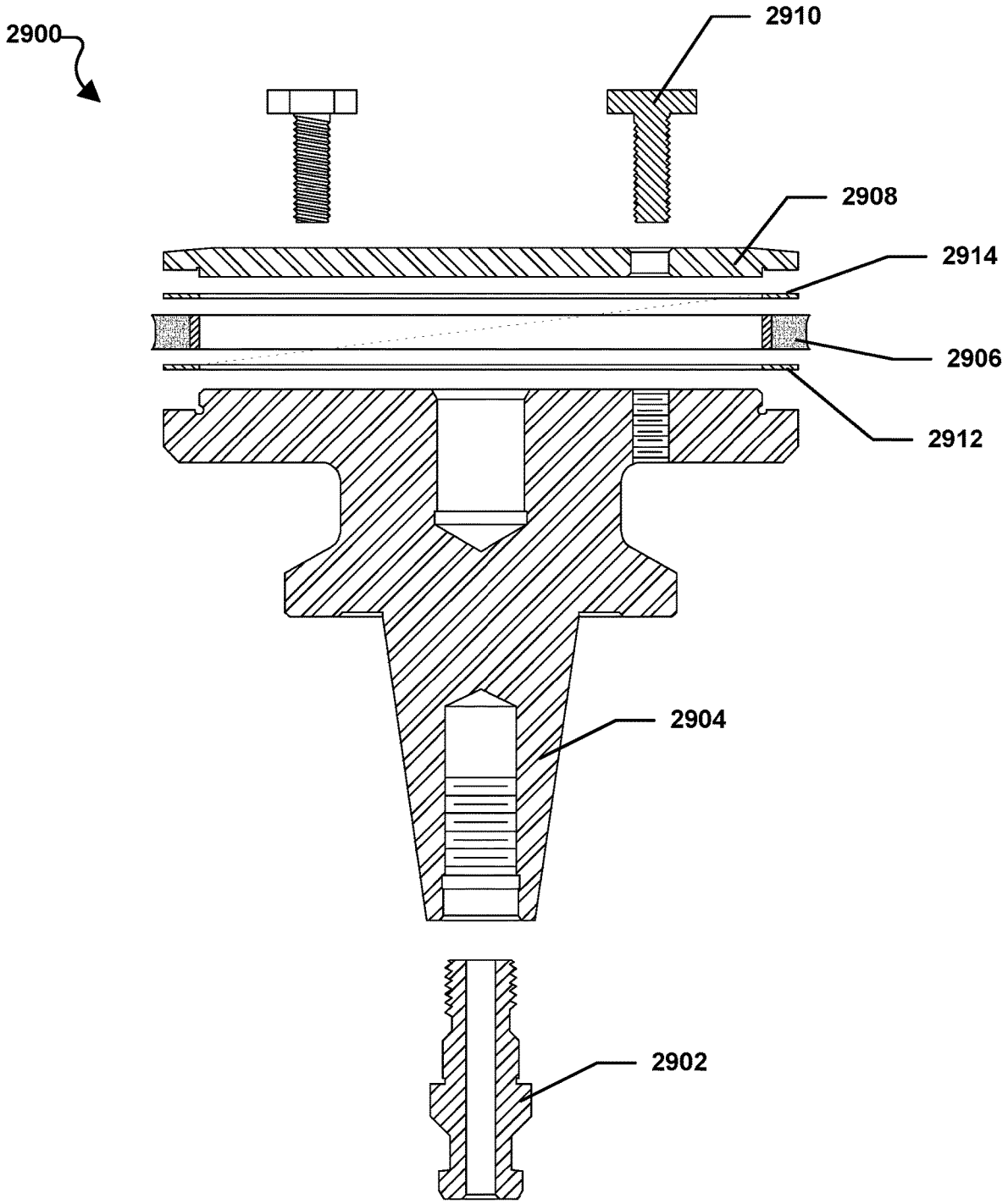
FIG. 31 includes an illustration of an exploded cross-section view of a grinding wheel assembly in accordance with an embodiment.
Figure 32:
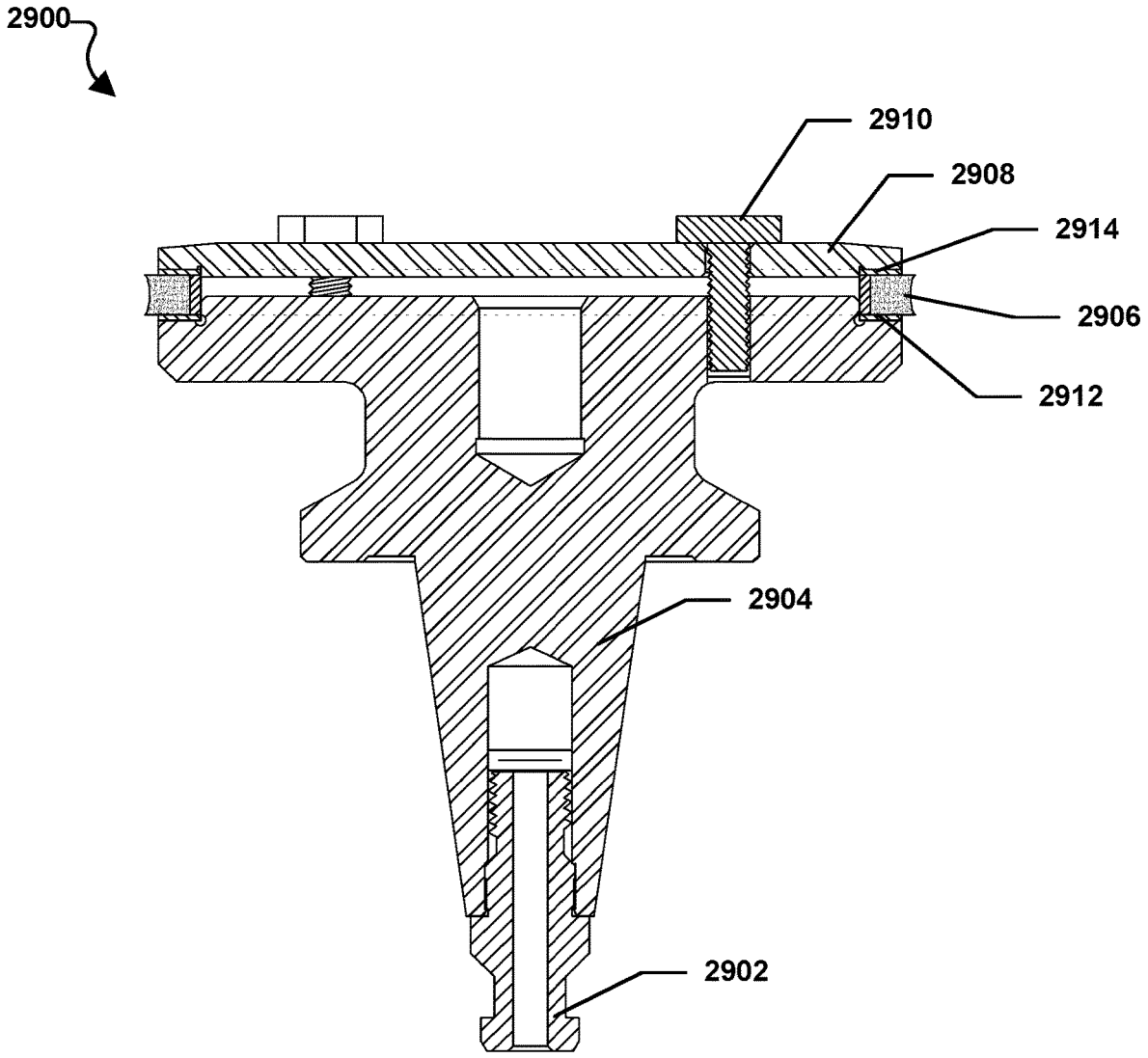
FIG. 32 includes an illustration of a cross-section view of a grinding wheel assembly in accordance with an embodiment.

In one aspect, the mounting plate 140 can have an average thickness, $T_{MP}$. Further, the mounting hub 142 can have an average thickness, $T_{MH}$. $T_{MH}$ may depend on whether the grinding wheel assembly 100 is configured to receive a single abrasive body 106, as shown in FIG. 1; two abrasive bodies, as shown in FIG. 24 and described in detail below; or three abrasive bodies, as shown in FIG. 28 and also described in detail below.

For example, $T_{MH}$ may be less than or equal to 30 millimeters (mm). Further, $T_{MH}$ may be less than 25 mm, such as less than 20 mm, less than 15 mm, or less than 12.5 mm. In another aspect, $T_{MH}$ can be greater than 2.5 mm. In particular, $T_{MH}$ can be greater than 3 mm, such as greater than 3.5 mm or greater than 4 mm.

In another aspect, $T_{MH}$ is less than or equal to $T_{MP}$. For example, $T_{MH}$ can be less than 95% $T_{MP}$. Further, $T_{MH}$ is less than 90% $T_{MP}$, such as less than 85% $T_{MP}$, less than 80% $T_{MP}$, or less than 75% $T_{MP}$. Moreover, $T_{MH}$ can be greater than 10% $T_{MP}$. In particular, $T_{MH}$ can be greater than 15% $T_{MP}$, such as greater than 20% $T_{MP}$, greater than 25% $T_{MP}$, or greater than 27.5% $T_{MP}$.

As illustrated in FIG. 11 and FIG. 13, the mounting plate 140 can include at least one threaded bore 144 radially offset from a central axis 146. The at least one threaded bore 144 can be configured to received the at least one fastener 110 shown in FIG. 1.

Figure 12:
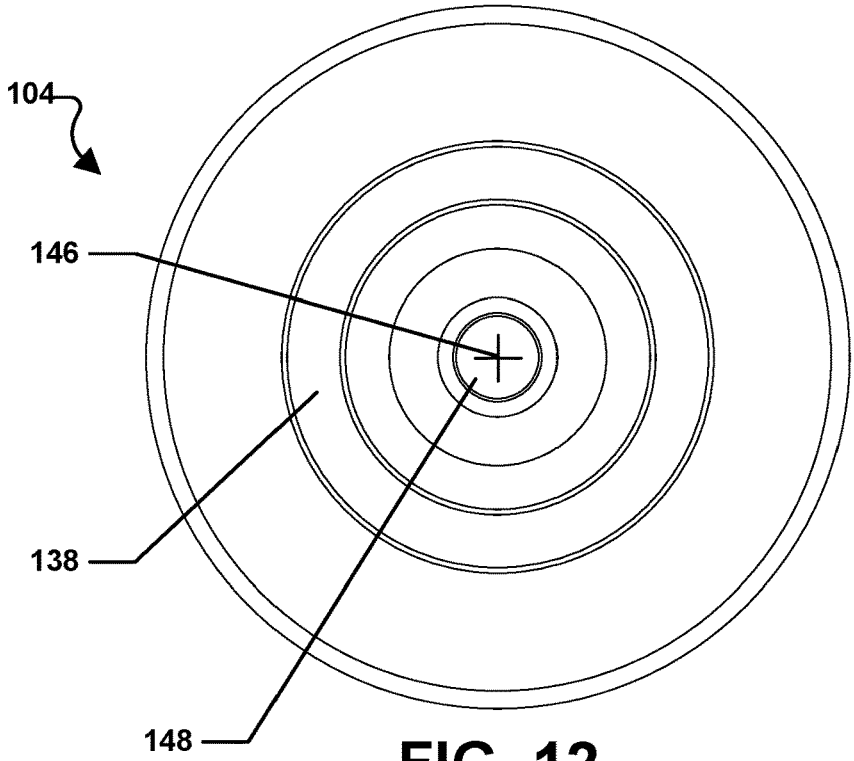
FIG. 12 includes an illustration of a bottom plan view of an arbor for a grinding wheel assembly in accordance with an embodiment.

FIG. 12 and FIG. 13 further indicate that the body 130 of the arbor 104 can also include a proximal central bore 148 formed at, and extending into, the proximal end 132 of the body 130 of the arbor 104 along the central axis 146. Specifically, the proximal central bore 148 formed in the proximal end 132 of the body 130 of the arbor 104 can extend into the body 130 of the arbor 104 a predetermined length. Moreover, the proximal central bore 148 can be formed with threads, i.e., screw threads, at least partially along the length of the proximal central bore 148. It can be appreciated that the proximal central bore 148 formed at the proximal end 132 of the body 130 of the arbor 104 can be configured to receive the pull stud 102 shown in FIG. 1, FIG. 3, and FIG. 4 through 9. More particularly, the proximal central bore 148 formed in the proximal end 132 of the body 130 of the arbor 104 can be configured to receive the threads 120 formed on the pull stud 102.

FIG. 11 and FIG. 13 indicate that the body 130 of the arbor 104 can also include a distal central bore 150 formed at, and extending into, the distal end 134 of the body 130 of the arbor 104 along the central axis 146. Specifically, the distal central bore 150 formed in the distal end 134 of the body 130 of the arbor 104 can extend into the body 130 of the arbor 104 a predetermined length. As shown, the distal central bore 150 can be a smooth walled bore. Further, the distal central bore 150 can be configured to removably engage a tool (not shown).

In another aspect, the arbor 104 can be a composite structure having a core structure around which other structures may be molded, e.g., injection molded. For example, the mounting plate 140 can be resin material that is molded onto or around a portion of the arbor.

Abrasive Body

Figure 14:
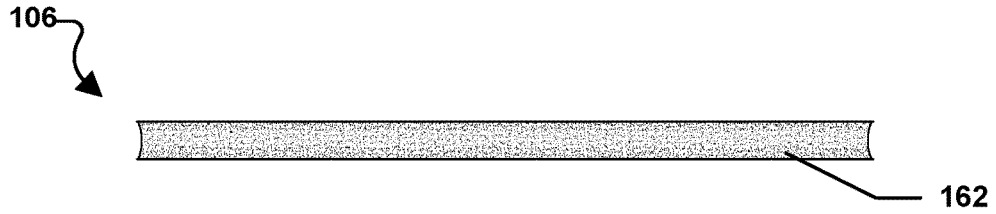
FIG. 14 includes an illustration of a side plan view of an abrasive body for a grinding wheel assembly in accordance with an embodiment.
Figure 15:
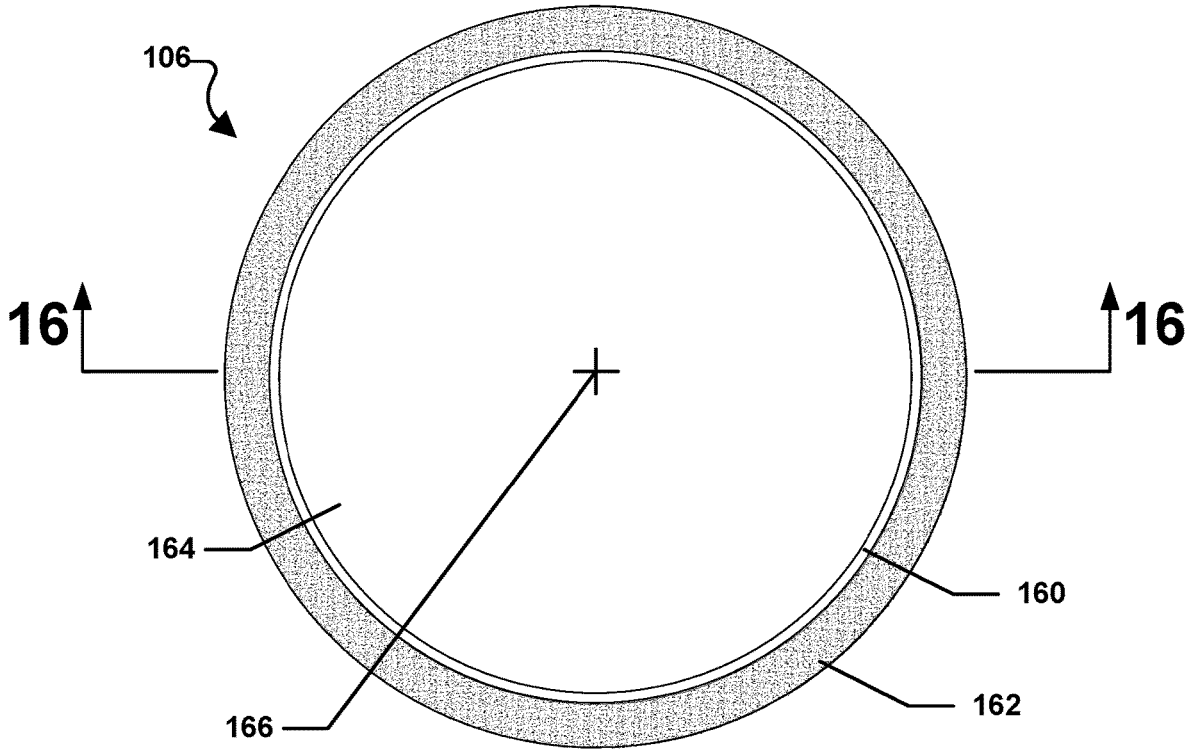
FIG. 15 includes an illustration of a top plan view of an abrasive body for a grinding wheel assembly in accordance with an embodiment.
Figure 16:
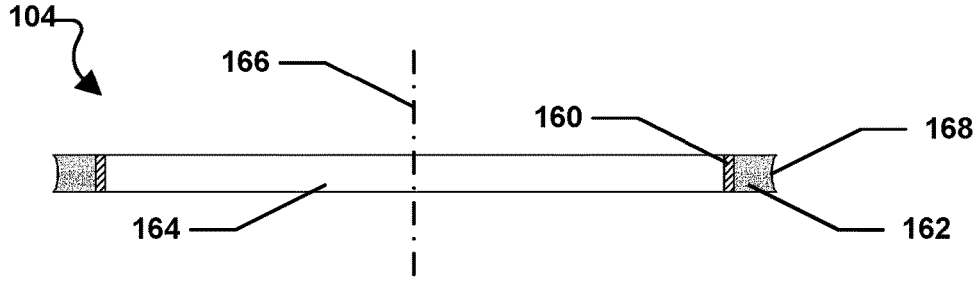
FIG. 16 includes an illustration of a cross-section view of an abrasive body for a grinding wheel assembly in accordance with an embodiment taken along line 16-16 in FIG. 15.

Referring now to FIG. 14 through FIG. 16, details regarding the abrasive body 106 are shown. The abrasive body 106 can include a backing 160 and an abrasive portion 162 mounted on the backing 160. A central bore 164 can be formed within the backing 160 of the abrasive body 106 along a central axis 166.

In a particular aspect, the backing 160 can be generally ring shaped and the backing 160 can include a metal or a metal alloy. Further, the backing 160 can include steel. In another aspect, the backing 160 may be bronze. Further still, the backing 160 can be made from a composite material, e.g., a carbon fiber composite. In a particular aspect, the abrasive portion 162 may be brazed to the backing 160. In another aspect, the abrasive portion 162 may be sinter bonded to the backing 160. Moreover, in another aspect, the abrasive portion 162 may be adhered to the backing 160, for example, using an adhesive.

In a particular aspect, the abrasive portion 162 can include abrasive particles fixed in a bond material. Suitable abrasive particles can include, for example, oxides, carbides, nitrides, borides, diamond, cubic boron nitride, silicon carbide, boron carbide, alumina, silicon nitride, tungsten carbide, zirconia, or a combination thereof. In a particular aspect, the abrasive particles of the bonded abrasive are diamond particles. In at least one embodiment, the abrasive particles can consist essentially of diamond.

The abrasive particles contained in the bonded abrasive body can have an average particle size suitable to facilitate particular grinding performance. For example, the abrasive particles can have a size less than about 2000 μm, such as less than about 1000 μm, less than about 500 μm, or less than about 300 μm. In another aspect, the abrasive particles can have a size of at least 0.01 μm, such as at least 0.1 μm, at least about 1 μm, at least 5 μm or at least 10 μm. It will be appreciated that the size of the abrasive particles contained in the bonded abrasive can be within a range between any of the minimum and maximum values noted above, such as from about 0.01 μm to about 2000 μm, from about 1 μm to about 500 μm, from about 5 μm to about 300 μm or from about 50 μm to about 150 μm.

The bond material of the bonded abrasive body can include an inorganic material, an organic material or any combination thereof. Suitable inorganic materials for the use as bond material may include metals, glass, ceramics, glass-ceramics or any combination thereof. For example, an inorganic bond material can include one or more metal compositions or elements such as Cu, Sn, Fe, W, WC, Co or any combination thereof. Organic materials may include resins, for example thermosets, thermoplastics or any combination thereof. For example, some suitable resins can include phenolic resins, epoxies, polyesters, cyanate esters, shellacs, polyurethanes, rubber, polyimides or any combination thereof.

As illustrated in FIG. 14 and FIG. 16, the abrasive portion 162 of the abrasive body 106 can have outer peripheral surface 168 that may have a profile ground therein. As shown, the profile may be concave, or U-shaped. However, in other aspects, the profile may be angular, or V-shaped. The profile of the outer peripheral surface 168 of the abrasive portion 162 of the abrasive body 106 will be reproduced in reverse on the material to be shaped by the grinding wheel assembly 100.

The abrasive body 106 of the present disclosure may be selected from a range of suitable sizes to facilitate efficient grinding depending upon the workpiece. In one embodiment, the abrasive body 106 can include a diameter of at least about 25 mm, such as at least about 30 mm or at least about 50 mm. In another embodiment, the diameter may be not greater than 500 mm, such as not greater than 450 mm, not greater than 300 mm or not greater than 200 mm. It will be appreciated that the diameter can be within a range between any of the minimum and maximum values noted above, such as from about 25 mm to about 500 mm, from about 50 mm to about 250 mm, or from about 25 mm to about 150 mm.

In a particular aspect, the abrasive can include a thickness, $T_A$, and the backing can have a thickness, $T_B$. Further, $T_B$ is greater than $T_A$. For example, $T_B$ can be at least 101% $T_A$. Moreover, $T_B$ can be at least 102% $T_A$, such as 103% $T_A$, 104% $T_A$, or 105% $T_A$. In another aspect, $T_B$ is no greater than 115% $T_A$. Further, $T_B$ can be at least 114% $T_A$, such as 113% $T_A$, 112% $T_A$, 111% $T_A$, or 110% $T_A$. In another aspect, $T_B$ can be within a range between and including any of the minimum and maximum values described above. It can be appreciated that the height differential between the backing and the abrasive may prevent the abrasive from being cracked if the fasteners are over tightened.

In another aspect, the backing can have a hardness, $H_B$, and the cover plate can have a hardness, $H_{CP}$. In this aspect, $H_B$ may be less than $H_{CP}$. As such, the backing may deform as the fasteners are tightened and this may prevent the abrasive from cracking if the fasteners are over tightened.

Cover Plate

Figure 17:
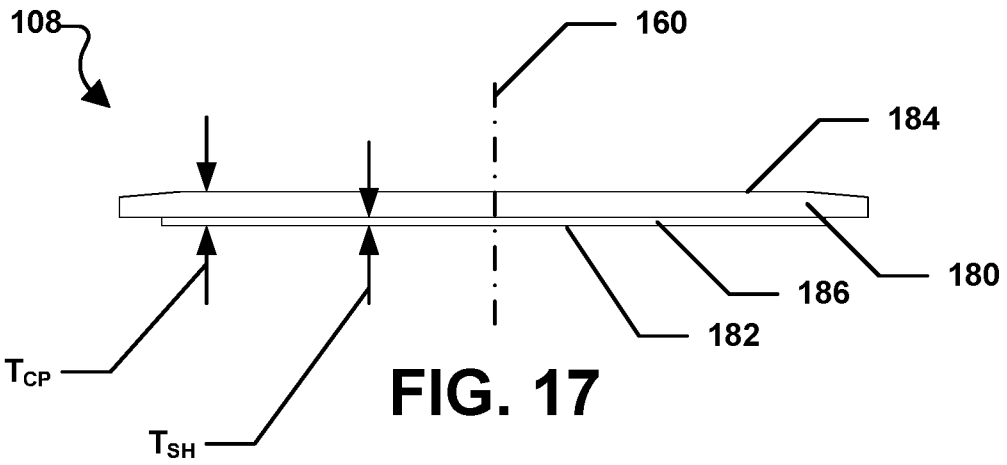
FIG. 17 includes an illustration of a side plan view of a cover plate for a grinding wheel assembly in accordance with an embodiment.
Figure 18:
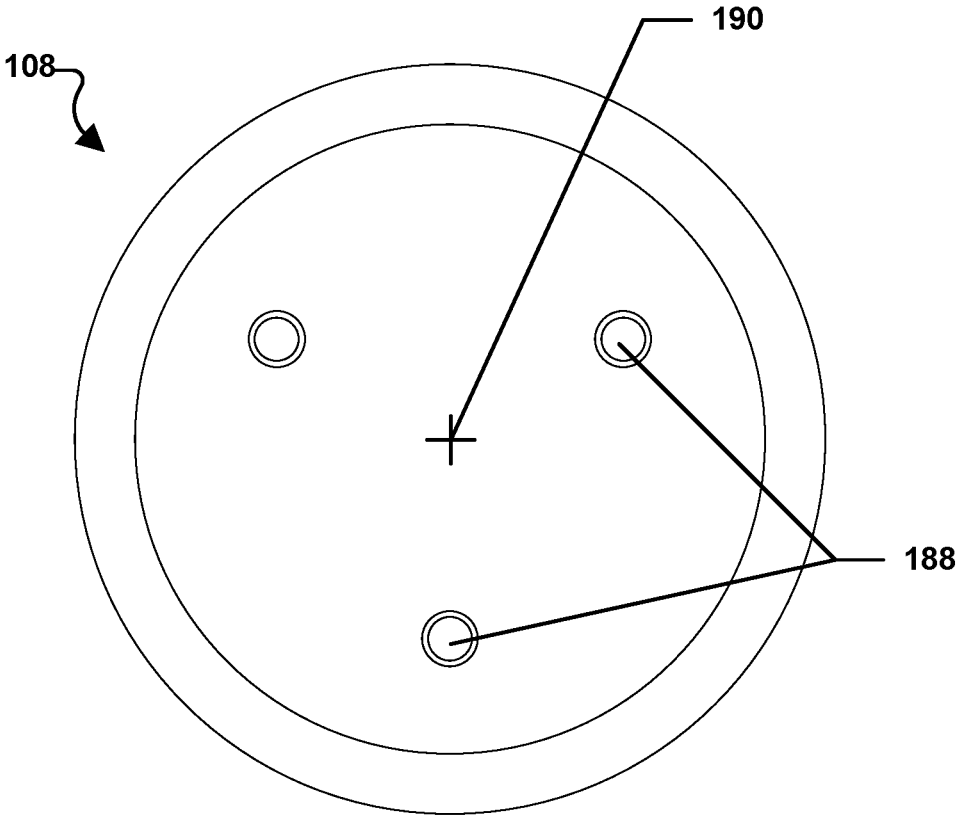
FIG. 18 includes an illustration of a top plan view of a cover plate for a grinding wheel assembly in accordance with an embodiment.
Figure 19:
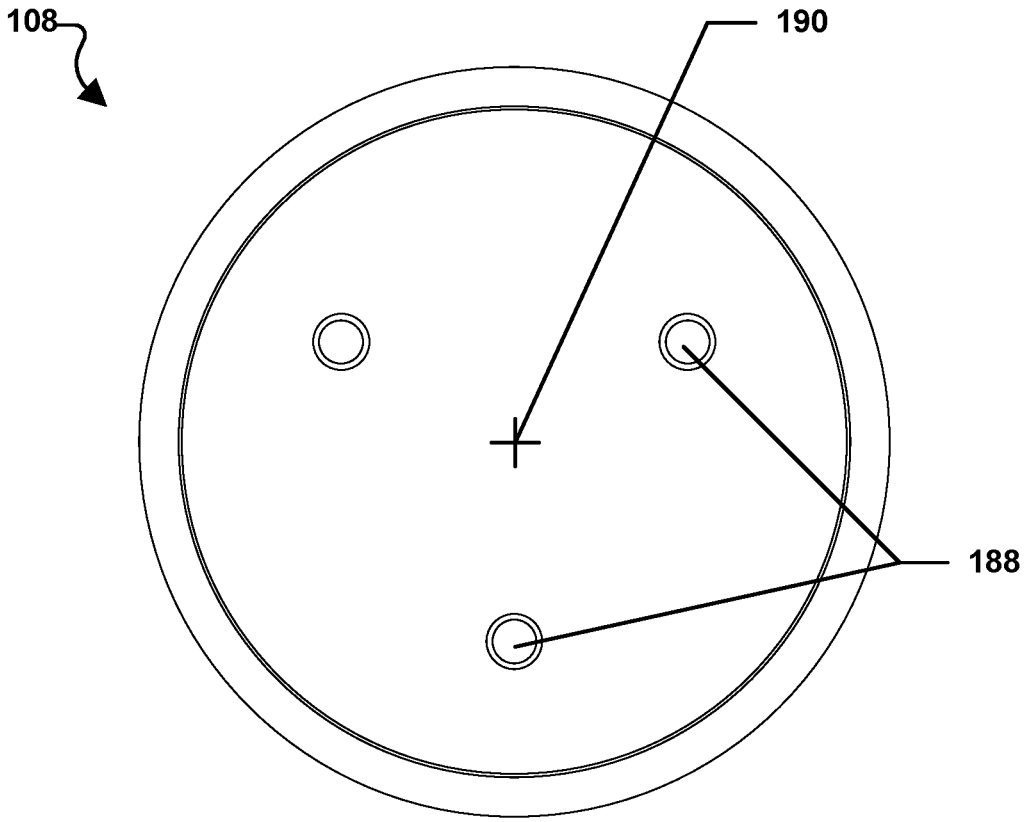
FIG. 19 includes an illustration of a bottom plan view of a cover plate for a grinding wheel assembly in accordance with an embodiment.
Figure 20:
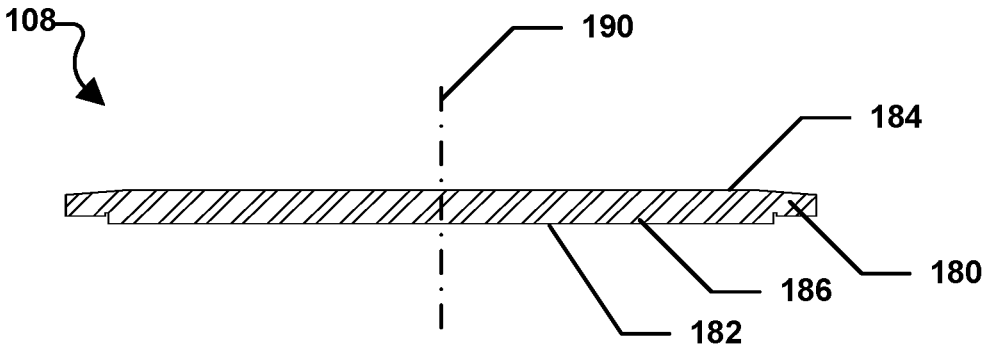
FIG. 20 includes an illustration of a cross-section view of a cover plate for a grinding wheel assembly in accordance with an embodiment.
Figure 22:
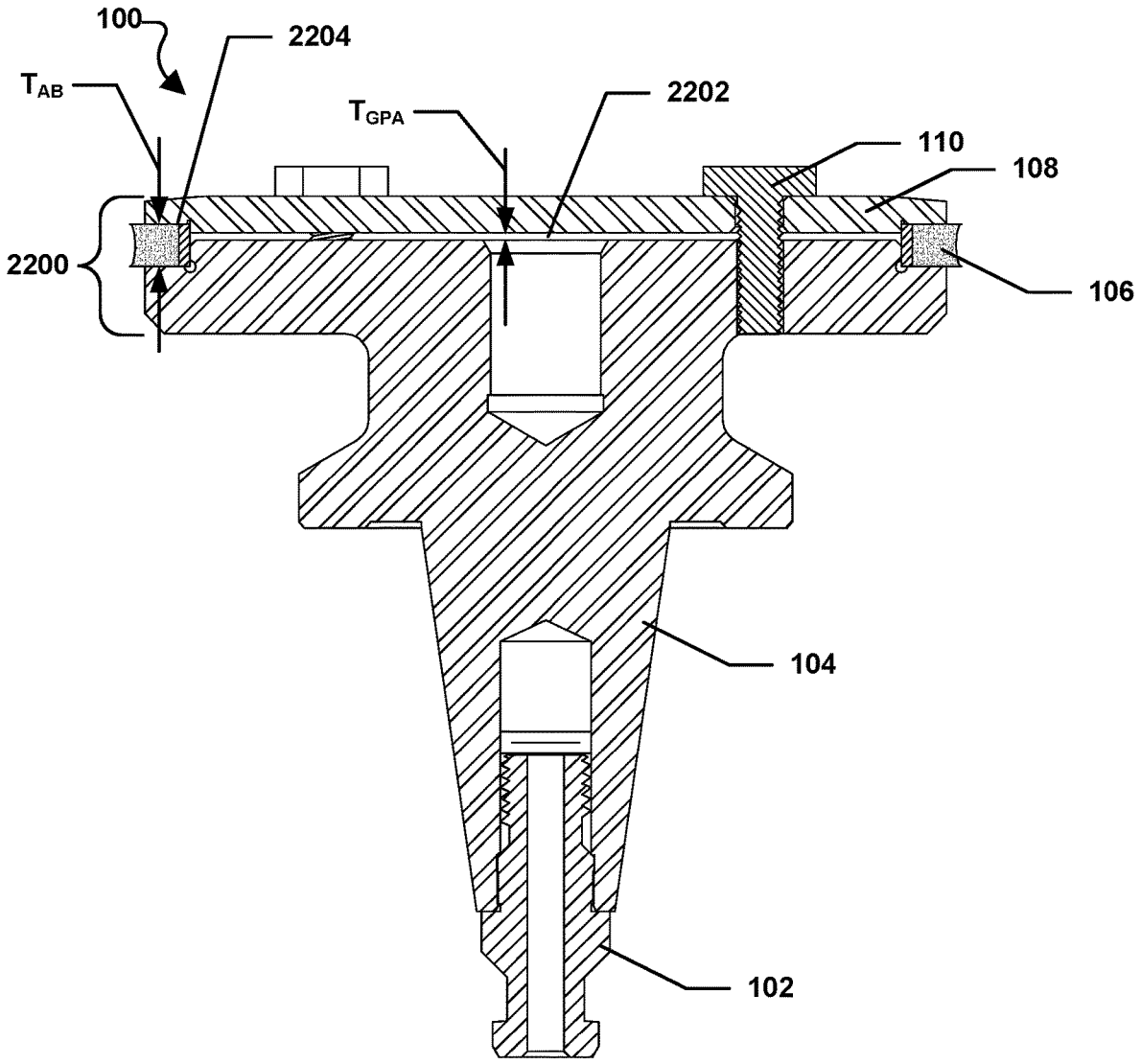
FIG. 22 includes an illustration of a cross-section view of a grinding wheel assembly in accordance with an embodiment.

FIG. 17 through FIG. 20 illustrate the details concerning the construction of the cover plate 108. The cover plate 108 can include a body 180 that is disk-shaped. Further, the body 180 of the cover plate 108 can include a proximal surface 182 and a distal surface 184. A generally cylindrical support hub 186 can extend outwardly from the proximal surface 182 as indicated in FIG. 17 and FIG. 20. The support hub 186 is configured to extend into and support the abrasive body 106 when the grinding wheel assembly 100 is assembled as shown in FIG. 1 and FIG. 22.

In a particular aspect, the cover plate defines an average thickness, $T_{CP}$, and the support hub defines a thickness, $T_{SH}$. Further, $T_{SH}$ is less than or equal to $T_{CP}$. For example, $T_{SH}$ is less than 50% $T_{CP}$. Further, $T_{SH}$ is less than 45% $T_{CP}$, such as less than 40% $T_{CP}$, less than 35% $T_{CP}$, or less than 30% $T_{CP}$. In another aspect, $T_{SH}$ is greater than 15% $T_{CP}$. Moreover, $T_{SH}$ is greater than 17.5% $T_{CP}$, such as greater than 20% $T_{CP}$, or greater than 22.5% $T_{CP}$.

As shown in FIG. 18 and FIG. 19, the body 180 of the cover plate 108 can include at least one bore 188 extending through the cover plate 108, i.e., between the proximal surface 182 and the distal surface 184. The at least one bore 188 can be radially offset from a central axis 190. The at least one bore 188 can be smooth walled bore and may be sized and shaped to allow the at least one fastener, shown in FIG. 1, to extend through the at least one bore 188 and engage the at least one bore 188 in a slip fit arrangement.

Assembled Grinding Wheel Assembly

Figure 21:
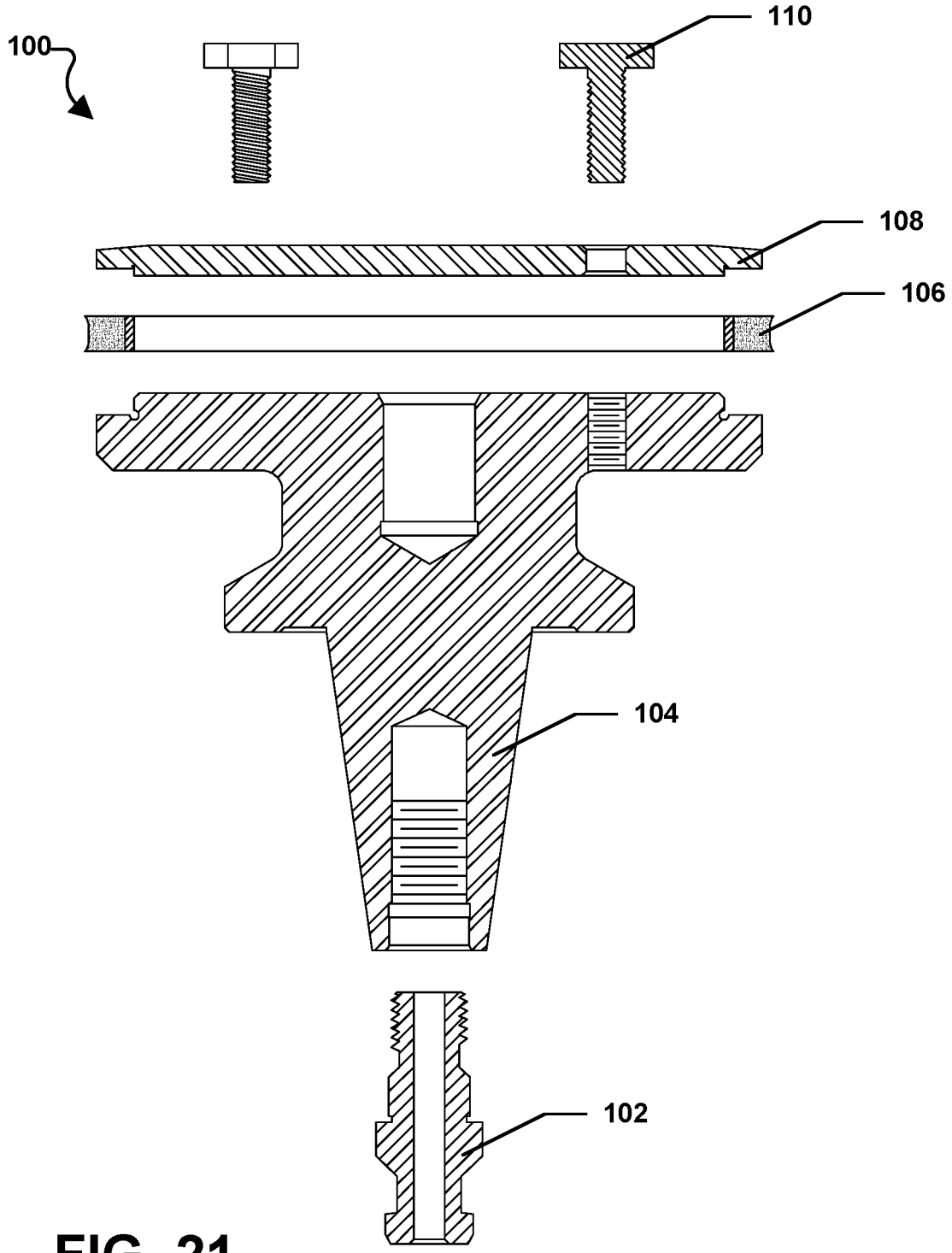
FIG. 21 includes an illustration of an exploded cross-section view of a grinding wheel assembly in accordance with an embodiment.
Figure 23:
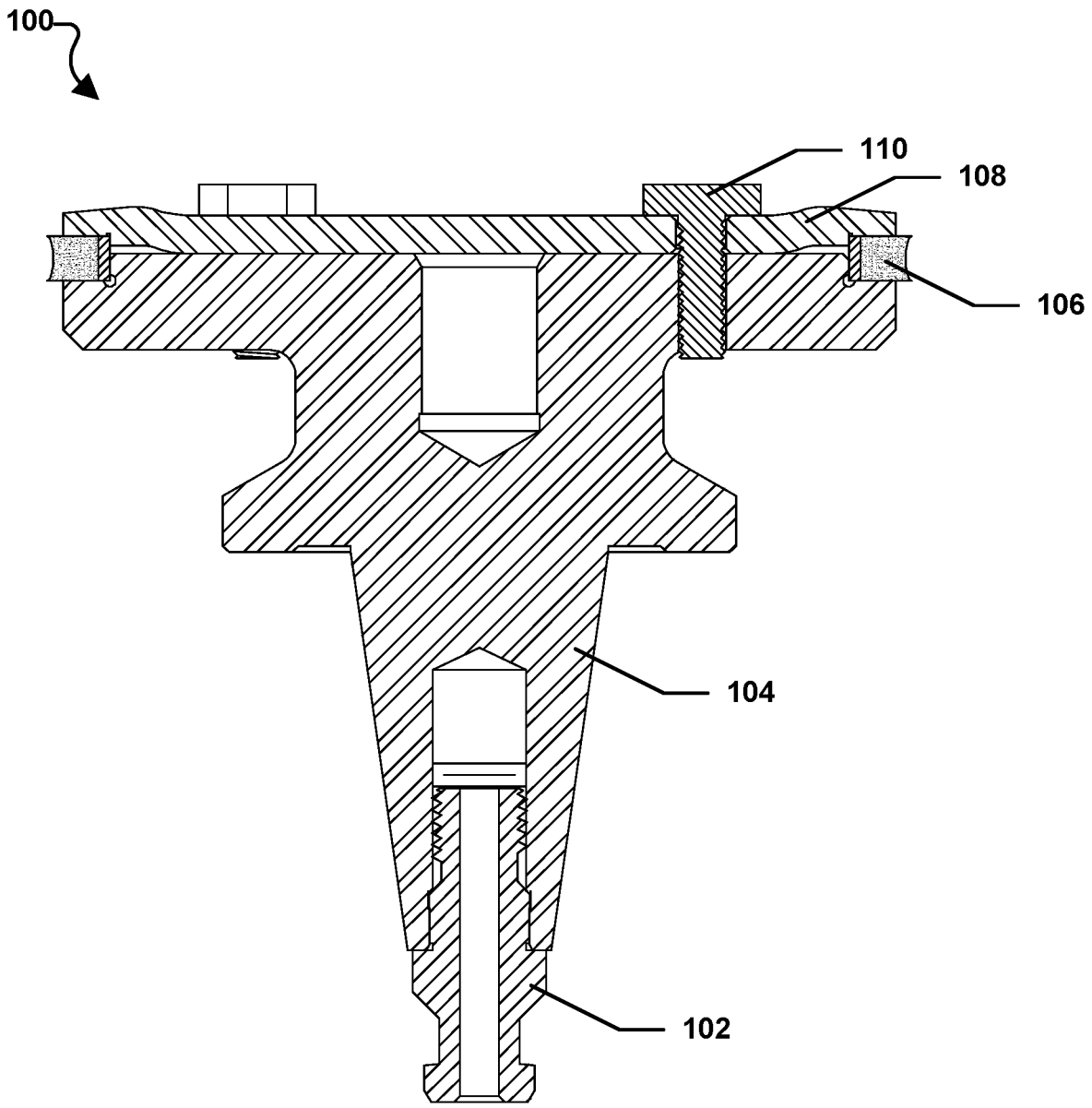
FIG. 23 includes an illustration of a cross-section view of a grinding wheel assembly in accordance with an embodiment.

Referring now to FIG. 21 through FIG. 23, the threads 120 on the pull stud 102 can be inserted into, and engaged with, the proximal central bore 148 of the arbor 104. Further, the abrasive body 106 can be installed on the mounting hub 142 of the arbor 104 so that the backing 160 of the body 106 circumscribes the outer surface of the mounting hub 142. Thereafter, the cover plate 108 can be installed over the abrasive body 106 so that the support hub 186 extends at least partially into the central bore 164 of the abrasive body 106. The bore 188 in the cover plate 108 can be aligned with the threaded bore 144 in the mounting plate 140 of the arbor 104. Moreover, the fastener 110 can be installed through the bore 188 of the cover plate 108 and rotated to engage the threaded bore 144 of the mounting plate 140 on the arbor 104.

When assembled, as illustrated in FIG. 22, the mounting plate 140, the abrasive body 106, and the cover plate 108 can establish a head assembly 2200. Further, a channel region 2202 can be established within the head assembly 2200 between the mounting plate 140 and the cover plate 108 around the mounting hub 142 and the support hub 186. The abrasive body 106 resides in the channel region 2202. Further, the abrasive body 106 can define a thickness, $T_{AB}$.

As shown, a pre-assembled gap region 2204 can be established between the mounting hub 142 and the support hub 186. The pre-assembled gap region 2204 exists after the parts are assembled, but before the fastener 110 is tightened to a proper torque. In particular, the pre-assembled gap 2204 can have a gap distance, or gap thickness, $T_{GPA}$ and $T_{GPA}$ can be less than $T_{AB}$. For example, $T_{GPA}$ can be less than 30% $T_{AB}$. Further, $T_{GPA}$ can be less than 25% $T_{AB}$, such as less than 22.5% $T_{AB}$, less than 20% $T_{AB}$, less than 17.5% $T_{AB}$, or less than 15% $T_{AB}$. In another aspect, $T_{GPA}$ can be greater than 2.5% $T_{AB}$. $T_{GPA}$ can be greater than 5% $T_{AB}$, such as greater than 7.5% $T_{AB}$, greater than 10% $T_{AB}$, or greater than 12.5% $T_{AB}$. It is to be understood that $T_{GPA}$ can be within a range between and including any of the minimum and maximum values herein. In a particular aspect, after the fastener 110 is tightened with the proper torque and the grinding wheel assembly 100 is ready for use, i.e., ready to be engaged with a drive assembly to perform grinding operations, the gap region 2204 can remain. However, the gap region 2204 may then be considered an assembled gap region. As described in greater detail below, the assembled gap region may have a gap distance, or gap thickness, $T_{GA}$, that is less than $T_{GPA}$ due to slight deformation of the cover plate 108.

In another aspect, $T_{GPA}$ can be less than or equal to 2.5 millimeters (mm). Moreover, $T_{GPA}$ can be less than 2.25 mm, such as less than 2 mm, less than 1.75 mm, less than 1.5 mm, or less than 1.25 mm. In still another aspect, $T_{GPA}$ is greater than 0.25 mm. Further, $T_{GPA}$ is greater than 0.375 mm, such as greater than 0.5 mm, greater than 0.625 mm, greater than 0.75 mm, greater than 0.875 mm, or greater than 1 mm.

In a particular aspect, the cover plate 108 and the mounting plate 140 are configured to be coupled with a clamping force across the channel region 2202 by the fasteners 110 in order to hold the abrasive body 106 within the channel region 2202. The torque applied to the fasteners 110 can properly tighten the cover plate 108 to the mounting plate 140 and secure the abrasive body 106 there between. In order to provide the proper clamping force, the torque, T, applied to each faster 110 can be at least 20 Newton meters (N●m). Further, T can be at least 25 N●m, such as at least 30 N●m, at least 35 N●m, or at least 40 N●m. In another aspect, T may be no greater than 60 N●m, such as no greater than 55 N●m, no greater than 50 N●m, or no greater than 45 N●m. It is to be understood that T may be within a range between and including any of the values of T described above. It is also to be understood that T is for fasteners 110 that include standard grade 12.9 M8 socket head cap screws.

In the event that the fastener 110 is over-tightened, the cover plate 108 can deform, or deflect, as illustrated in FIG. 23, so that the support hub 186 of the cover plate 108 comes into contact with the mounting hub 142. This deflection of the cover plate 108 can prevent the cover plate 108 from being over-tightened and potentially cracking the abrasive 162 of the abrasive body 106. It can be appreciated, however, if the fastener 110 is properly tightened the gap region 2204 may remain, but the assembled gap distance or thickness, $T_{GA}$, may be less than the pre-assembled gap distance or thickness, $T_{GPA}$. For example, $T_{GA}$ may be less than 99% $T_{GPA}$. Further, $T_{GA}$ may be less than 98% $T_{GPA}$, such as less than 97.5% $T_{GPA}$, less than 97% $T_{GPA}$, less than 96.5% $T_{GPA}$, or less than 96% $T_{GPA}$. In a properly assembled grinding wheel assembly 100, $D_{GA}$ may be greater than 90% $T_{GPA}$. Further, $T_{GA}$ may be greater than 91% $T_{GPA}$, such as greater than 92% $T_{GPA}$, greater than 93% $T_{GPA}$, greater than 94% $T_{GPA}$, or greater than 95% $T_{GPA}$. It is to be understood that $T_{GA}$ may be within a range between and including any of maximum and minimum values described above.

In another aspect, $T_{GA}$ can be less than or equal to 2.25 millimeters (mm). Moreover, $T_{GA}$ can be less than 2 mm, such as less than 1.75 mm, less than 1.5 mm, less than 1.25 mm, or less than 1 mm. In still another aspect, $T_{GA}$ is greater than 0.2 mm. Further, $T_{GA}$ is greater than 0.25 mm, such as greater than 0.375 mm, greater than 0.5 mm, greater than 0.625 mm, greater than 0.75 mm, or greater than 0.875 mm.

Grinding Wheel Assemblies with Multiple Abrasive Bodies

Referring to FIG. 24 through FIG. 27, a grinding wheel assembly is illustrated and is generally designated 2400. As shown, the grinding wheel assembly 2400 can include a pull stud 2402, an arbor 2404, a first abrasive body 2406, a second abrasive body 2408, a cover plate 2410, and at least one fastener 2412, e.g., a threaded fastener.

It can be appreciated that the pull stud 2402 can be configured substantially identical to the pull stud 102 described above. Further, the arbor 2404 can be mostly identical to the arbor 104 described above. The arbor 2404 illustrated in FIG. 24 through FIG. 27 includes a mounting hub 2414 that is configured to receive two abrasive bodies 2406, 2408, i.e., the thickness of the mounting hub 2414 is greater than the thickness of the mounting hub 142 of the arbor 104 described above. The first abrasive body 2406 can be substantially identical to the abrasive body 106 described above and the second abrasive body 2408 can be mostly identical to the abrasive body 106 described above.

In particular, the first abrasive body 2406 can have an outer profile 2416 that is same as the outer profile of the abrasive body 106 described above. In other words, the outer profile 2416 of the first abrasive body 2406 can be concave or generally U-shaped. The outer profile 2418 of the second abrasive body 2408 can be generally angular or V-shaped. As such, the first abrasive body 2406 has an outer profile 2416 that is different from the outer profile 2418 of the second abrasive body 2408.

In another aspect, the first abrasive body 2406 can have a first abrasive grit size and the second abrasive body 2408 can have a second abrasive grit size that can be different from the first abrasive grit size. During use, by translating the grinding wheel assembly 2400 along a linear axis perpendicular to a workpiece, a user can switch between the first abrasive body 2406 having the first abrasive grit size and the second abrasive body 2408 having the second abrasive grit size without having to change to a different grinding wheel assembly (not shown).

It can be appreciated that the cover plate 2410 is substantially identical to the cover plate 108 described above. Moreover, the fastener 2412 is substantially identical to the fastener 110 described above. The grinding wheel assembly 2400 can be assembled in the same manner as the grinding wheel assembly 100 described above with the additional step of installing the second abrasive body 2408 over the mounting hub 2414 on top of the first abrasive body 2406 before installing the cover plate 2410 and the fastener 2412.

FIG. 28 illustrates another aspect of a grinding wheel assembly that is generally designated 2800. As shown, the grinding wheel assembly 2800 can include a pull stud 2802, an arbor 2804, a first abrasive body 2806, a second abrasive body 2808, a third abrasive body 2810, a cover plate 2812, and at least one fastener 2814, e.g., a threaded fastener.

It can be appreciated that the pull stud 2802 can be configured substantially identical to the pull stud 102 described above. Further, the arbor 2804 can be mostly identical to the arbor 104 described above. The arbor 2804 illustrated in FIG. 28 includes a mounting hub 2816 that is configured to receive three abrasive bodies 2806, 2808, 2810 i.e., the thickness of the mounting hub 2816 is greater than the thickness of the mounting hub 142 of the arbor 104 described above. The first abrasive body 2806 can be substantially identical to the abrasive body 106 described above. The second abrasive body 2808 and the third abrasive body 2810 can be mostly identical to the abrasive body 106 described above.

In particular, the first abrasive body 2806 can have an outer profile 2818 that is same as the outer profile of the abrasive body 106 described above. In other words, the outer profile 2818 of the first abrasive body 2806 can be concave or generally U-shaped. The outer profile 2820 of the second abrasive body 2808 can be generally angular or V-shaped. The outer profile 2822 of the third abrasive body 2810 can be concave or generally U-shaped, but with a larger radius of curvature than the outer profile 2818 of the first abrasive body 2806. As such, the outer profile 2818, 2820, 2822 of each of the first abrasive body 2806, the second abrasive body 2808, and the third abrasive body 2810 are different.

In another aspect, the first abrasive body 2806 can have a first abrasive grit size. The second abrasive body 2808 can have a second abrasive grit size. The third abrasive body 2810 can have a third abrasive grit size. Each of the abrasive grit sizes can be different. During use, by translating the grinding wheel assembly 2800 along a linear axis perpendicular to a workpiece, a user can switch between the first abrasive body 2806 having the first abrasive grit size, the second abrasive body 2808 having the second abrasive grit size, and the third abrasive body 2810 having the third abrasive grit size without having to change to a different grinding wheel assembly (not shown).

It can be appreciated that the cover plate 2812 is substantially identical to the cover plate 108 described above. Moreover, the fastener 2814 is substantially identical to the fastener 110 described above. The grinding wheel assembly 2800 can be assembled in the same manner as the grinding wheel assembly 100 described above with the additional step of installing the second abrasive body 2808 over the mounting hub 2816 on top of the first abrasive body 2806 and installing the third abrasive body 2810 over the mounting hub 2816 on top of the second abrasive body 2808 before installing the cover plate 2812 and the fastener 2814.

Grinding Wheel Assemblies with Vibration Dampening Members

Referring to FIG. 29 through FIG. 32, a grinding wheel assembly is shown and is generally designated 2900. The grinding wheel assembly 2900 is basically the same as the grinding wheel assembly 100 described above and can include a pull stud 2902, an arbor 2904, an abrasive body 2906, a cover plate 2908, and at least one fastener 2910. In addition, the grinding wheel assembly 2900 can include a first vibration dampening member 2912 installed between the arbor 2904 and the abrasive body 2906 and a second vibration dampening member 2914 between the abrasive body 2906 and the cover plate 2908.

Figure 33:
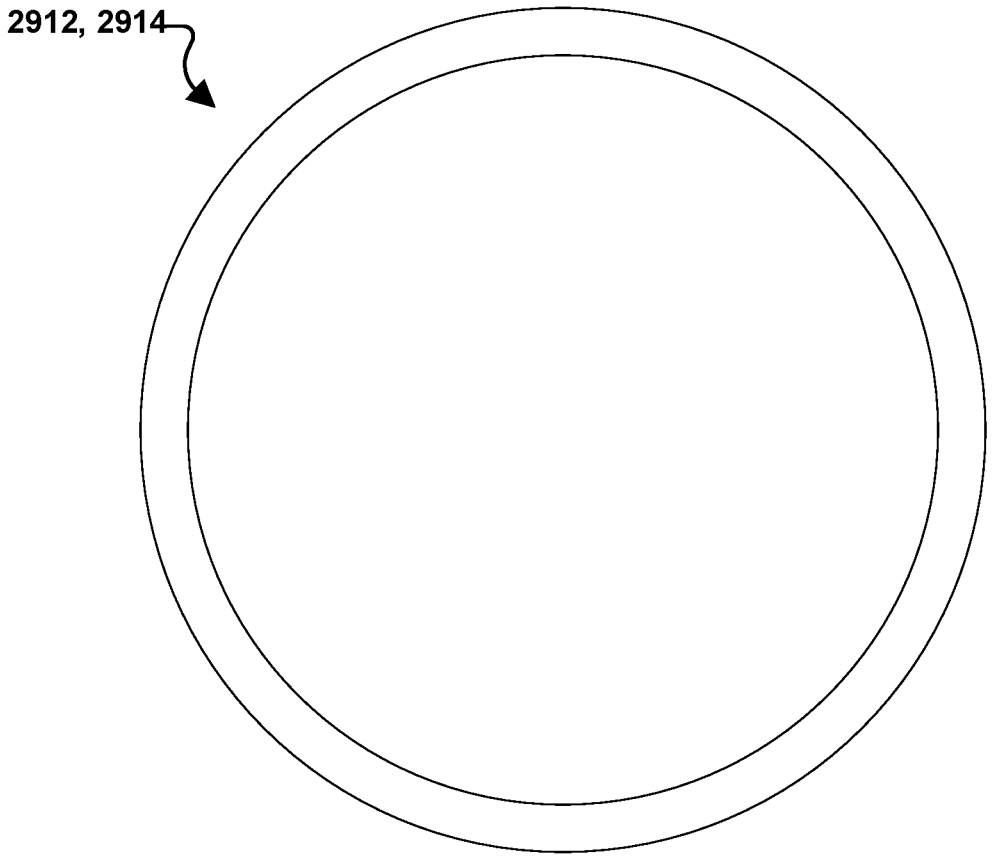
FIG. 33 includes an illustration of a top plan view of a locking ring for a grinding wheel assembly in accordance with an embodiment.
Figure 34:
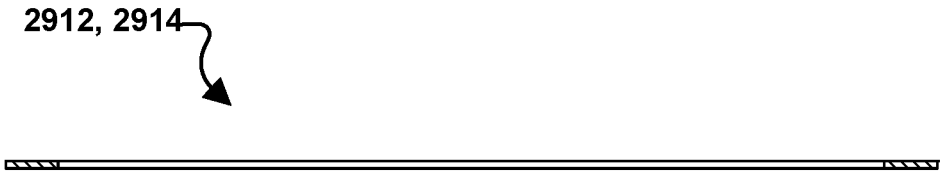
FIG. 34 includes an illustration of a side plan view of a locking ring for a grinding wheel assembly in accordance with an embodiment.
Figure 35:
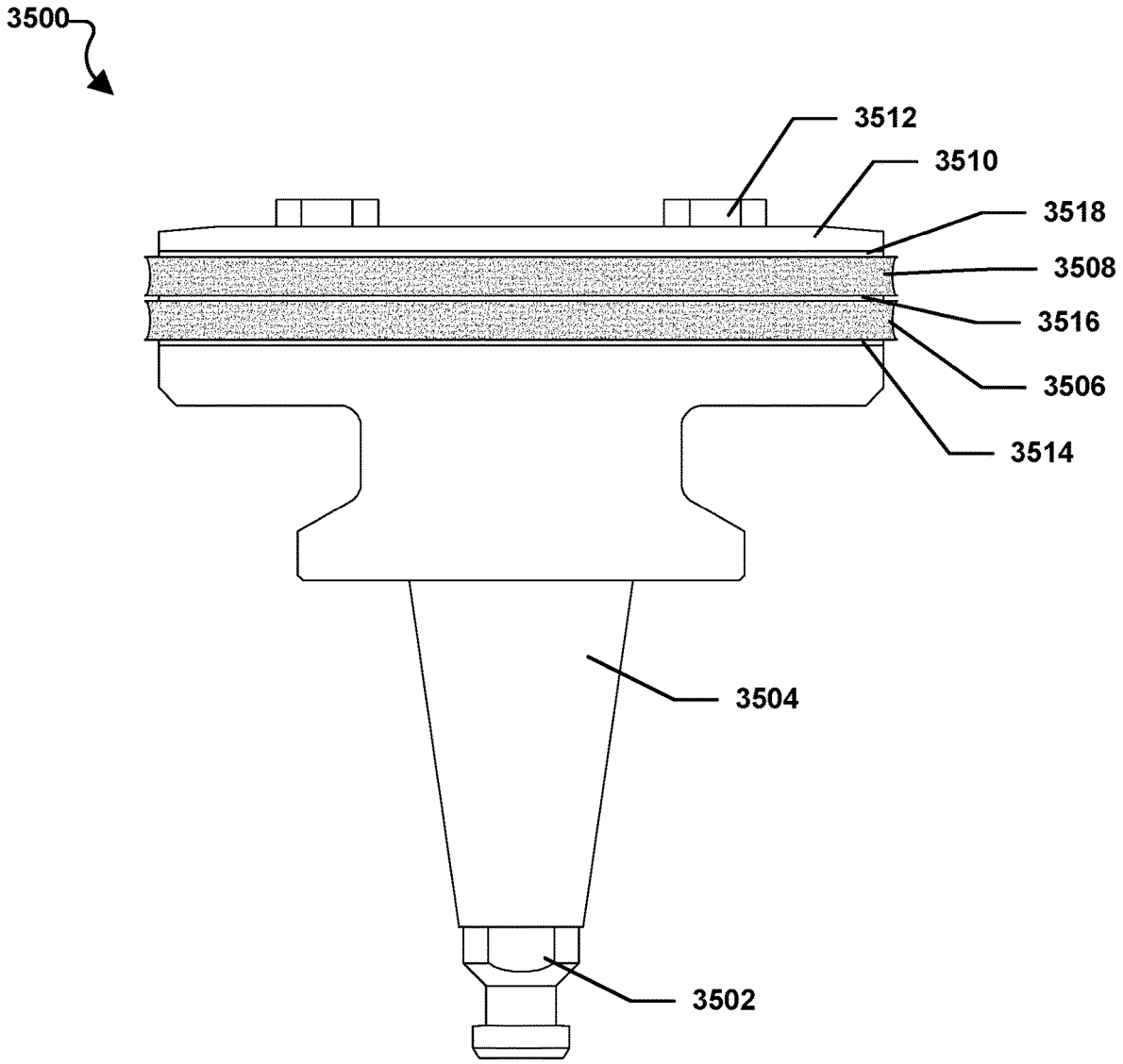
FIG. 35 includes an illustration of a side plan view of a grinding wheel assembly in accordance with an embodiment.
Figure 36:
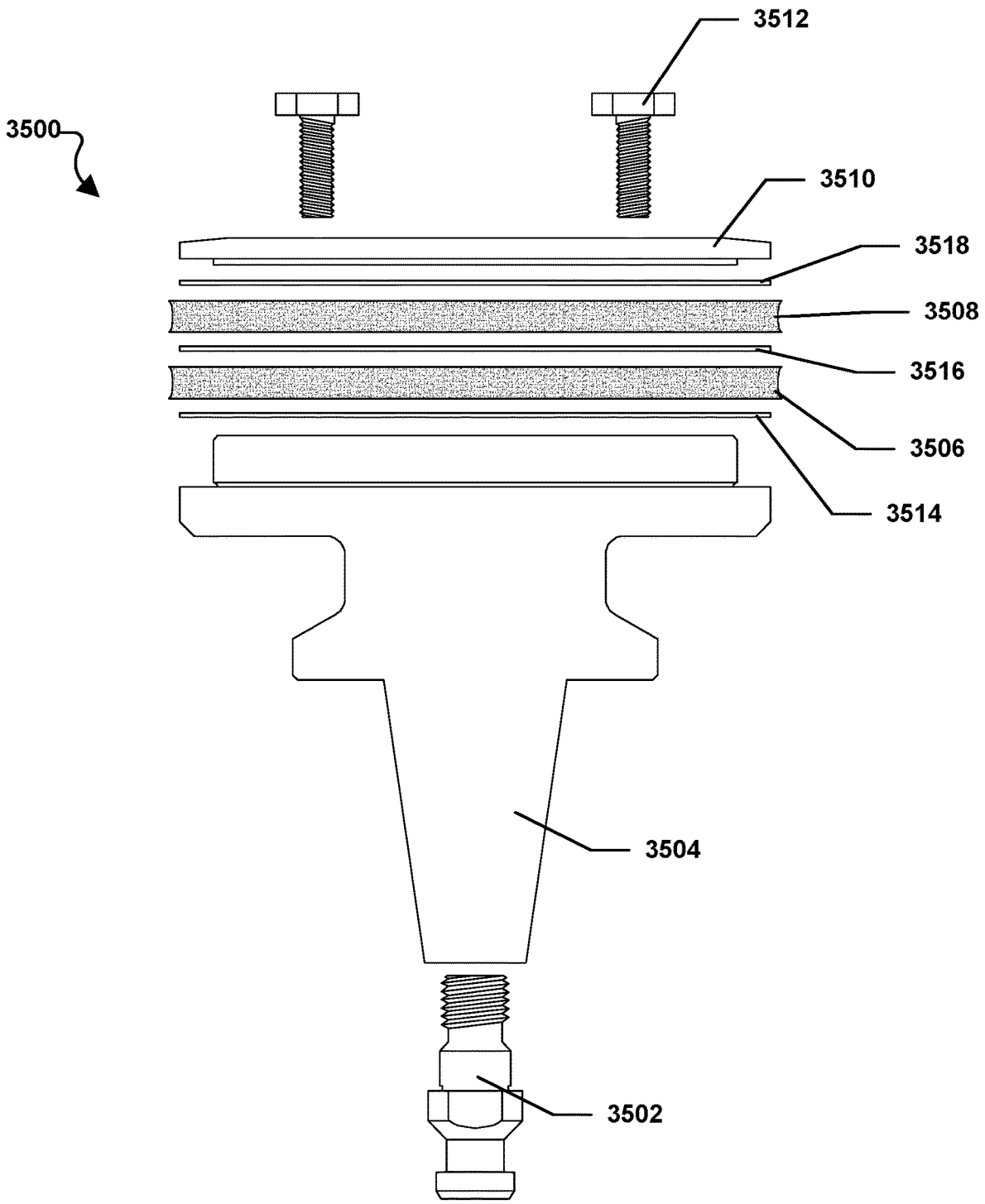
FIG. 36 includes an illustration of an exploded side plan view of a grinding wheel assembly in accordance with an embodiment.
Figure 37:
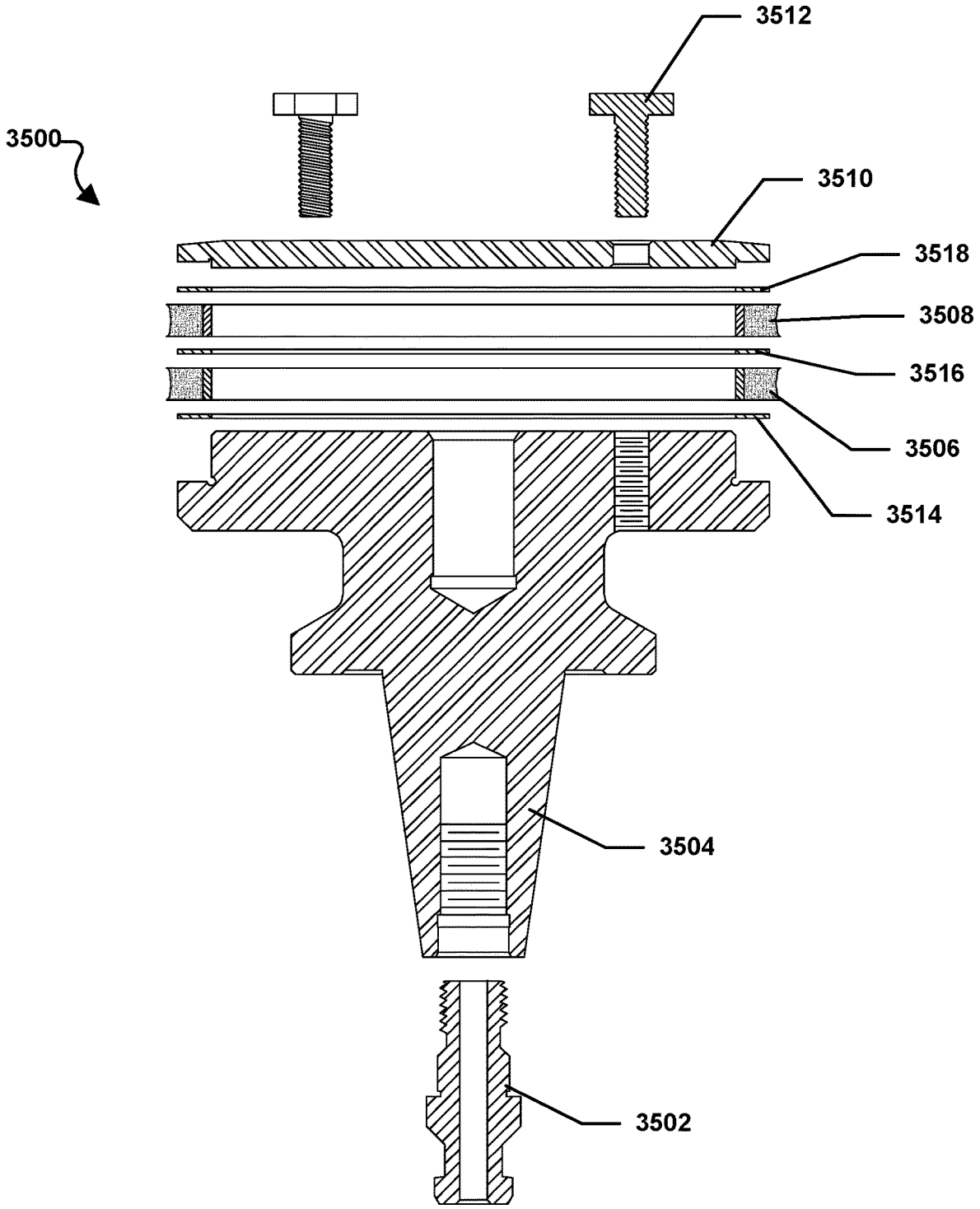
FIG. 37 includes an illustration of an exploded cross-section view of a grinding wheel assembly in accordance with an embodiment.
Figure 38:
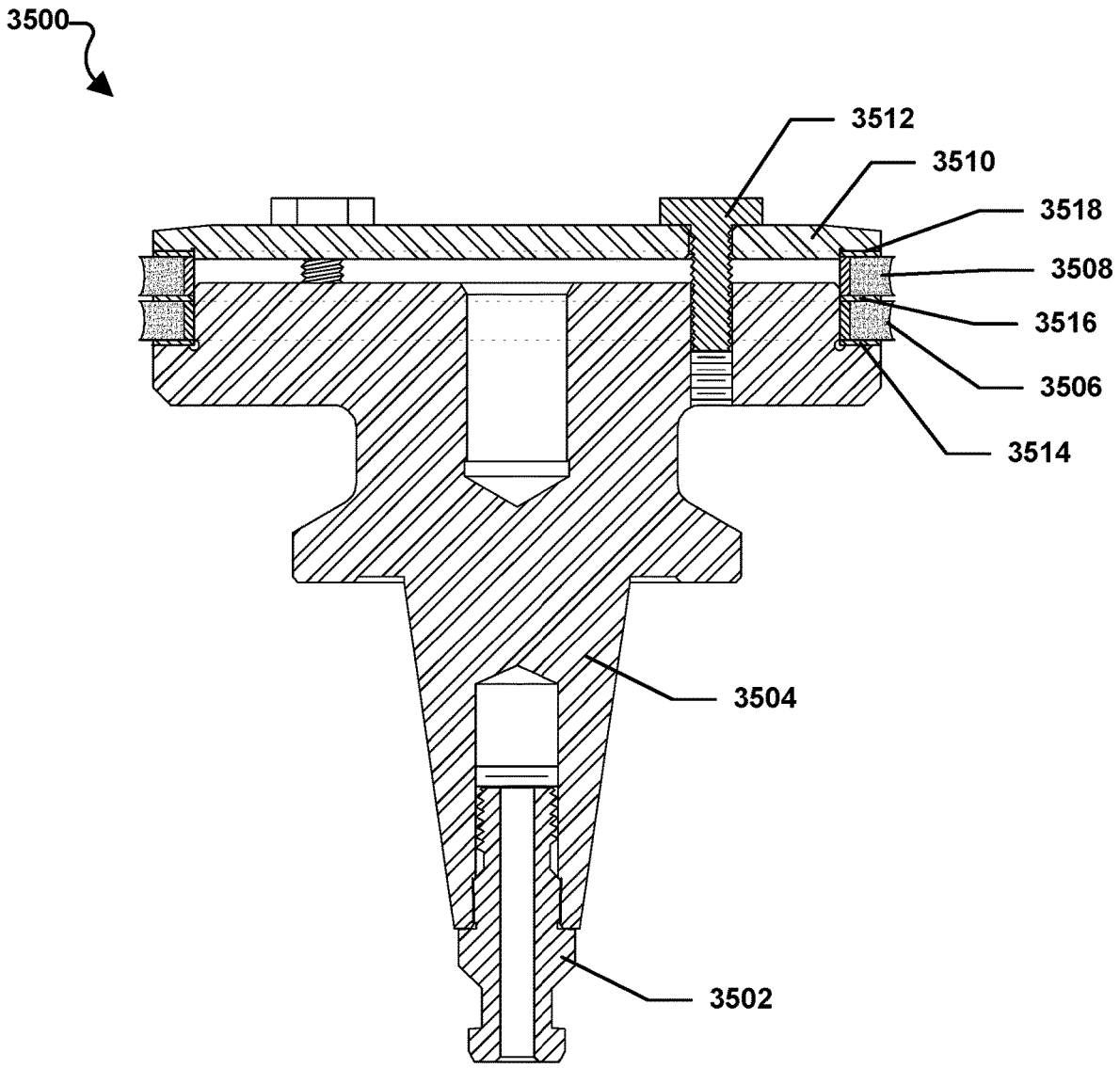
FIG. 38 includes an illustration of a cross-section view of a grinding wheel assembly in accordance with an embodiment.

In a particular aspect, the first vibration dampening member 2912 and the second vibration dampening member 2914 are identical and as illustrated in FIG. 33 and FIG. 34, each vibration dampening member 2912, 2914 can include a generally flat, ring-shaped body 2920. Further, each vibration dampening member 2912, 2914 can be made from an organic material. In particular, the vibration dampening members 2912, 2914 can be made from a polymer material, e.g., polyamid. In addition to providing vibration dampening, the vibration dampening members 2912, 2914 can also provide substantial friction between the arbor 2904, the abrasive body 2906, and the cover 2908 in order to minimize the risk of the abrasive body 2906 moving relative to the arbor 2904 and the cover 2908.

FIG. 35 through FIG. 38 illustrate a grinding wheel assembly 3500 that is substantially identical to the grinding wheel assembly 2400 described above. The grinding wheel assembly 3502 includes a pull stud 3502, an arbor 3504, a first abrasive body 3506, a second abrasive body 3508, a cover plate 3510, and at least one fastener 3512. Additionally, the grinding wheel assembly 3500 includes a first vibration dampening member 3514 between the arbor 3504 and the first abrasive body 3506, a second vibration dampening member 3516 between the first abrasive body 3506 and the second abrasive body 3508, and a third vibration dampening member 3518 between the second abrasive body 3508 and the cover plate 3510. It can be appreciated that the vibration dampening members 3514, 3516, 3518 are identical to the vibration dampening members 2912, 2914 that were previously described.

Grinding Wheel Assembly with Removeable Head Assembly

Referring now to FIG. 39 through FIG. 42, a grinding wheel assembly is illustrated and is generally designated 3900. As shown, the grinding wheel assembly 3900 can include a pull stud 3902, an arbor 3904, a head assembly 3906, and at least one fastener 3908. The pull stud 3902 and the at least one fastener 3908 are substantially identical to the pull stud 102 and fastener 110 described above.

Arbor

FIG. 43 through FIG. 46 illustrate the details of the arbor 3904. As shown, the arbor 3904 can include a body 3920 that can define a proximal end 3922 and a distal end 3924. The body 3920 of the arbor 3904 can include a generally frustoconical drive shaft 3926 that can extend from the proximal end 3922 of the body 3920 to a central flange 3928 that extends outwardly from the body 3920. Further, the body 3920 of the arbor 3904 can include a mounting plate 3930 that can extend radially outward from the body 3920 at, or near, the distal end 3924 of the body 3920 of the arbor 3904.

Figure 43:
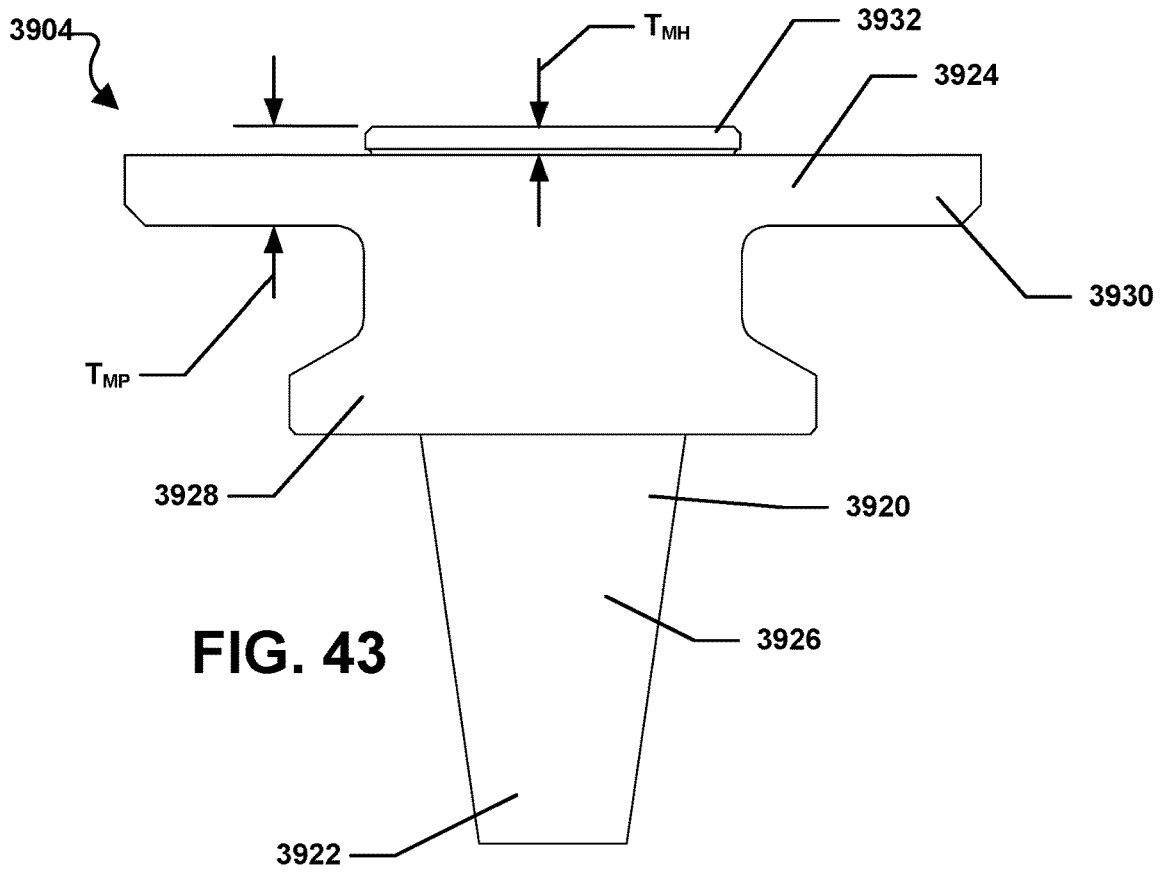
FIG. 43 includes an illustration of a side plan view of an arbor for a grinding wheel assembly in accordance with an embodiment.
Figure 44:
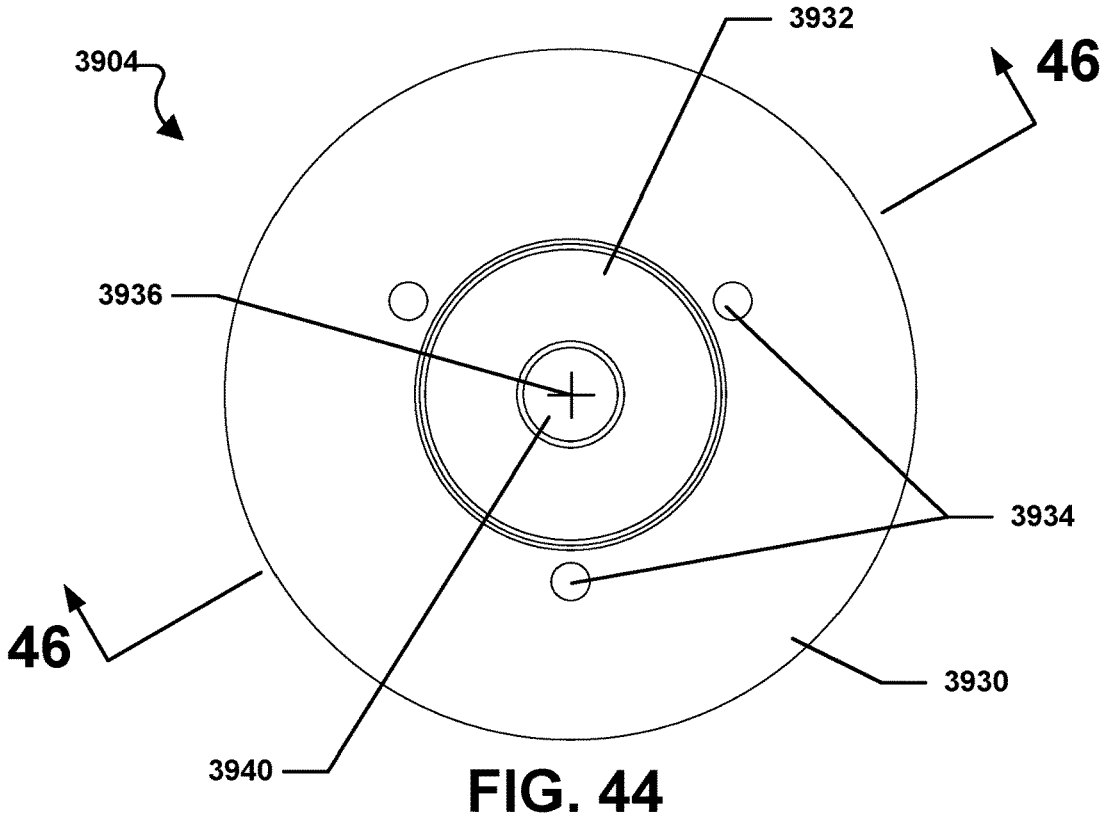
FIG. 44 includes an illustration of a top plan view of an arbor for a grinding wheel assembly in accordance with an embodiment.
Figure 46:
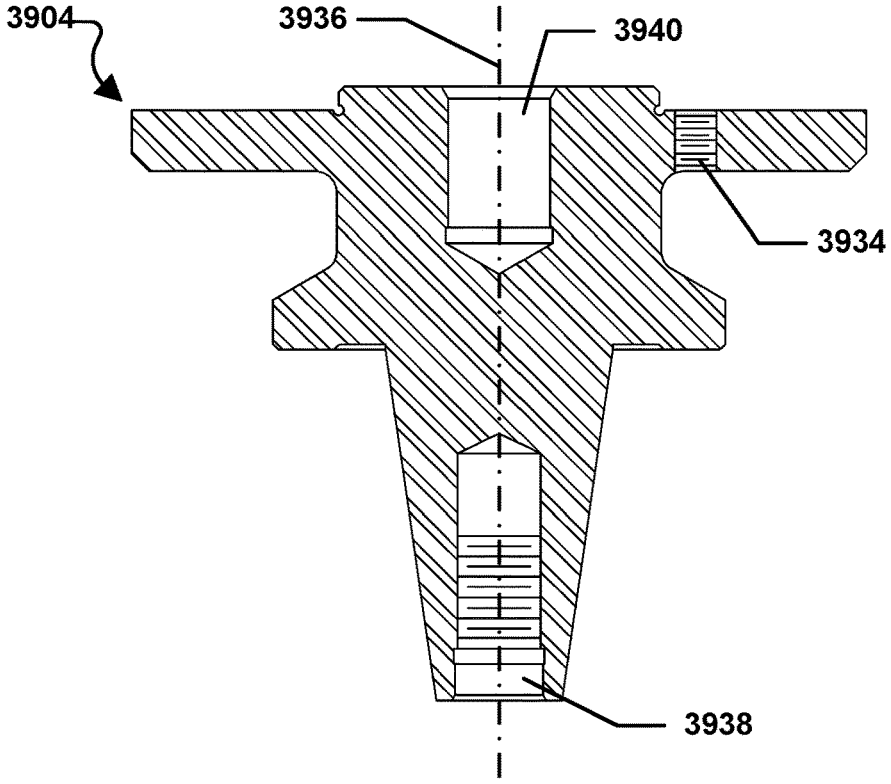
FIG. 46 includes an illustration of a cross-section view of an arbor for a grinding wheel assembly in accordance with an embodiment taken along line 46-46 in FIG. 44.
Figure 47:
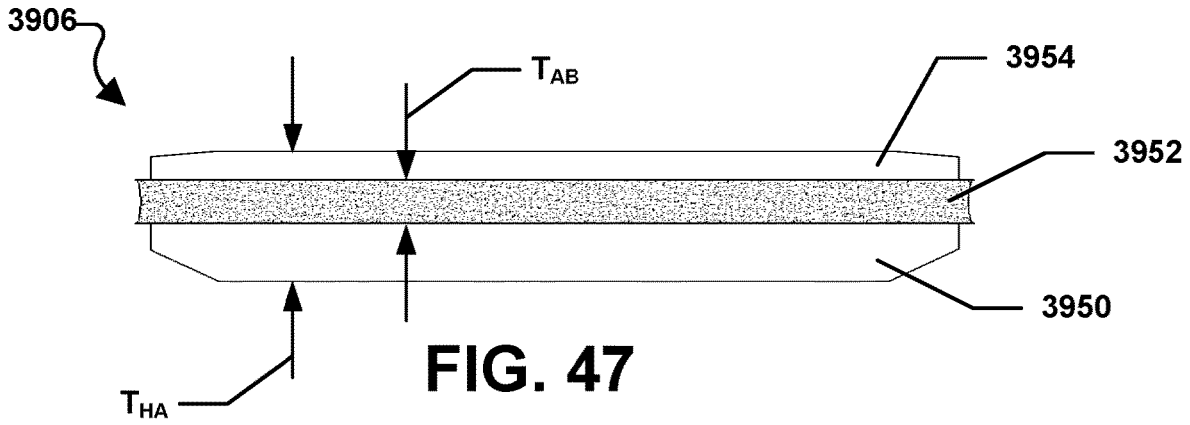
FIG. 47 includes an illustration of a side plan view of a head assembly for a grinding wheel assembly in accordance with an embodiment.
Figure 48:
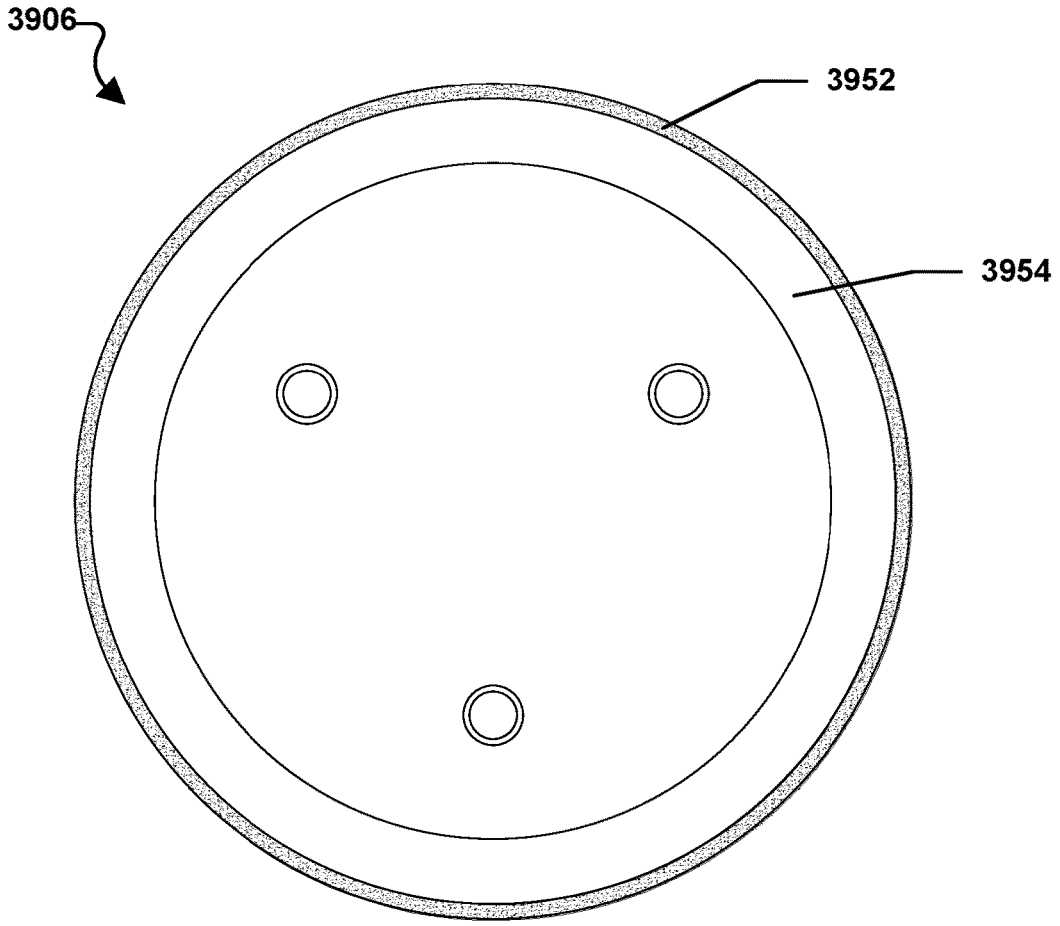
FIG. 48 includes an illustration of a top plan view of a head assembly for a grinding wheel assembly in accordance with an embodiment.
Figure 49:
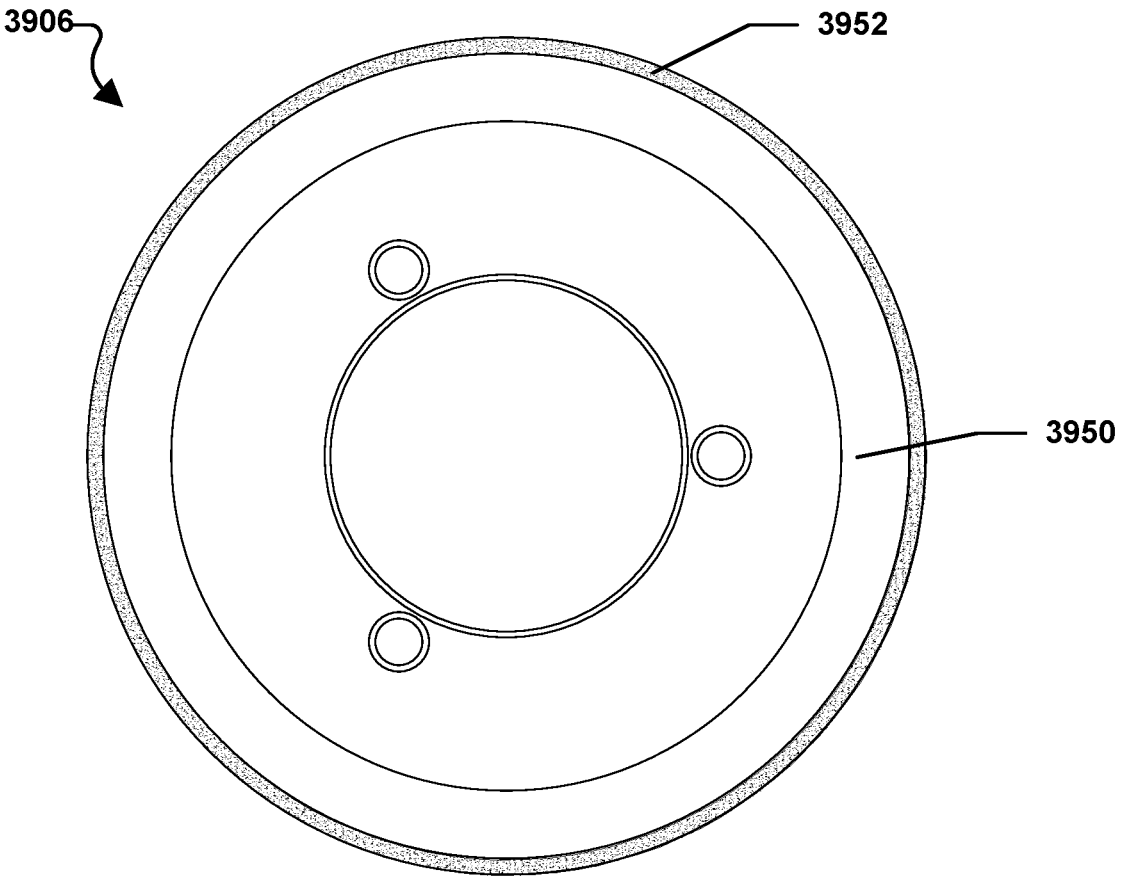
FIG. 49 includes an illustration of a bottom plan view of a head assembly for a grinding wheel assembly in accordance with an embodiment.
Figure 50:
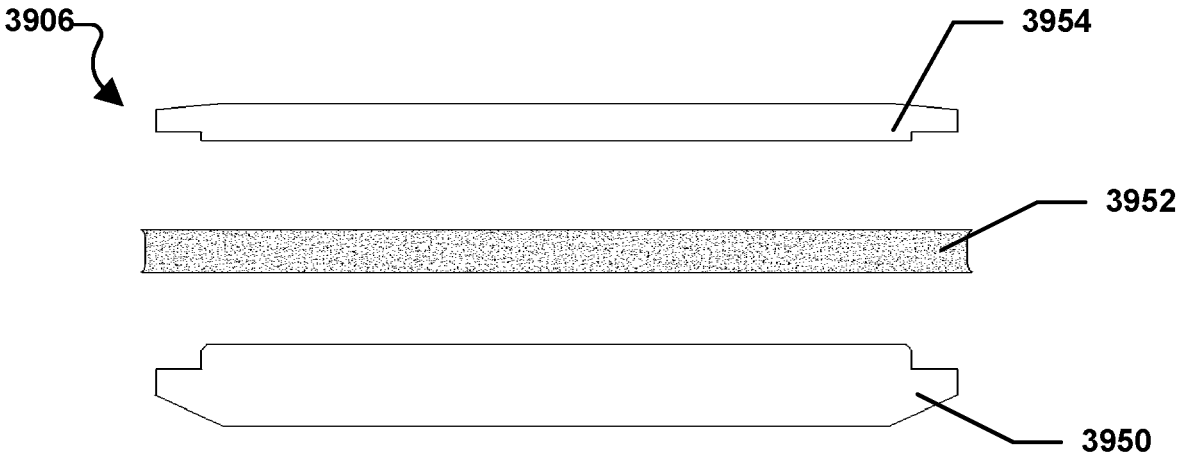
FIG. 50 includes an illustration of an exploded side plan view of a head assembly for a grinding wheel assembly in accordance with an embodiment.
Figure 51:
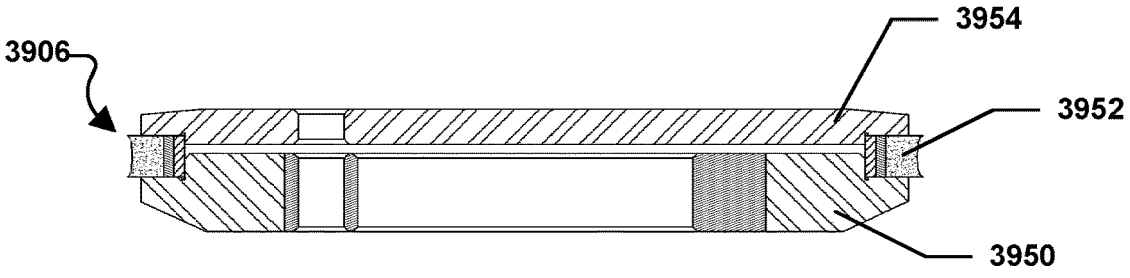
FIG. 51 includes an illustration of a cross-section view of a head assembly for a grinding wheel assembly in accordance with an embodiment.

FIG. 43, FIG. 44, and FIG. 46 indicate that the mounting plate 3930 can include a mounting hub 3932. The mounting hub 3932 can be generally cylindrical and can extend axially away from the distal end 3924 of the body 3920 of the arbor 3904. In a particular aspect, the mounting hub 3932 can be configured to receive and engage the head assembly 3906, illustrated in FIG. 47 through FIG. 51 and described in greater detail herein. Further, the mounting hub 3932 can have an average thickness, $T_{MH}$. For example, $T_{MH}$ may be at least 1.5 mm. Further, $T_{MH}$, may be at least 2.0 mm, such as at least 2.5 mm, at least 3.0 mm, at least 3.5 mm, or at least 4.0 mm. In another aspect, $T_{MH}$ may be less than 10.0 mm, such as less than 9.5 mm, less than 9.0 mm, less than 8.5 mm, less than 8.0 mm, less than 7.5 mm, or less than 7.0 mm. It is to be understood that $T_{MH}$ may be within a range between and including any of the minimum and maximum values described above.

As illustrated in FIG. 44 and FIG. 46, the mounting plate 3930 can include at least one threaded bore 3934 radially offset from a central axis 3936. The at least one threaded bore 3934 can be configured to received the at least one fastener 3908 shown in FIG. 39.

Figure 45:
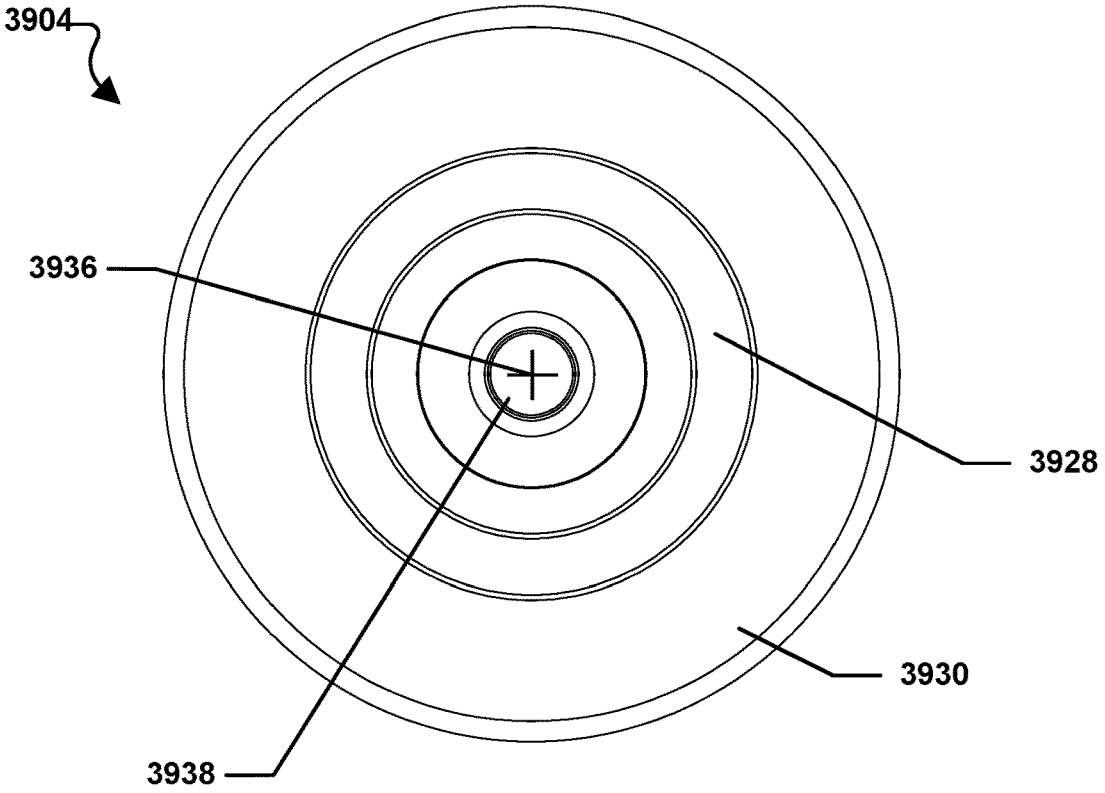
FIG. 45 includes an illustration of a bottom plan view of an arbor for a grinding wheel assembly in accordance with an embodiment.

FIG. 45 and FIG. 46 further indicate that the body 3920 of the arbor 3904 can also include a proximal central bore 3938 formed at, and extending into, the proximal end 3922 of the body 3920 of the arbor 3904 along the central axis 3936. Specifically, the proximal central bore 3938 formed in the proximal end 3922 of the body 3920 of the arbor 3904 can extend into the body 3920 of the arbor 3904 a predetermined length. Moreover, the proximal central bore 3938 can be formed with threads, i.e., screw threads, at least partially along the length of the proximal central bore 3938. It can be appreciated that the proximal central bore 3938 formed at the proximal end 3922 of the body 3920 of the arbor 3904 can be configured to receive the pull stud 3902 shown in FIG. 39.

FIG. 44 and FIG. 46 indicate that the body 3920 of the arbor 3904 can also include a distal central bore 3940 formed at, and extending into, the distal end 3924 of the body 3920 of the arbor 3904 along the central axis 3936. Specifically, the distal central bore 3940 formed in the distal end 3924 of the body 3920 of the arbor 3904 can extend into the body 3920 of the arbor 3904 a predetermined length. As shown, the distal central bore 3940 can be a smooth walled bore. Further, the distal central bore 3940 can be configured to removably engage a tool (not shown).

Head Assembly

FIG. 47 through FIG. 51 illustrate the details of the head assembly 3906. As shown, the head assembly 3906 can include a mounting plate 3950, an abrasive body 3952, and a cover plate 3954. The cover plate 3954 is substantially identical to the cover plate 108 described elsewhere herein.

In a particular aspect, the head assembly 3906 can defines a thickness, $T_{HA}$. Further, the abrasive body 3952 can define a thickness, $T_{AB}$. $T_{AB}$ can be less than $T_{HA}$. For example, $T_{AB}$ can be less than 50% $T_{HA}$. In particular, $T_{AB}$ can be less than 45% $T_{HA}$, such as less than 40% $T_{HA}$, less than 35% $T_{HA}$, or less than 30% $T_{HA}$. In another aspect, $T_{AB}$ can be greater than 15% $T_{HA}$. Further, $T_{AB}$ can be greater than 17.5% $T_{HA}$, such as greater than 20% $T_{HA}$, or greater than 22.5% $T_{HA}$.

Figure 39:
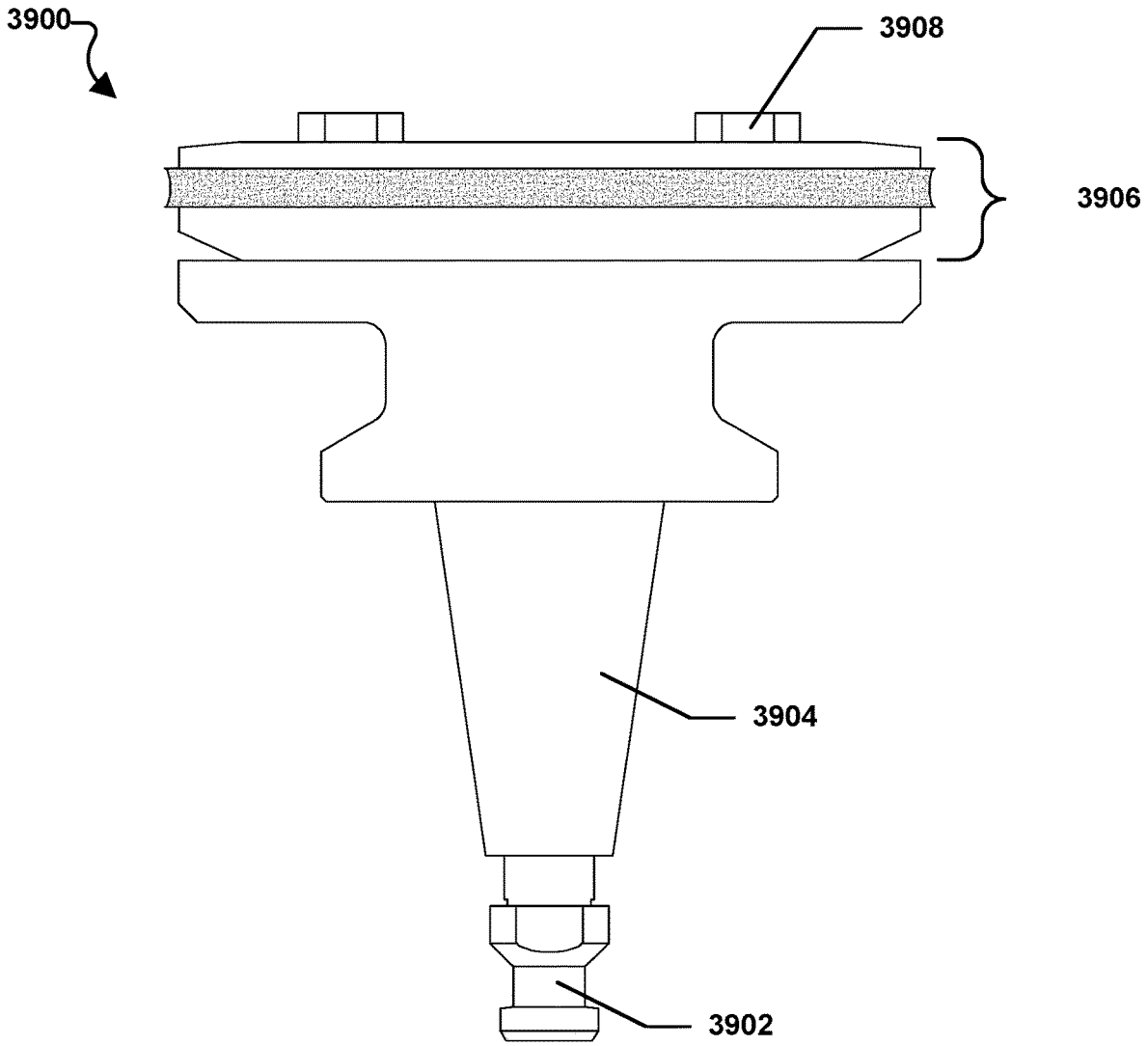
FIG. 39 includes an illustration of a side plan view of a grinding wheel assembly in accordance with an embodiment.
Figure 40:
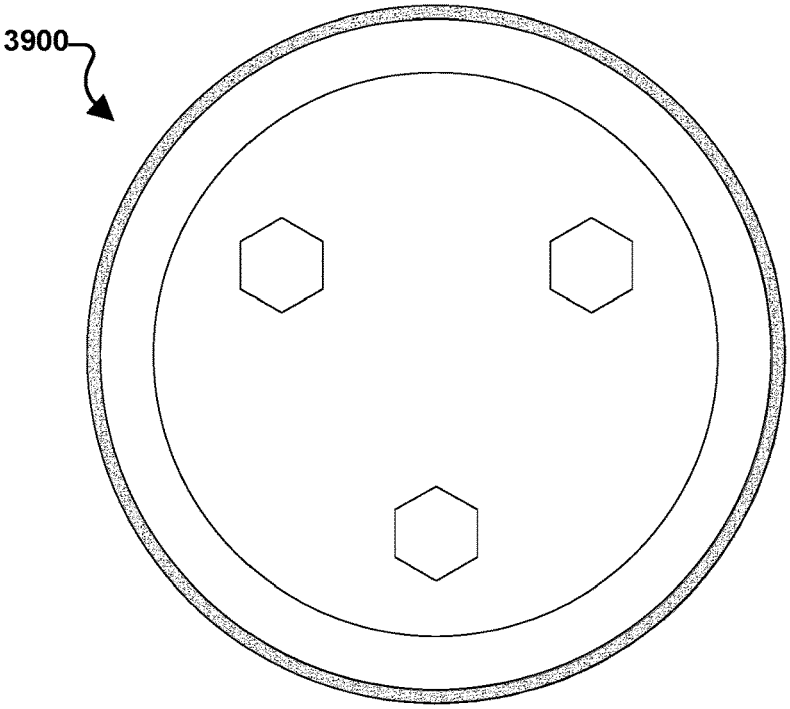
FIG. 40 includes an illustration of a top plan view of a grinding wheel assembly in accordance with an embodiment.
Figure 41:
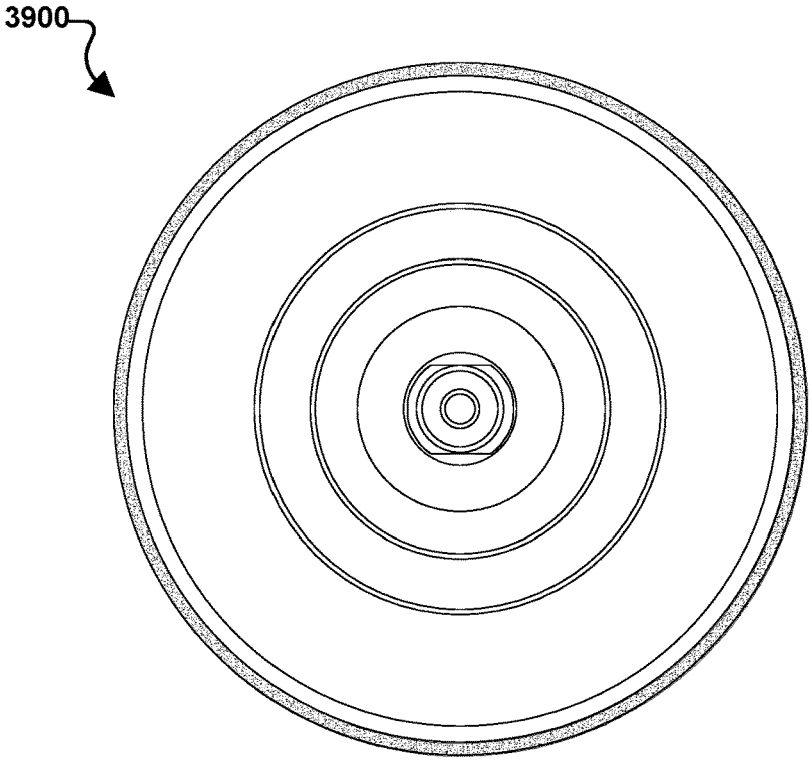
FIG. 41 includes an illustration of a bottom plan view of a grinding wheel assembly in accordance with an embodiment.
Figure 42:
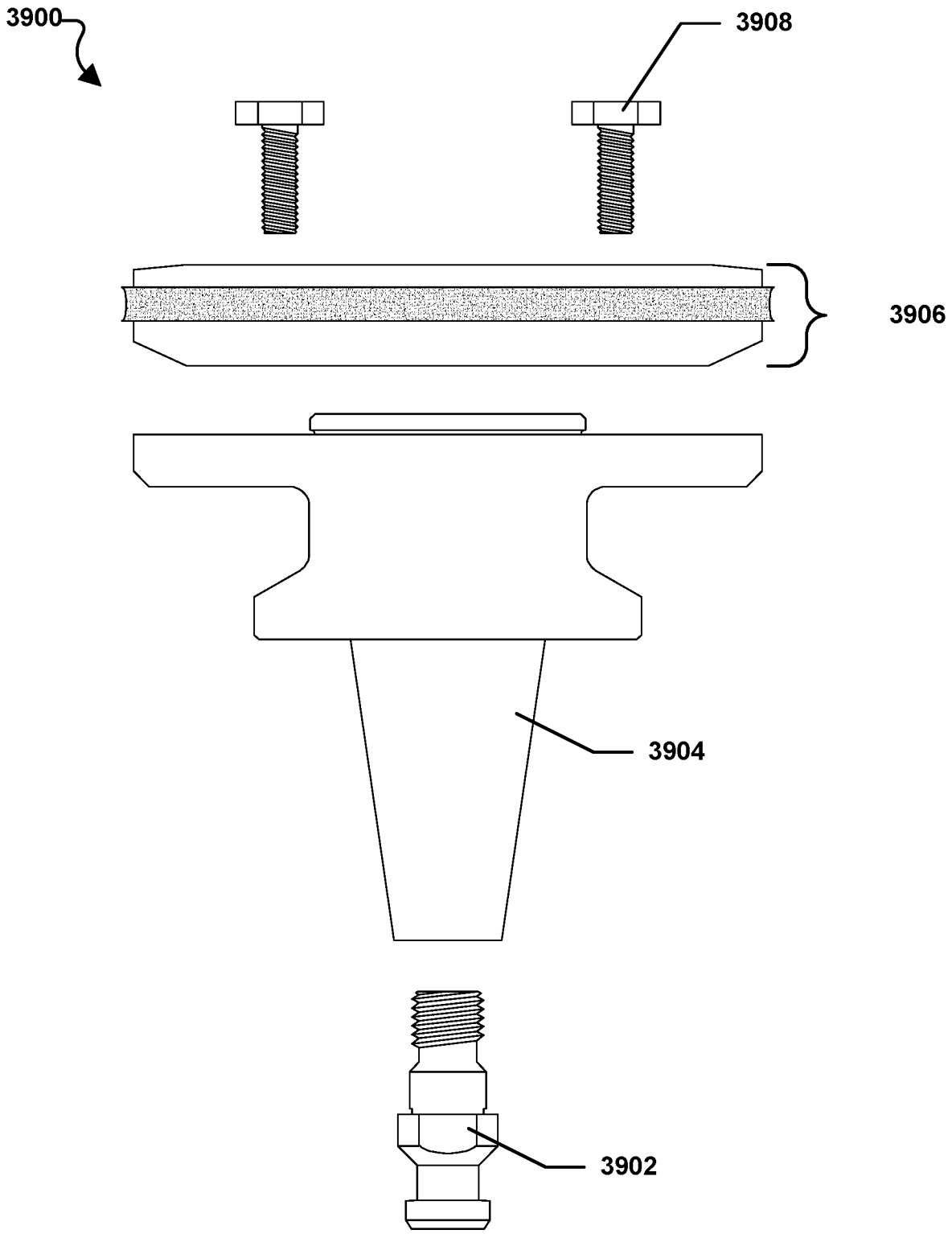
FIG. 42 includes an illustration of an exploded side plan view of a grinding wheel assembly in accordance with an embodiment.
Figure 52:
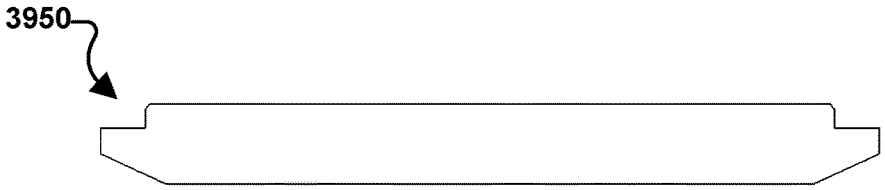
FIG. 52 includes an illustration of a side plan view of a mounting plate for a head assembly of a grinding wheel assembly in accordance with an embodiment.
Figure 53:
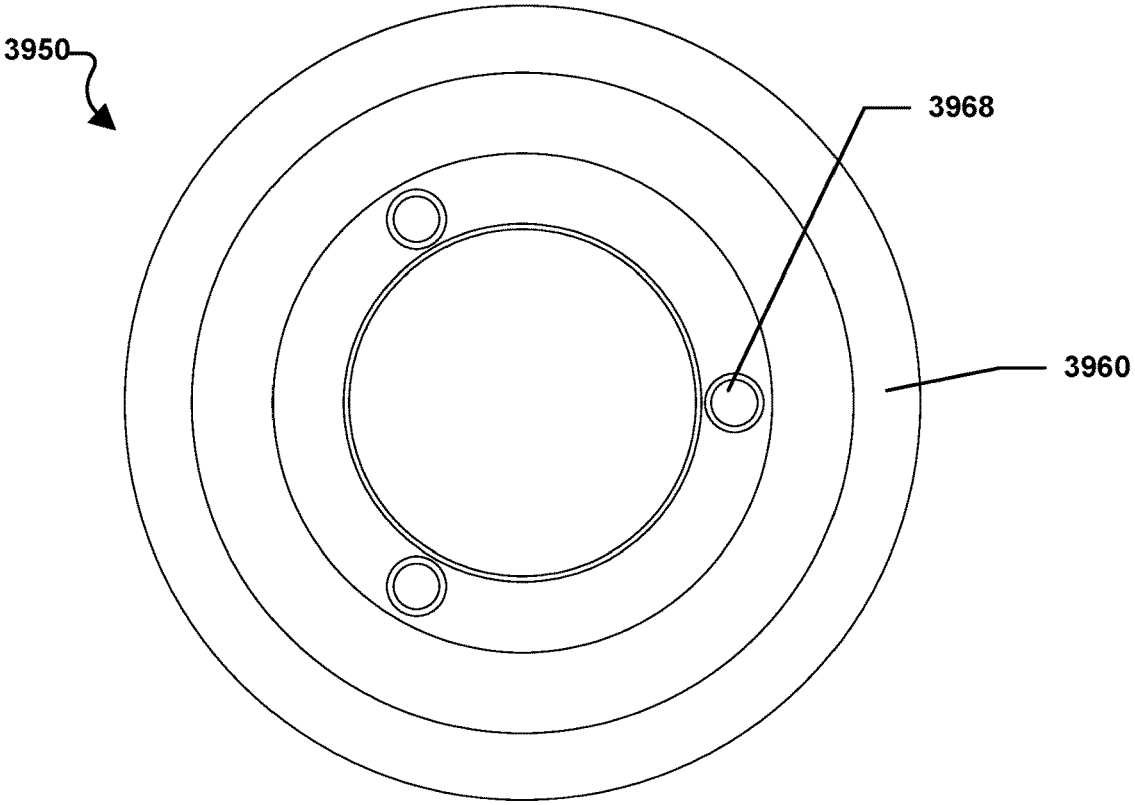
FIG. 53 includes an illustration of a top plan view of a mounting plate for a head assembly of a grinding wheel assembly in accordance with an embodiment.
Figure 54:
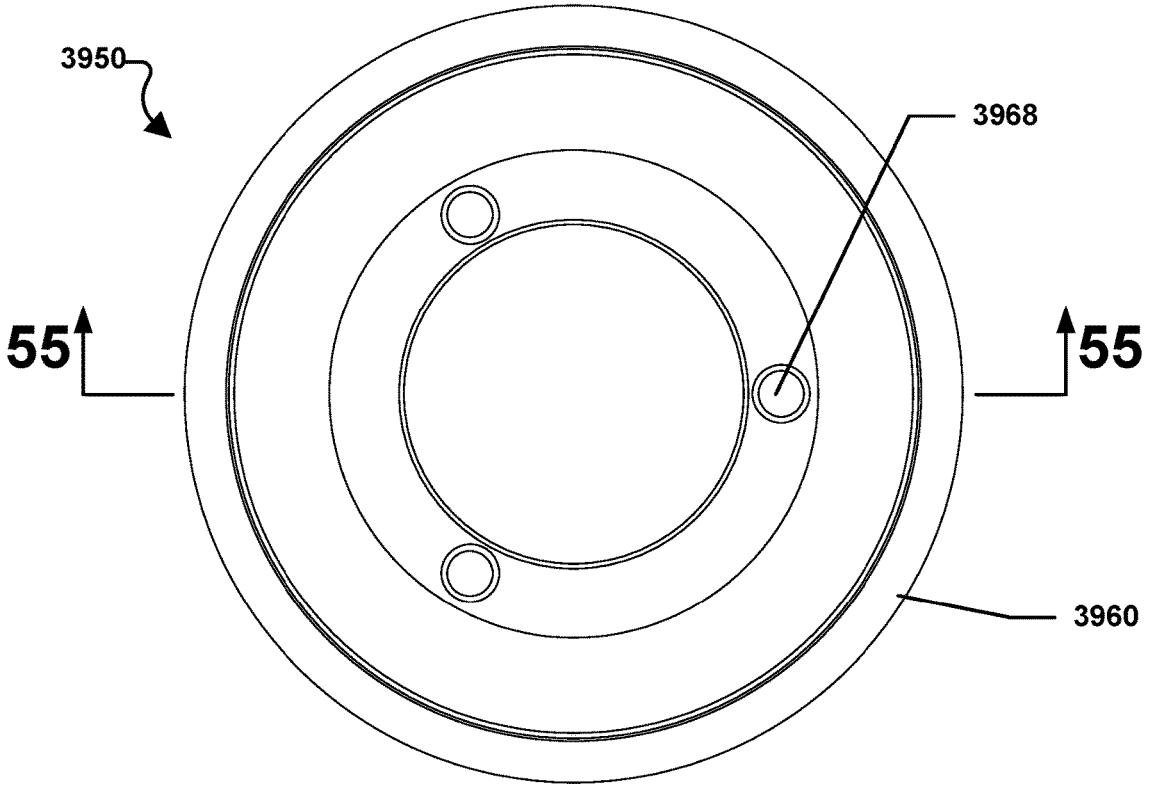
FIG. 54 includes an illustration of a bottom plan view of a mounting plate for a head assembly of a grinding wheel assembly in accordance with an embodiment.
Figure 55:
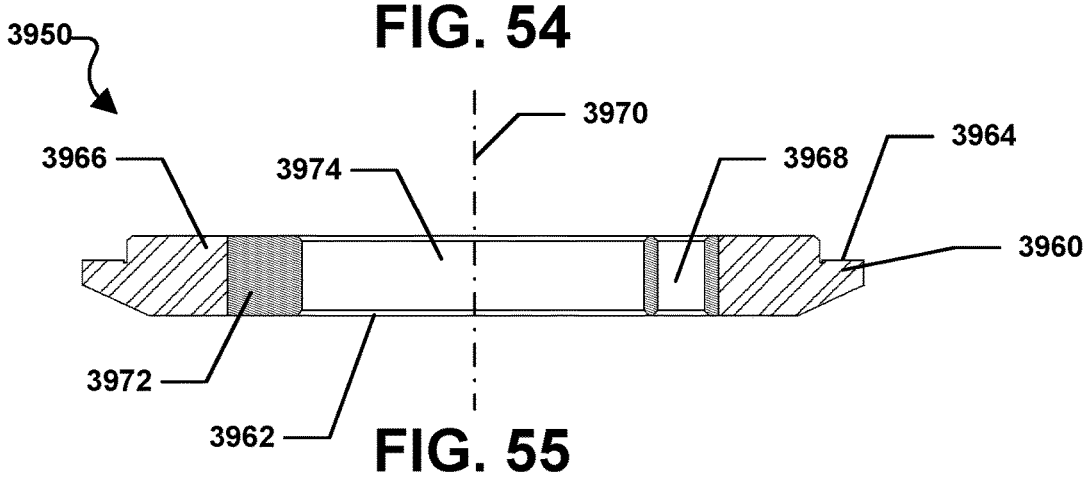
FIG. 55 includes an illustration of a cross-section view of a mounting plate for a head assembly of a grinding wheel assembly in accordance with an embodiment taken along line 55-55 in FIG. 54.

As shown in FIG. 52 through 55, the mounting plate 3950 can include a body 3960 that is disk-shaped. Further, the body 3960 of the mounting plate 3950 can include a proximal surface 3962 and a distal surface 3964. A generally cylindrical mounting hub 3966 can extend outwardly from the proximal surface 3964 as indicated in FIG. 52 and FIG. 55. The mounting hub 3966 is configured to extend into and support the abrasive body 3952 when the grinding wheel assembly 3900 is assembled as indicated in FIG. 39.

As shown in FIG. 53, FIG. 54, and FIG. 55, the body 3960 of the mounting plate 3950 can include at least one bore 3968 extending through the mounting plate 3950, i.e., between the proximal surface 3962 and the distal surface 3964. The at least one bore 3968 can be radially offset from a central axis 3970. The at least one bore 3968 can be a smooth walled bore and may be sized and shaped to allow the at least one fastener 3908, shown in FIG. 39, to extend through the at least one bore 3968 and engage the at least one bore 3968 in a slip fit arrangement.

FIG. 55 shows that the mounting plate 3950 can be a composite structure and the body 3960 of the mounting plate 3950 can include a central hub 3972 formed with a central bore 3974. The central hub 3972 may be formed from a vibration dampening material. For example, the vibration dampening material can include an organic material. Further, the vibration dampening material can include a polymer material, e.g., polyamid. In addition, the central bore 3974 of the body 3960 can be configured to fit over the mounting hub 3932 on the arbor 3905, shown in FIG. 43.

Figure 56:
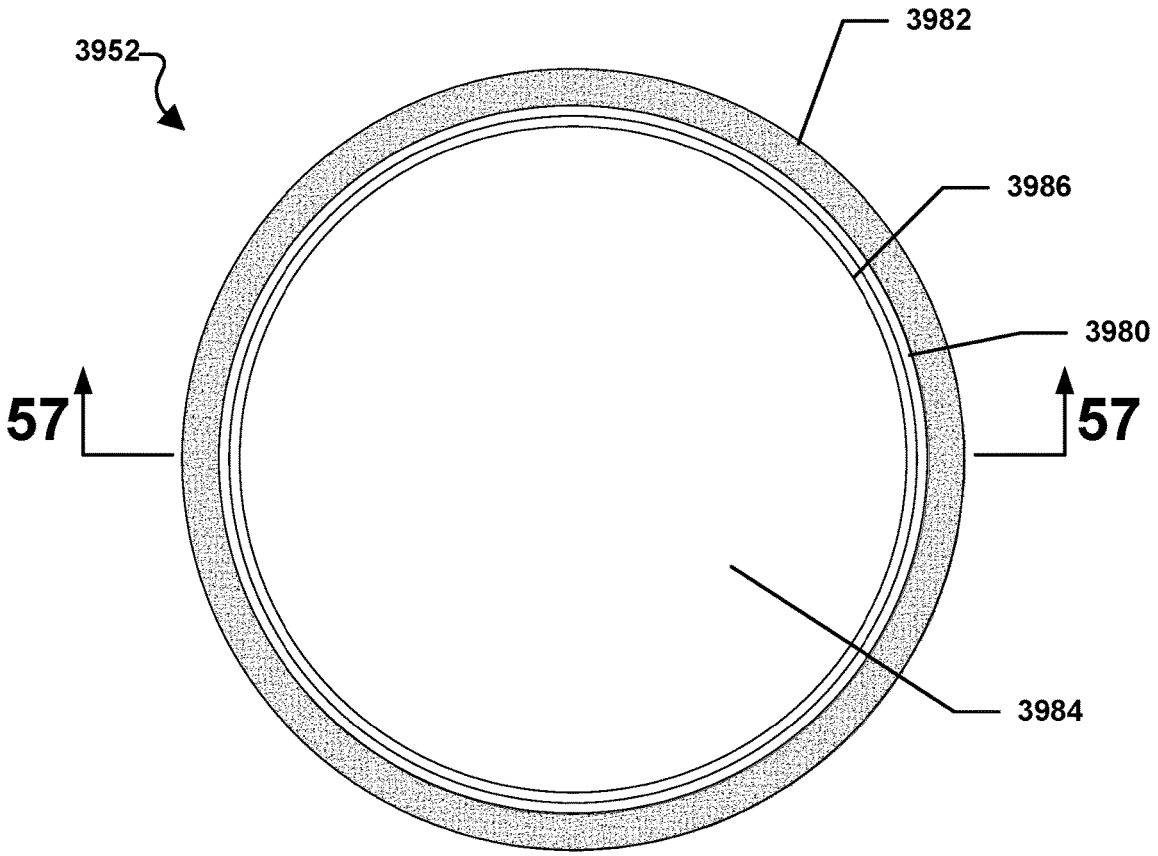
FIG. 56 includes an illustration of a top plan view of an abrasive body for a grinding wheel assembly in accordance with an embodiment.
Figure 57:
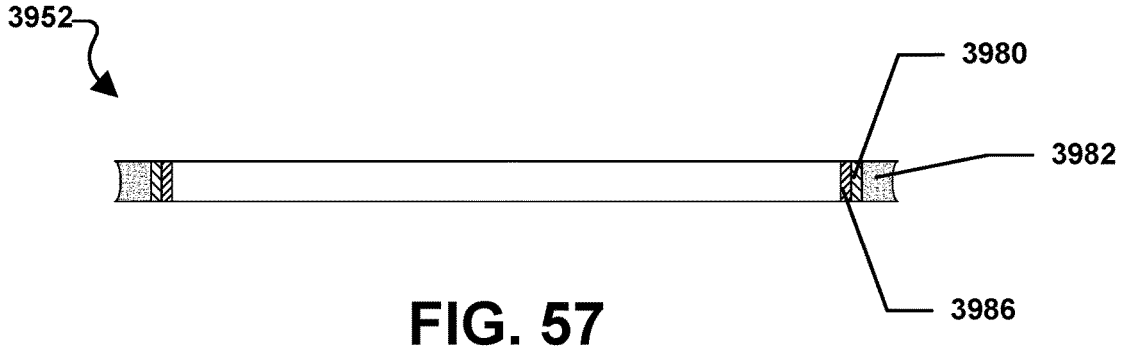
FIG. 57 includes an illustration of a cross-section view of an abrasive body for a grinding wheel assembly in accordance with an embodiment taken along line 57-57 in FIG. 56.

FIG. 56 and FIG. 57 illustrate the details of the abrasive body 3952 of the head assembly 3906. The abrasive body 3952 can be substantially identical to the abrasive body 106 (FIG. 1) described herein. The abrasive body 3952 can include a backing 3980 and an abrasive portion 3982 mounted on the backing 3980. A central bore 3984 can be formed within the backing 3980 of the abrasive body 3952 along a central axis 3986. The abrasive body 3952 can further include a vibration dampening layer 3986 disposed on an inner surface of the backing 3980. For example, the vibration dampening material can include an organic material. Further, the vibration dampening material can include a polymer material, e.g., polyamid.

Head Assembly with Multiple Abrasive Bodies

Figure 58:
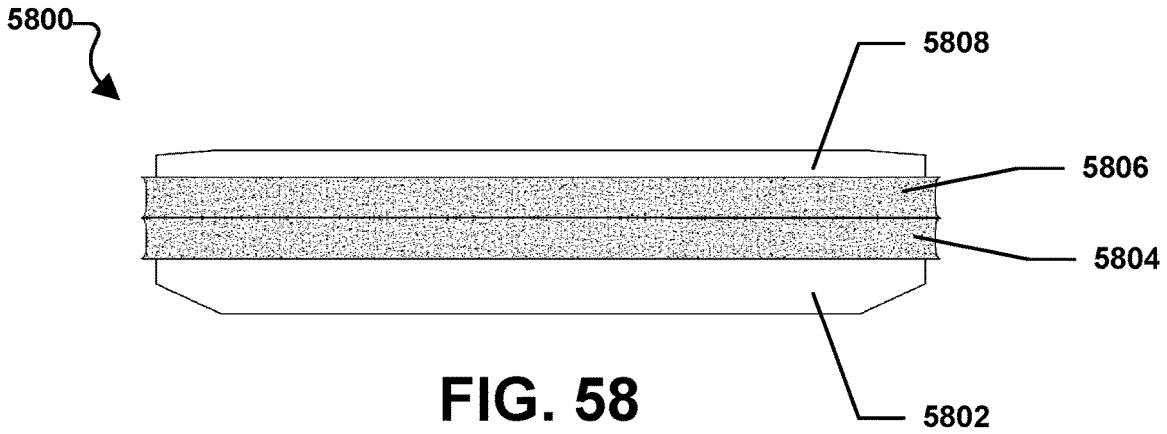
FIG. 58 includes an illustration of a side plan view of a head assembly for a grinding wheel assembly in accordance with an embodiment.
Figure 59:
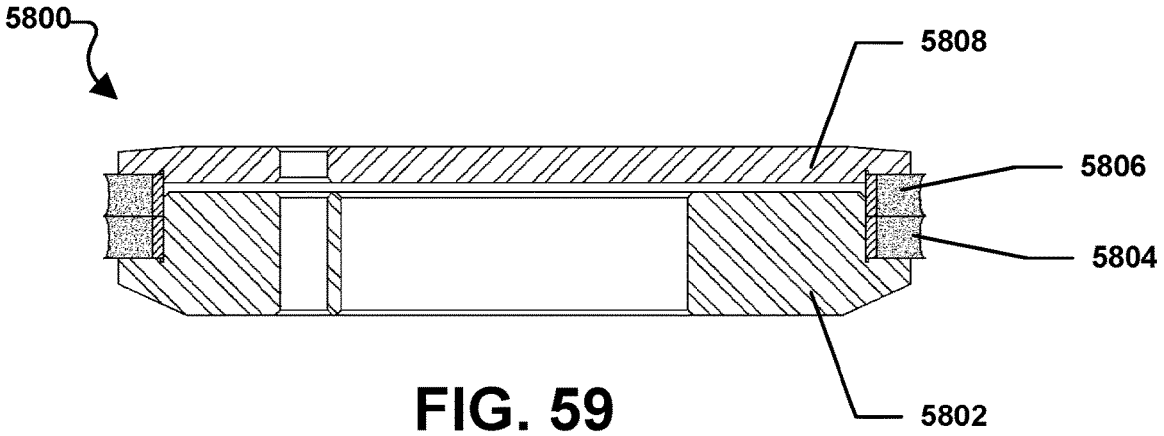
FIG. 59 includes an illustration of a cross-section view of a head assembly for a grinding wheel assembly in accordance with an embodiment.

FIG. 58 and FIG. 59 illustrate a head assembly 5800 for a grinding wheel assembly, e.g., the grinding wheel assembly 3900 illustrated in FIG. 39. The grinding wheel assembly 5800 can include a mounting plate 5802, a first abrasive body 5804, a second abrasive body 5806, and a cover plate 5808. The abrasive bodies 5804, 5806 may be constructed in a manner similar or identical to any of the abrasive bodies described herein. The cover plate 5808 can be configured similar to any of the other cover plates described herein. The mounting plate 5802 can be similar to the mounting plate 3950 described above. However, instead of being a composite structure, the mounting plate 5802 can be a monolithic structure made from a single material, e.g., a metal or a metal alloy. Further, the mounting plate 5802 can have a mounting hub 5810 that is thicker than the mounting hub 3966 (FIG. 55) of the mounting hub 3950 (FIG. 55) to accommodate the multiple abrasive bodies 5804, 5806. It can be appreciated that the head assembly 5800 could include a third abrasive body (not shown) or a fourth abrasive body (not shown).

Head Assembly with Vibration Dampening Members

Figure 60:
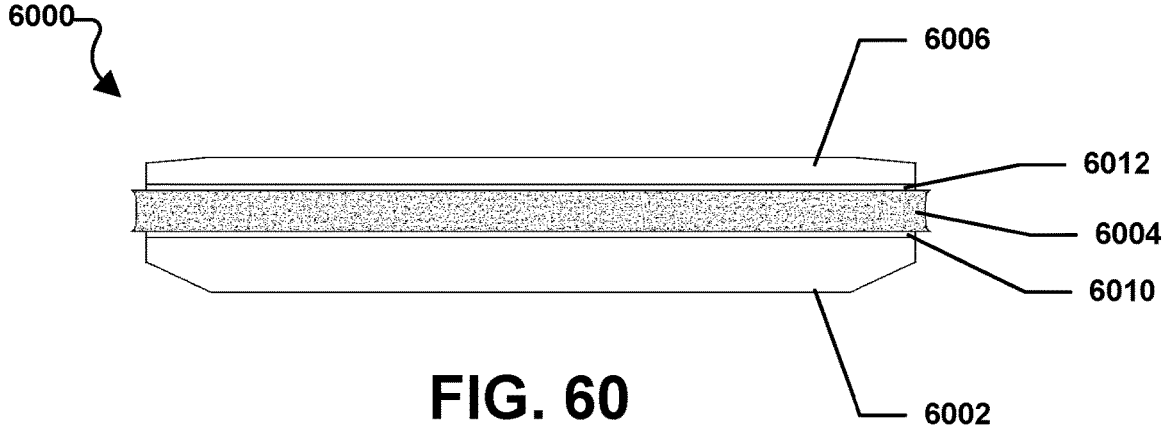
FIG. 60 includes an illustration of a side plan view of a head assembly for a grinding wheel assembly in accordance with an embodiment.
Figure 61:
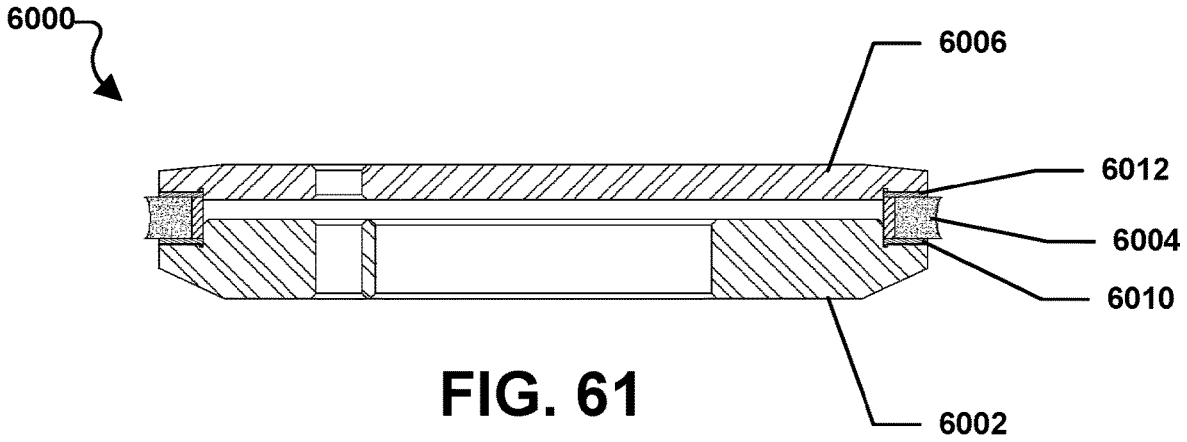
FIG. 61 includes an illustration of a cross-section view of a head assembly for a grinding wheel assembly in accordance with an embodiment.

FIG. 60 and FIG. 61 illustrate a head assembly 6000 for a grinding wheel assembly, e.g., the grinding wheel assembly 3900 illustrated in FIG. 39. The head assembly 6000 can include a mounting plate 6002, an abrasive body 6004, and a cover plate 6006. The abrasive body 6004 may be constructed in a manner similar or identical to any of the abrasive bodies described herein. The cover plate 6006 can be configured similar to any of the other cover plates described herein. The mounting plate 6002 can be similar to the mounting plate 3950 described above. However, instead of being a composite structure, the mounting plate 6002 can be a monolithic structure made from a single material, e.g., a metal or a metal alloy.

In addition, the head assembly 6000 can include a first vibration dampening member 6010 installed between the mounting plate 6002 and the abrasive body 6004 and a second vibration dampening member 6012 installed between the abrasive body 6004 and the cover plate 6006. The vibration dampening members 6010, 6012 may be identical to the vibration dampening members described elsewhere herein.

Figure 62:
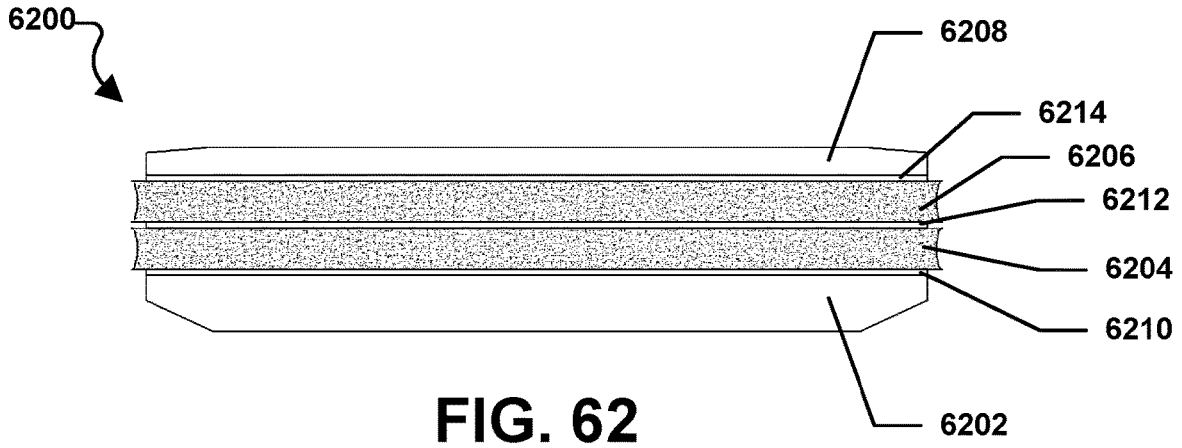
FIG. 62 includes an illustration of a side plan view of a head assembly for a grinding wheel assembly in accordance with an embodiment.
Figure 63:
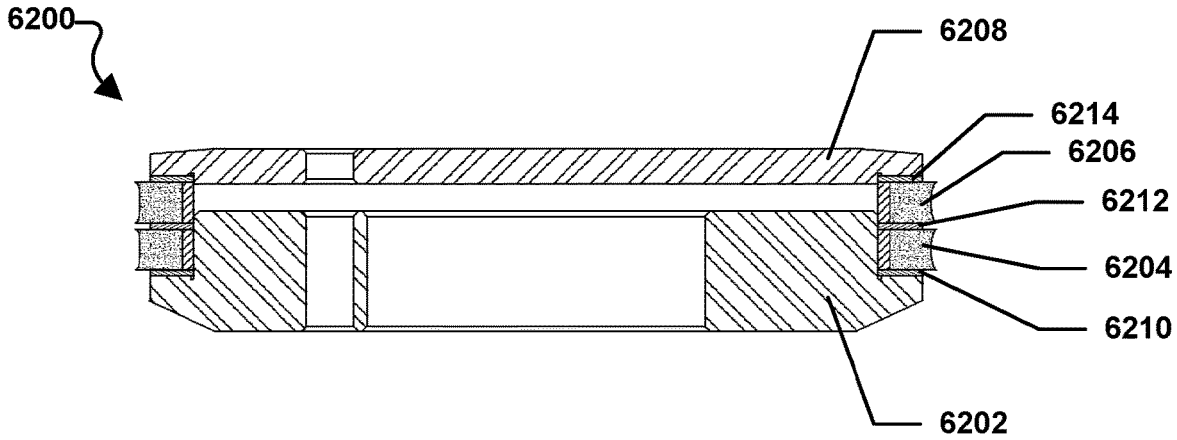
FIG. 63 includes an illustration of a cross-section view of a head assembly for a grinding wheel assembly in accordance with an embodiment.

FIG. 62 and FIG. 63 illustrate a head assembly 6200 for a grinding wheel assembly, e.g., the grinding wheel assembly 3900 illustrated in FIG. 39. The head assembly 6200 can include a mounting plate 6202, a first abrasive body 6204, a second abrasive body 6206, and a cover plate 6208. The abrasive bodies 6204, 6206 may be constructed in a manner similar or identical to any of the abrasive bodies described herein. The cover plate 6208 can be configured similar to any of the other cover plates described herein. The mounting plate 6202 can be similar to the mounting plate 5802 described above.

In addition, the head assembly 6200 can include a first vibration dampening member 6210 installed between the mounting plate 6202 and the first abrasive body 6204, a second vibration dampening member 6212 installed between the abrasive bodies 6204, 6206, and a third vibration dampening member 6214 installed between the second abrasive body 6206, and the cover plate 6208. The vibration dampening members 6210, 6212, 6214 may be identical to the vibration dampening members described elsewhere herein.

Grinding Wheel Assembly with Removable Head Assembly and Balancing Features

Referring now to FIG. 64 through FIG. 67, a grinding wheel assembly is illustrated and is generally designated 6400. As shown, the grinding wheel assembly 6400 can include a pull stud 6402, an arbor 6404, a head assembly 6406, and at least one fastener 6408. The pull stud 6402 and the at least one fastener 6408 are substantially identical to the pull stud 102 and fastener 110 described above. Further, the arbor 6404 may be constructed in a manner substantially identical to the arbor 3904 (FIG. 39) described above.

Head Assembly

FIG. 67 through FIG. 72 illustrate the details of the head assembly 6406. As shown, the head assembly 6406 can include a mounting plate 6420, an abrasive body 6422, and a cover plate 6424. The cover plate 6424 is substantially identical to the cover plate 108 described elsewhere herein.

Figure 64:
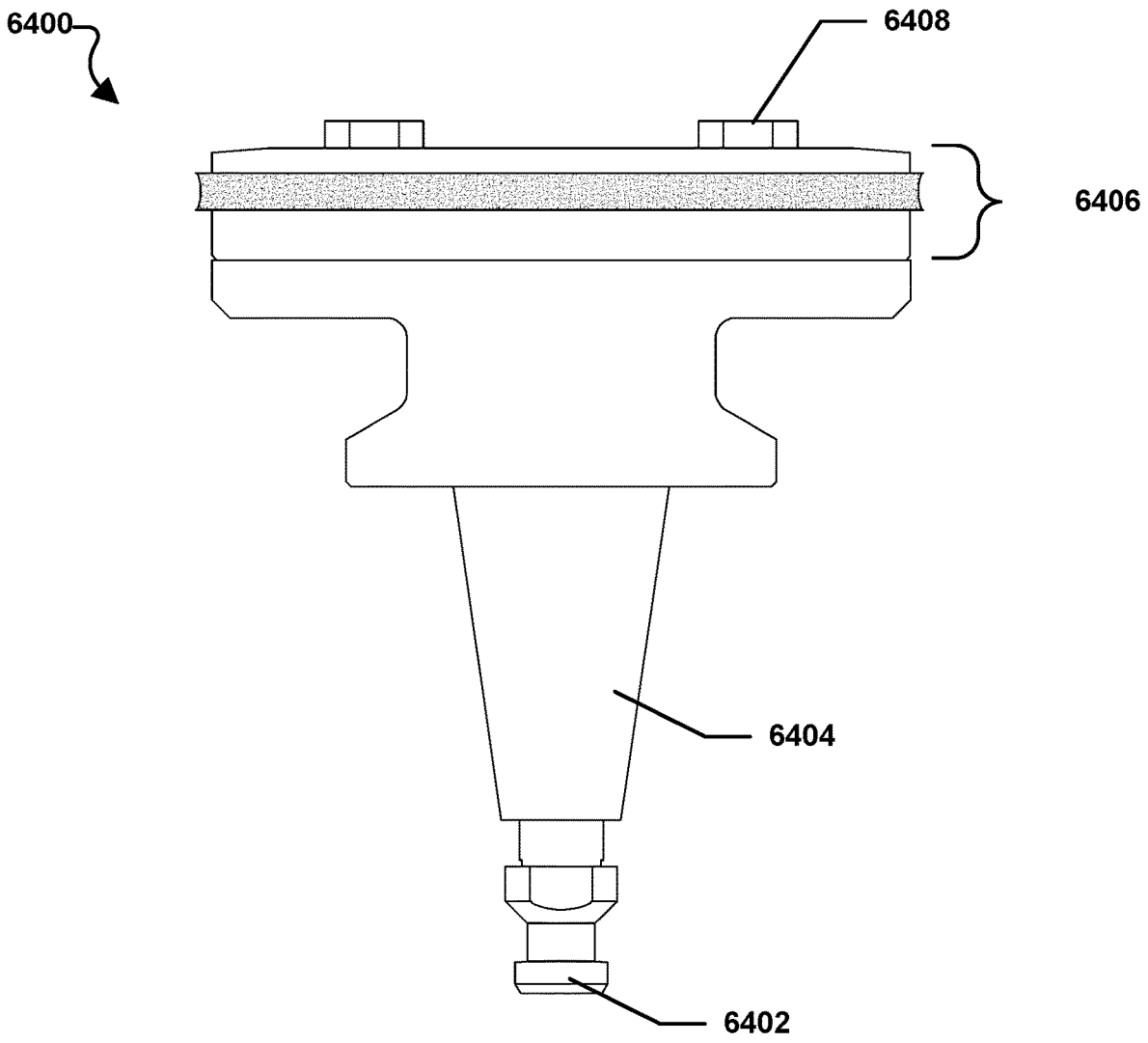
FIG. 64 includes an illustration of a side plan view of a grinding wheel assembly in accordance with an embodiment.
Figure 65:
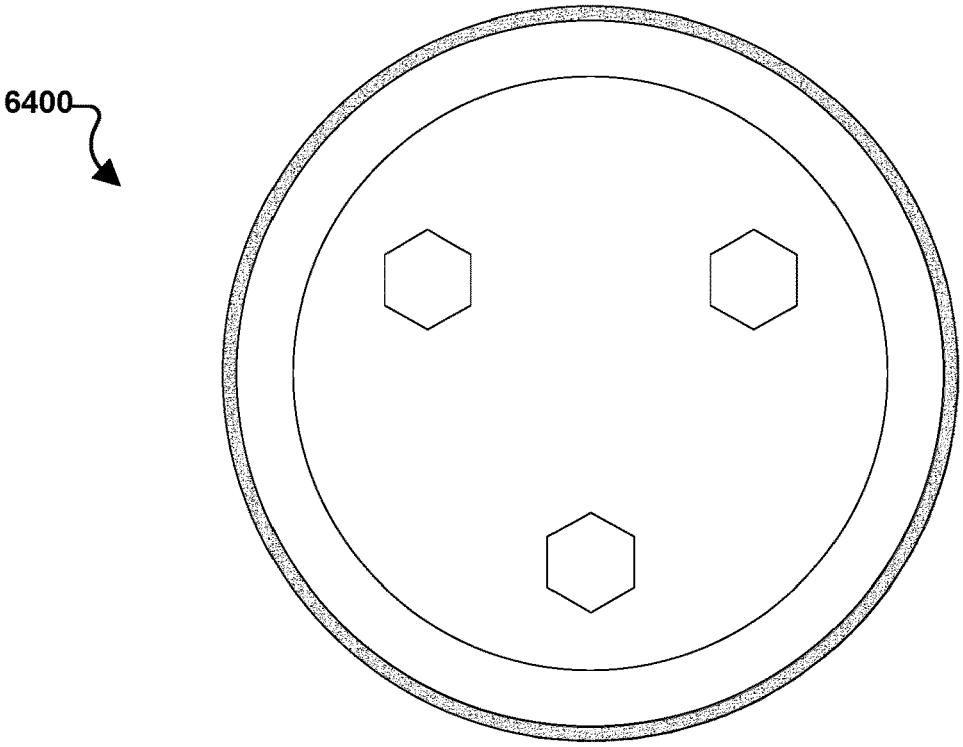
FIG. 65 includes an illustration of a top plan view of a grinding wheel assembly in accordance with an embodiment.
Figure 66:
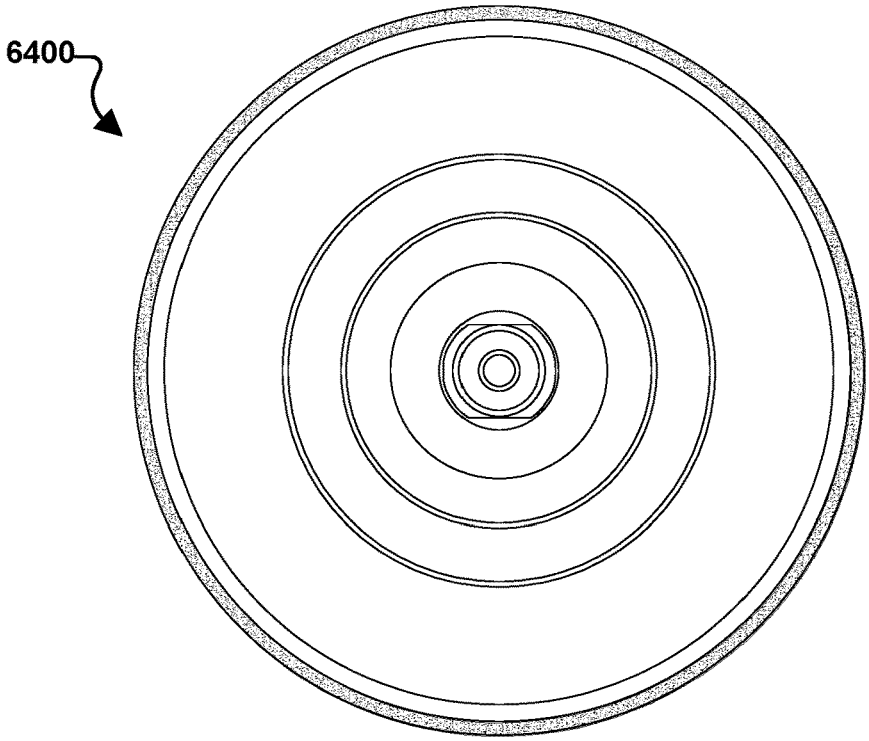
FIG. 66 includes an illustration of a bottom plan view of a grinding wheel assembly in accordance with an embodiment.
Figure 67:
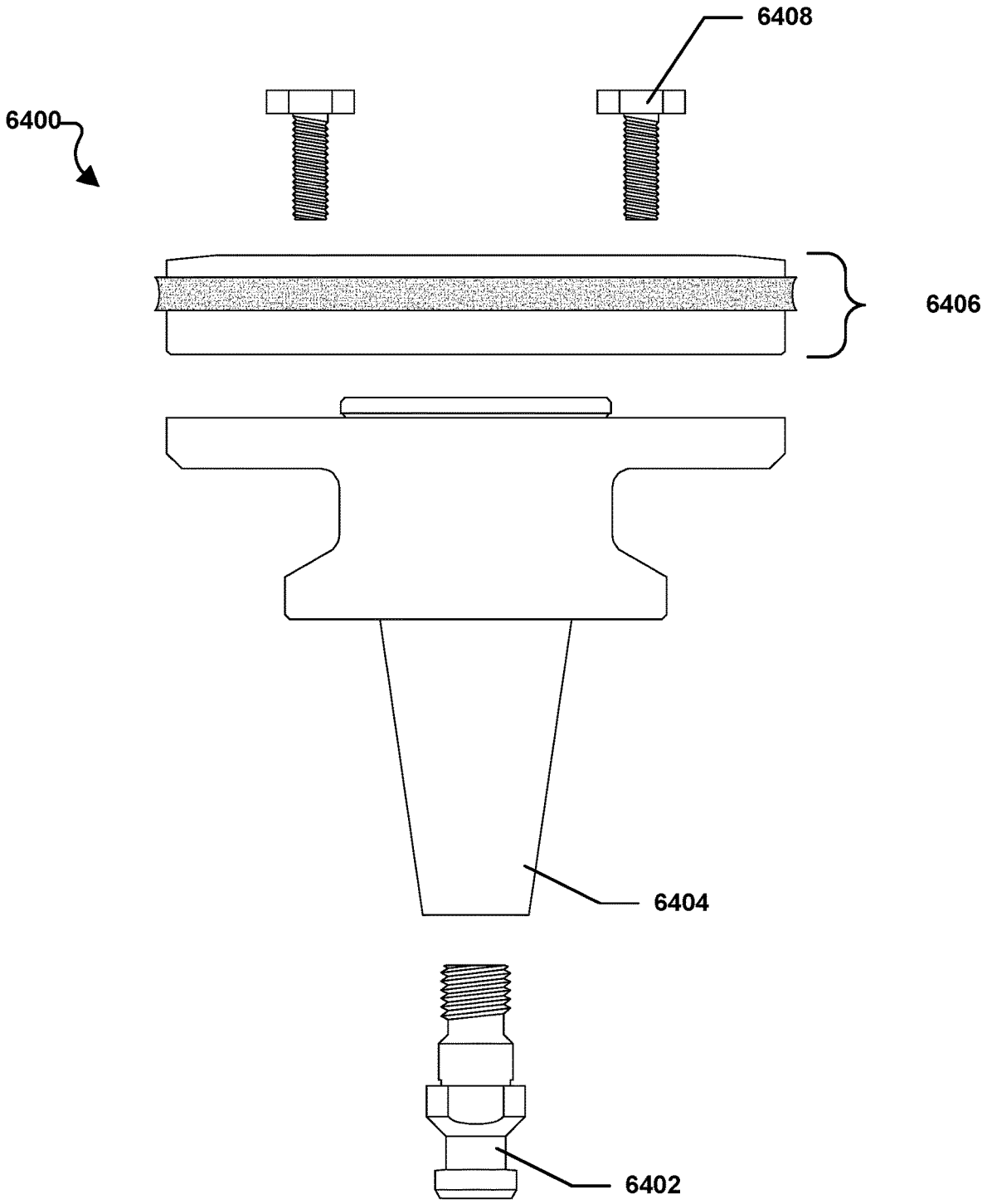
FIG. 67 includes an illustration of an exploded side plan view of a grinding wheel assembly in accordance with an embodiment.
Figure 68:
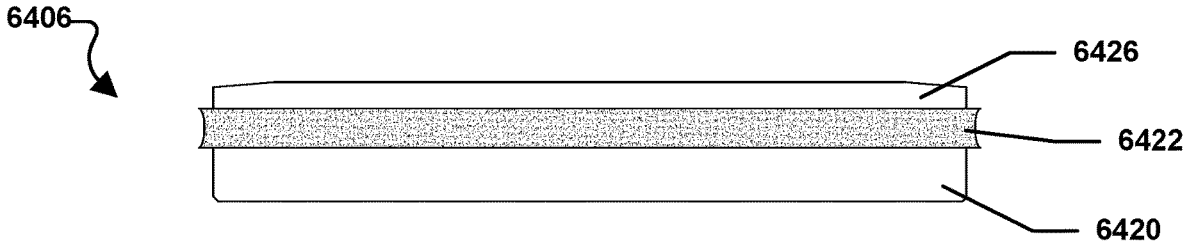
FIG. 68 includes an illustration of a side plan view of a head assembly for a grinding wheel assembly in accordance with an embodiment.
Figure 69:
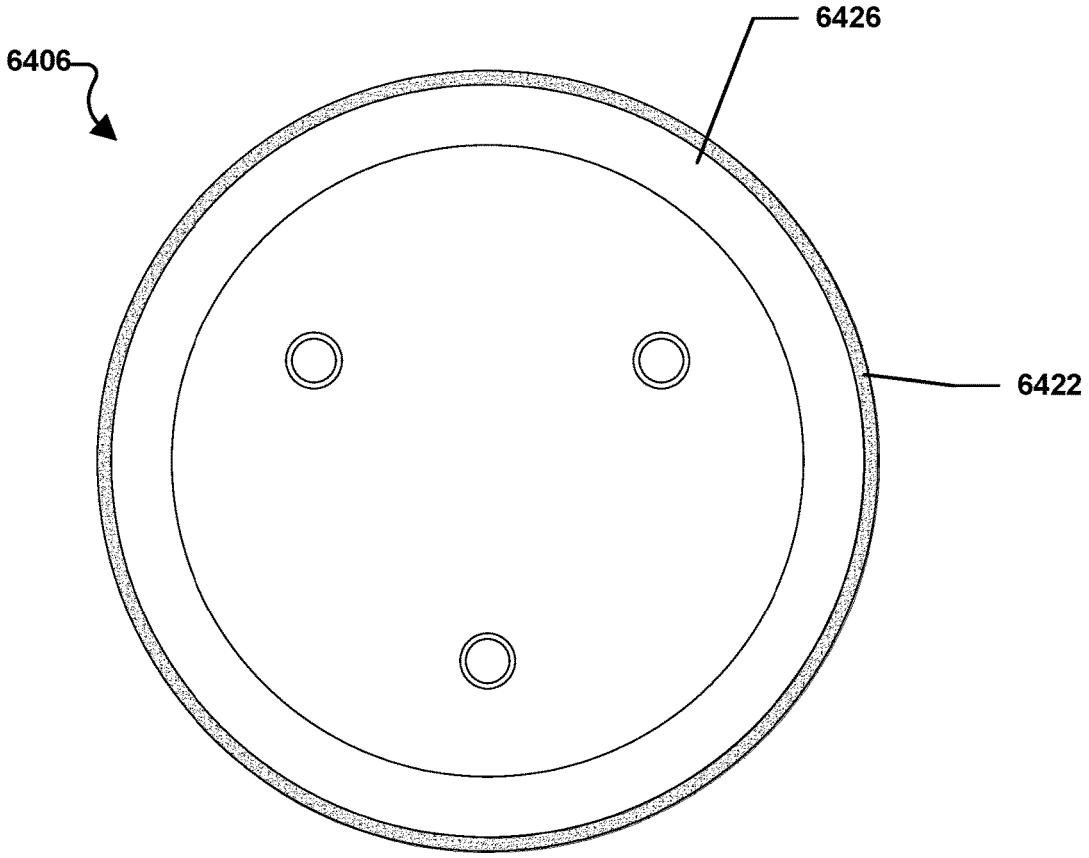
FIG. 69 includes an illustration of a top plan view of a head assembly for a grinding wheel assembly in accordance with an embodiment.
Figure 70:
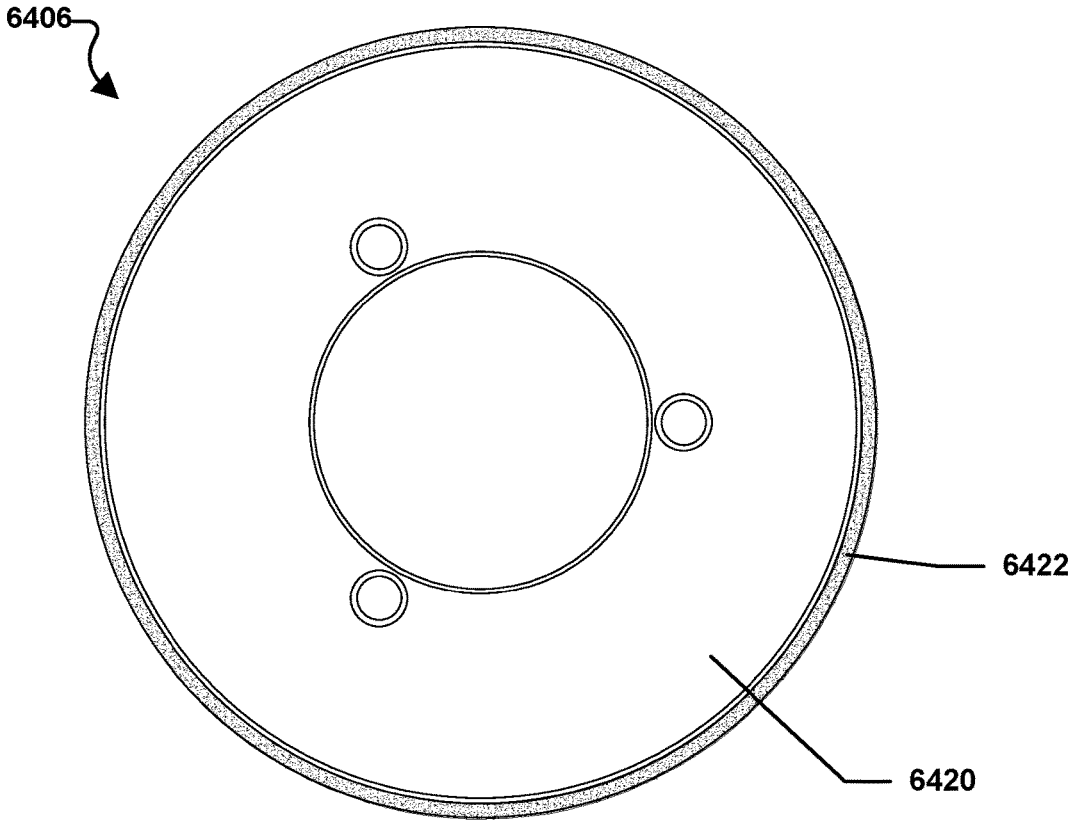
FIG. 70 includes an illustration of a bottom plan view of a head assembly for a grinding wheel assembly in accordance with an embodiment.
Figure 71:
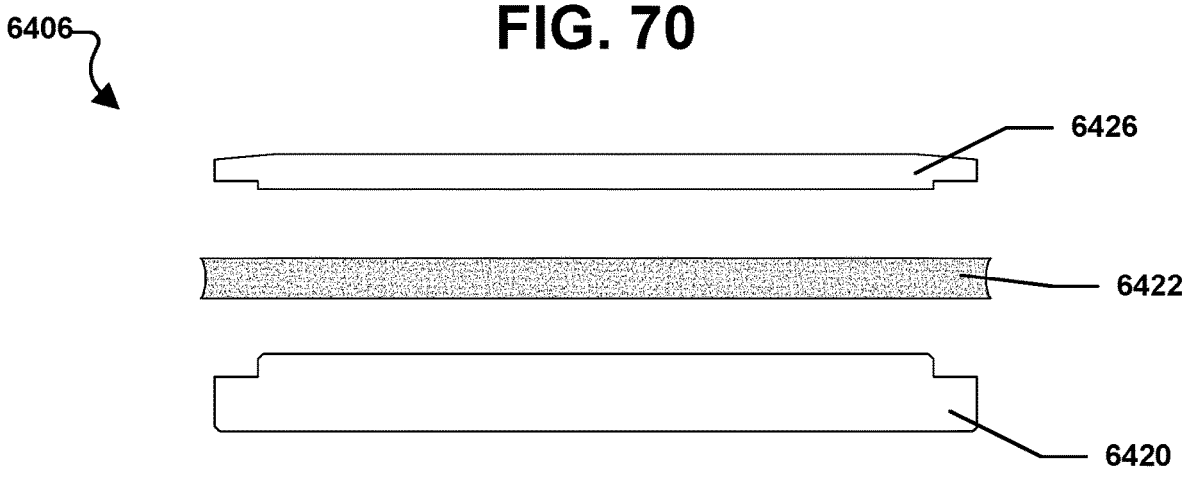
FIG. 71 includes an illustration of an exploded side plan view of a head assembly for a grinding wheel assembly in accordance with an embodiment.
Figure 72:
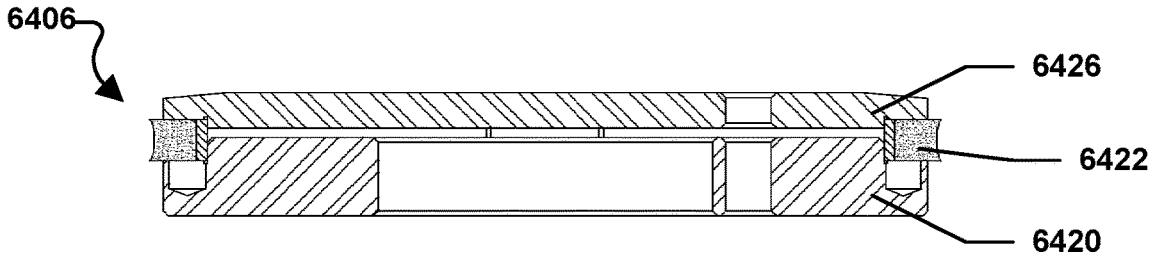
FIG. 72 includes an illustration of a cross-section view of a head assembly for a grinding wheel assembly in accordance with an embodiment.
Figure 73:
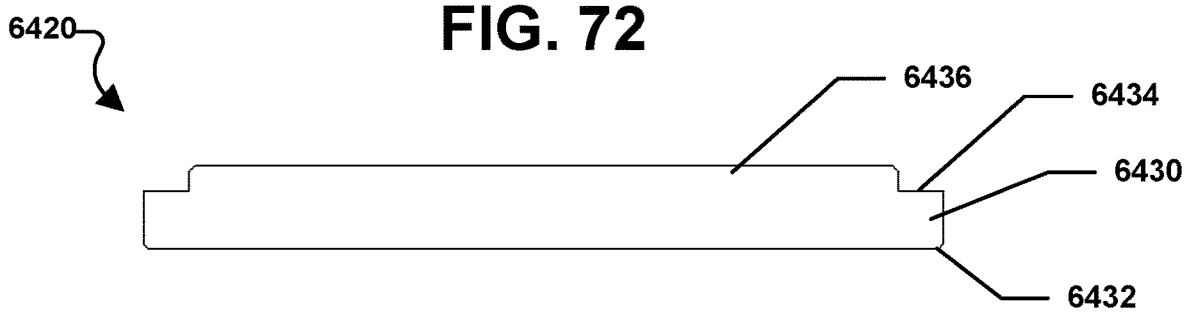
FIG. 73 includes an illustration of a side plan view of a mounting plate for a head assembly of a grinding wheel assembly in accordance with an embodiment.
Figure 74:
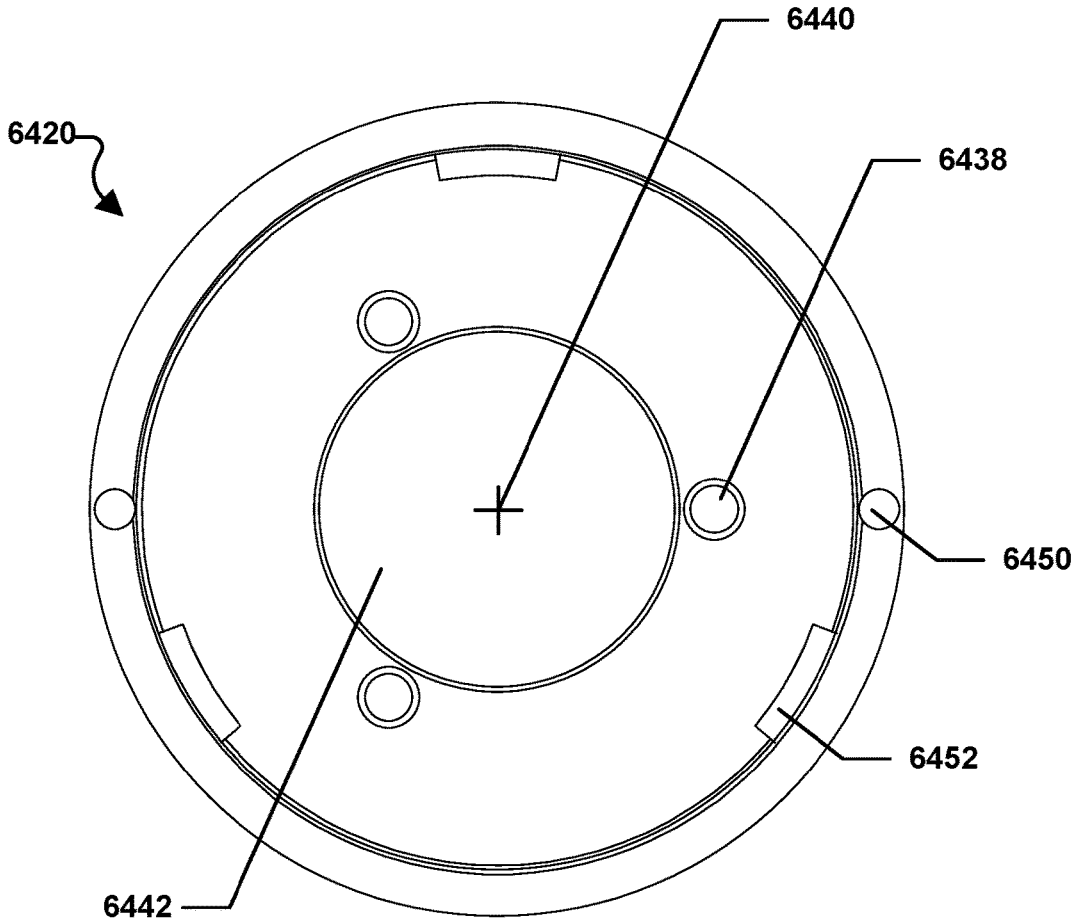
FIG. 74 includes an illustration of a top plan view of a mounting plate for a head assembly of a grinding wheel assembly in accordance with an embodiment.
Figure 75:
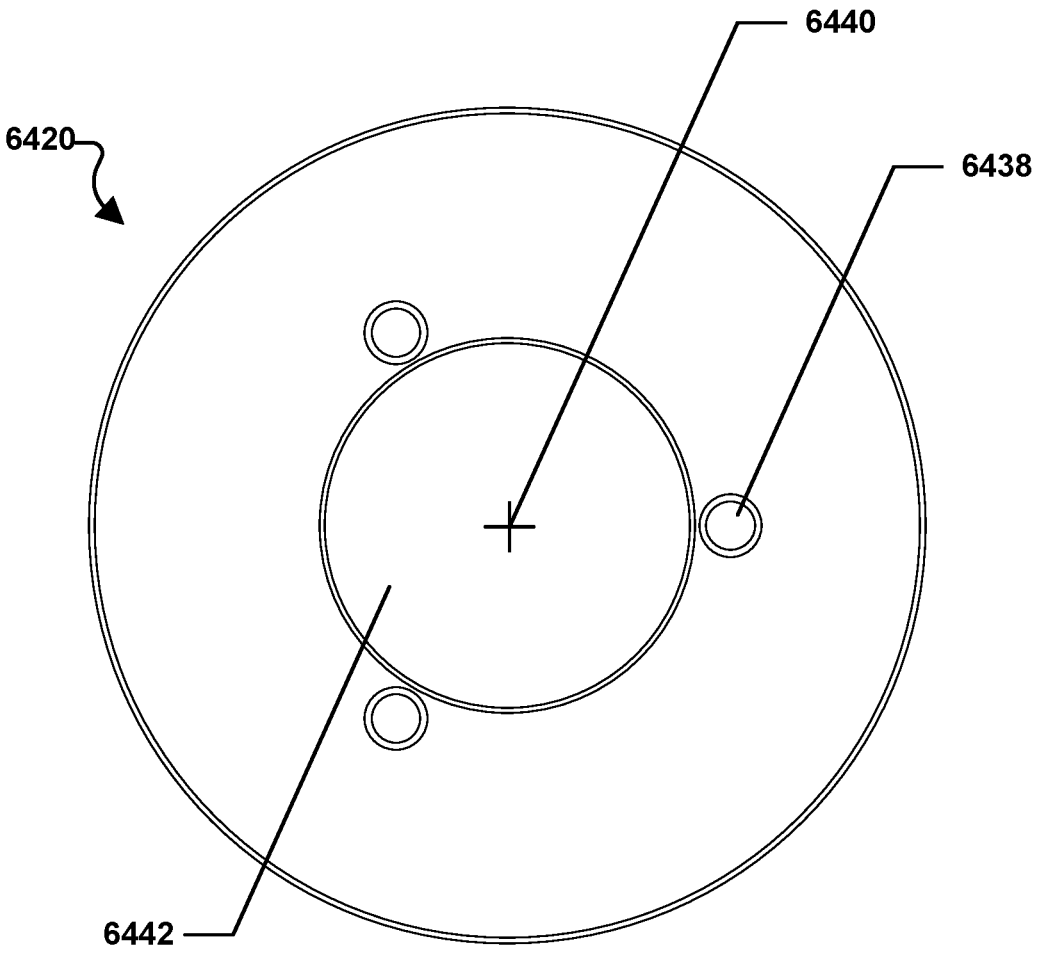
FIG. 75 includes an illustration of a bottom plan view of a mounting plate for a head assembly of a grinding wheel assembly in accordance with an embodiment.
Figure 76:
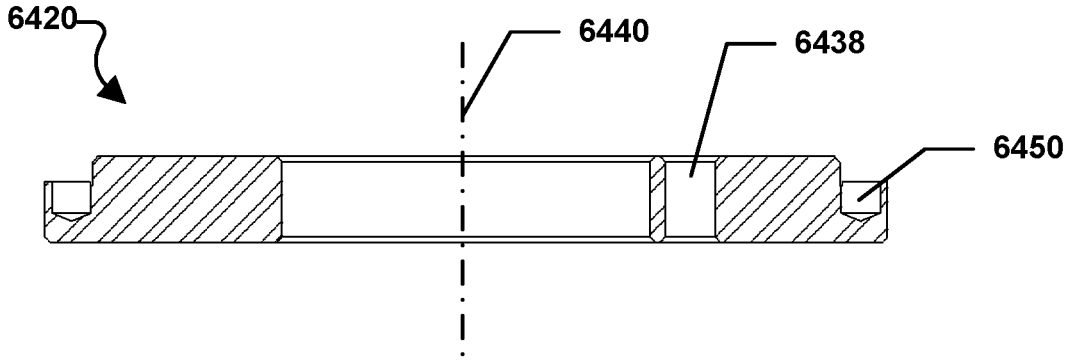
FIG. 76 includes an illustration of a cross-section view of a mounting plate for a head assembly of a grinding wheel assembly in accordance with an embodiment.

As shown in FIG. 73 through 76, the mounting plate 6420 can include a body 6430 that is disk-shaped. Further, the body 6430 of the mounting plate 6420 can include a proximal surface 6432 and a distal surface 6434. A generally cylindrical mounting hub 6436 can extend outwardly from the proximal surface 6434 as indicated in FIG. 73 and FIG. 76. The mounting hub 6436 is configured to extend into and support the abrasive body 6422 when the grinding wheel assembly 6400 is assembled as indicated in FIG. 64.

As shown in FIG. 74, FIG. 75, and FIG. 76, the body 6430 of the mounting plate 6420 can include at least one bore 6438 extending through the mounting plate 6420, i.e., between the proximal surface 6432 and the distal surface 6434. The at least one bore 6438 can be radially offset from a central axis 6440. The at least one bore 6438 can be a smooth walled bore and may be sized and shaped to allow the at least one fastener 6408, shown in FIG. 64, to extend through the at least one bore 6438 and engage the at least one bore 6438 in a slip fit arrangement. As further illustrated, the mounting plate 6420 can be formed with a central bore 6442 that can be configured to engage the arbor 6405 as described elsewhere herein.

FIG. 74 also indicates that the body 6430 of the mounting plate 6420 may include at least one balancing bore 6450 extending partially into the body 6430 of the mounting plate 6420 from the distal surface 6434 of the body 6430. During manufacture, or during use, an operator may place balancing material (not shown) in the at least one balancing bore 6450 in order to properly balance the head assembly 6406. FIG. 74 shows two diametrically opposed balancing bores 6450, but it can be appreciated that the mounting plate 6420 may include three balancing bores, four balancing bores, or more balancing bores. In any case, the balancing bores 6450 may be equally spaced radially around the central axis 6440 of the mounting plate 6420 and equally spaced linearly from the central axis 6440.

As further illustrated in FIG. 74, the body 6430 of the mounting plate 6420 can include at least one rotation limiting structure, e.g., a groove or a locking notch 6452, formed in the mounting hub 6436. As shown, the at least one locking notch 6452 can extend radially inward into the outer wall of the mounting hub 6436. The locking notch 6452 can be configured to engage another rotation limiting structure, e.g., a locking tab, formed on the abrasive body 6422, described below, in order to prevent the abrasive body 6422 from moving relative to the mounting hub 6436.

Figure 77:
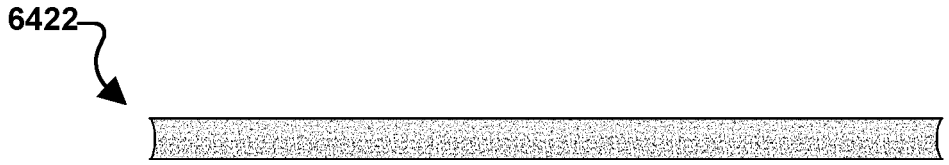
FIG. 77 includes an illustration of a side plan view of an abrasive body for a grinding wheel assembly in accordance with an embodiment.
Figure 78:
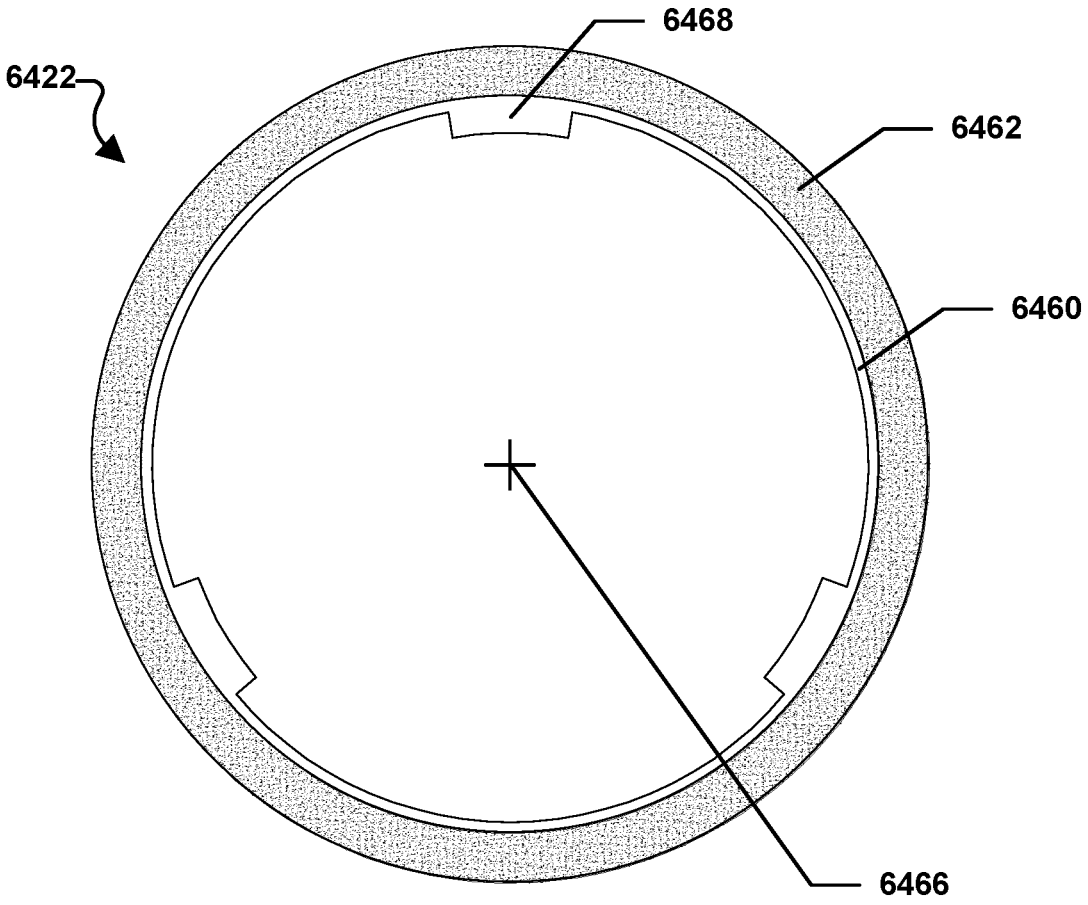
FIG. 78 includes an illustration of a top plan view of an abrasive body for a grinding wheel assembly in accordance with an embodiment.
Figure 79:
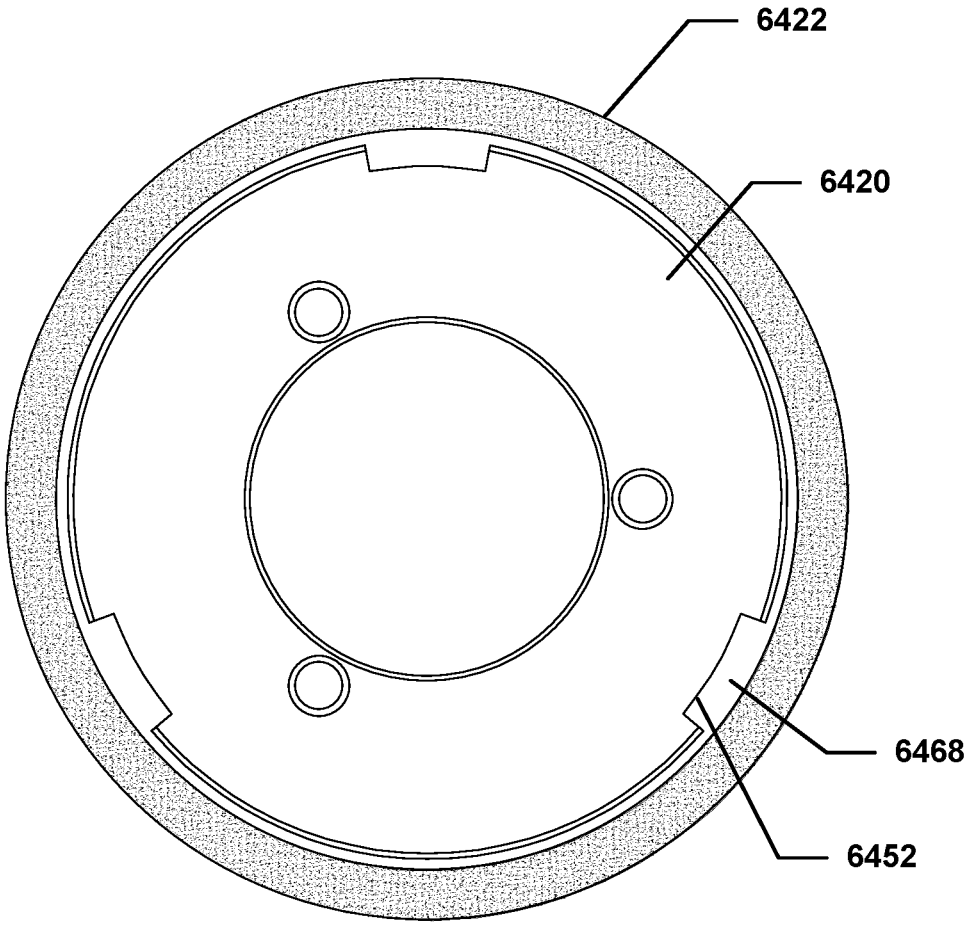
FIG. 79 includes an illustration of a top plan view of an abrasive body and mounting plate for a grinding wheel assembly in accordance with an embodiment.
Figure 80:
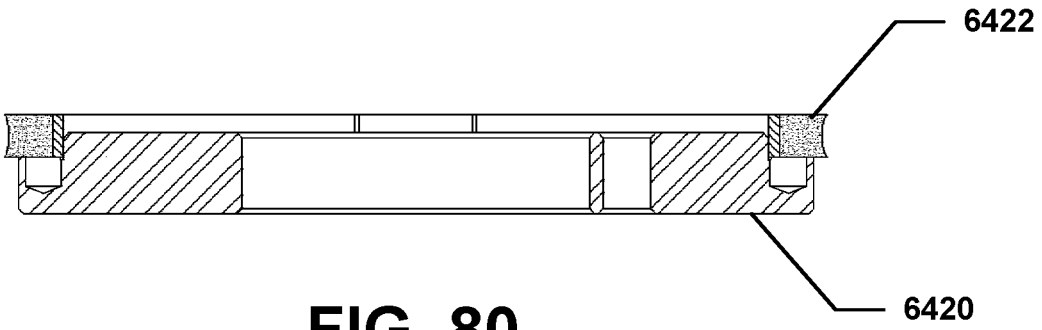
FIG. 80 includes an illustration of a cross-section view of an abrasive body and mounting plate for a grinding wheel assembly in accordance with an embodiment.

FIG. 77 and FIG. 78 show the details of the abrasive body 6422 of the head assembly 6406. The abrasive body 6422 can be substantially identical to the abrasive body 106 (FIG. 1) described herein. The abrasive body 6452 can include a backing 6460 and an abrasive portion 6462 mounted on the backing 6460. A central bore 6464 can be formed within the backing 6460 of the abrasive body 6422 along a central axis 6466. The abrasive body 6422 can further include a locking tab 6468 extending inwardly from the inner wall of the backing 6460, i.e., toward the central axis 6466. The locking tab 6468 may be sized and shaped to fit into the locking notch 6452 formed in the mounting hub 6436 of the mounting plate 6420 when the abrasive body 6422 is installed over the mounting plate 6420 as illustrated in FIG. 79 and FIG. 80. The engagement of the locking tab 6468 and the locking notch 6452 can prevent the abrasive body 6422 from spinning relative to the mounting plate 6420 during use.

Figure 81:
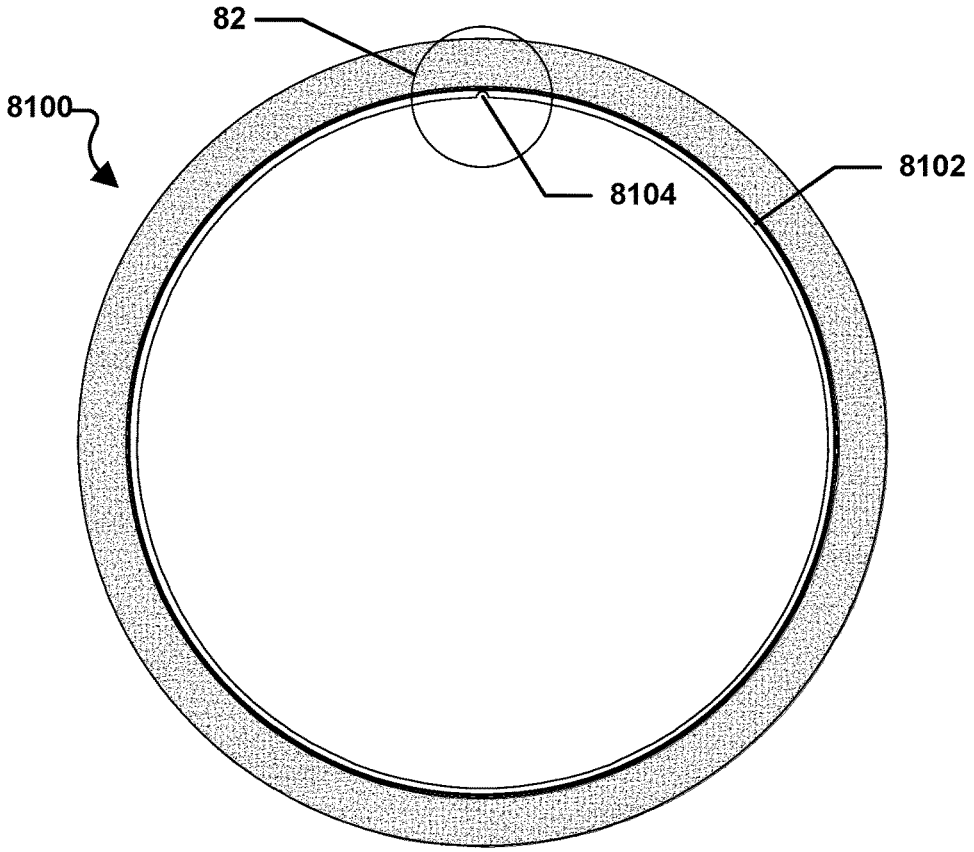
FIG. 81 includes an illustration of a top plan view of an abrasive body for a grinding wheel assembly in accordance with an embodiment.
Figure 83:
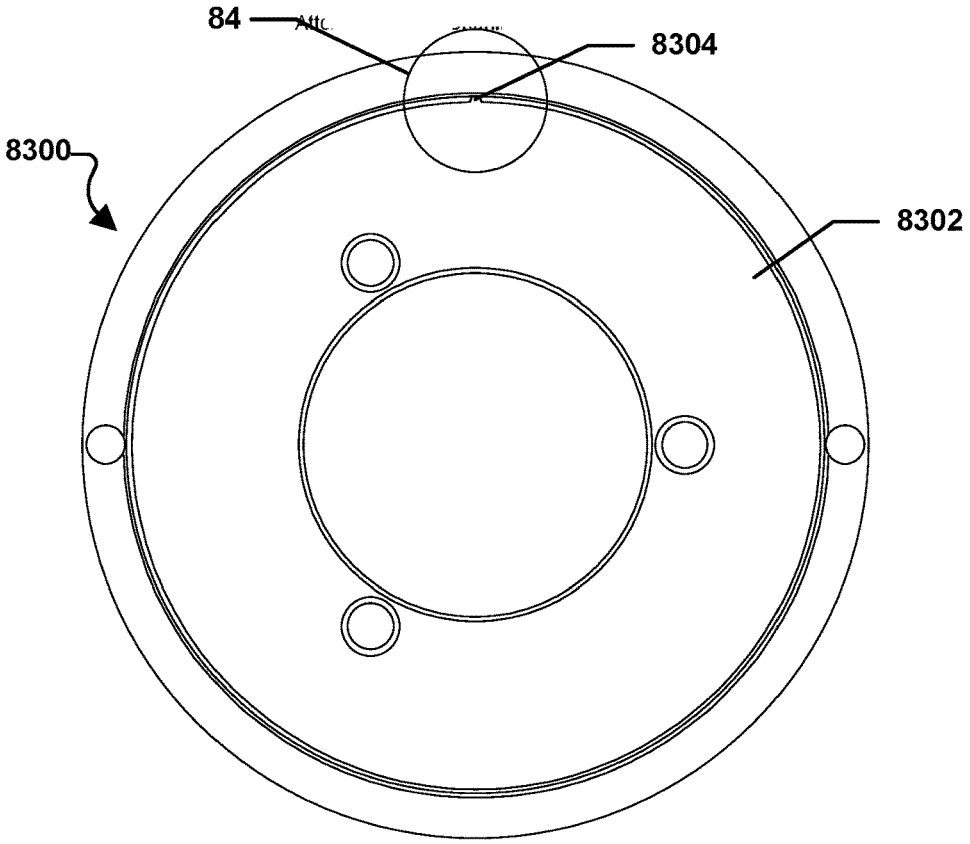
FIG. 83 includes an illustration of a top plan view of a mounting plate for a grinding wheel assembly in accordance with an embodiment.

In another aspect, as illustrated in FIG. 81, an abrasive body 8100 may be include a backing 8102 formed with a locking notch 8104. A mounting plate 8300, shown in FIG. 83, may include a mounting hub 8302 formed with a locking protrusion 8304 that can extend into the locking notch 8104 of the abrasive body 8100 when the abrasive body 8100 is fitted, or otherwise installed, over the mounting hub 8302 of the mounting plate 8300. This arrangement may prevent the abrasive body 8100 from rotating relative to the mounting plate 8300 during use. The abrasive body 8100 may be formed with two locking notches that can be diametrically opposed. Further, the mounting plate 8300 may also be formed with two locking notches that can be diametrically opposed.

Figure 82:
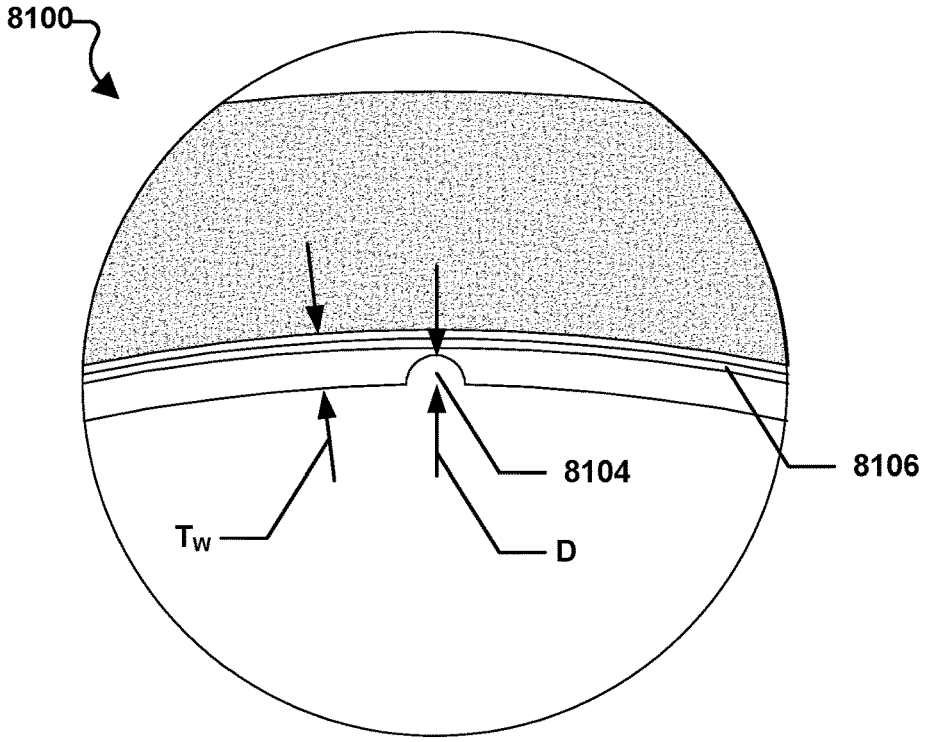
FIG. 82 includes an illustration of a detailed view of an abrasive body for a grinding wheel assembly in accordance with an embodiment taken at circle 82 in FIG. 81.

FIG. 82 indicates that the locking notch 8104 of the abrasive body 8100 can be generally semi-circular. The locking notch 8104 may be formed using a mill bit having a diameter of at least 9/64 inches, such as at least 5/32 inches, or at least 3/16 inches. The diameter of the mill bit may be less than 15/64 inches, such as less than 7/32 inches. The locking notch 8104 may be formed in the inner wall of the backing 8102 at a depth, D, that is less than the wall thickness, $T_W$, of the backing 8102. For example, D may be less than 50% $T_W$. Further, D may be less than 45% $T_W$, such as less than 40% $T_W$, less than 35% $T_W$, or less than 30% $T_W$. In another aspect, D may be greater than 10% $T_W$, such as greater than 15% $T_W$, greater than 20% $T_W$, or greater than 25% $T_W$. In another aspect, D may be within a range between and including any of the minimum and maximum values detailed above.

Further, D may be at least 0.010 inches. For example, D may be at least 0.015 inches, such as at least 0.020 inches, at least 0.025 inches, at least 0.030 inches, or at least 0.035 inches. In another aspect, D is less than 0.060 inches, such as less than 0.055 inches, less than 0.050 inches, less than 0.045 inches, or less than 0.040 inches. It is to be understood that D may be within a range between and including any of the minimum and maximum values described above. Moreover, $T_W$ may be at least 0.100 inches, such as at least 0.105 inches, at least 0.110 inches, or at least 0.114 inches. $T_W$ may be less than 0.150 inches, such as less than 0.145 inches, less than 0.140 inches, less than 0.135 inches, less than 0.130 inches, less than 0.125 inches, less than 0.120 inches, or less than 0.15 inches. It is to be understood that $T_W$ may be within a range between and including any of the minimum and maximum values described above.

FIG. 82 also indicates that the backing 8102 of the abrasive body 8100 may be formed with a channel 8106 along a surface of the backing 8102. The channel 8106 may be formed in an upper surface of the backing 8102, a lower surface of the backing 8102, or both the upper and lower surfaces of the backing 8102. The channel 8106 may be configured to receive a vibration dampening member that is sized and shaped to fit into the channel 8106 and engage the abrasive body 8100. In particular, the vibration dampening member may be at least partially disposed within the channel 8106 of the backing 8102 of the abrasive body 8100 so that a portion of the vibration dampening member extends above the surface in which the channel 8106 is formed.

Figure 84:
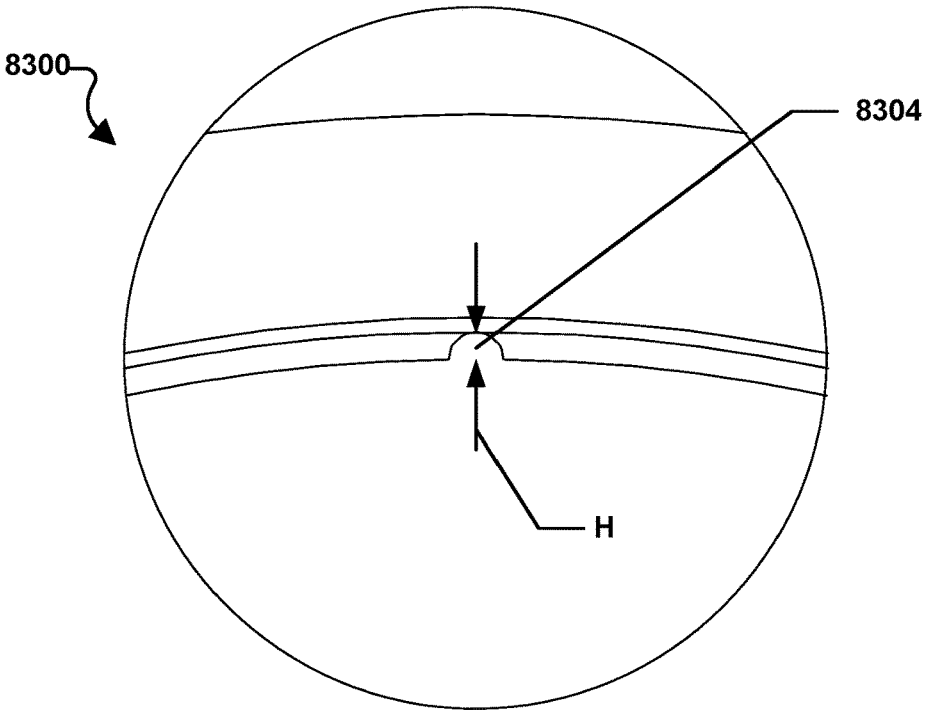
FIG. 84 includes an illustration of a detailed view of a mounting plate for a grinding wheel assembly in accordance with an embodiment taken at circle 84 in FIG. 83.

FIG. 84 indicates that the locking protrusion 8304 of the mounting plate 8300 can include a height, H, that is less than the wall thickness, $T_W$, of the backing 8102 of the abrasive body 8100. For example, H may be less than 50% $T_W$. Further, H may be less than 45% $T_W$, such as less than 40% $T_W$, less than 35% $T_W$, or less than 30% $T_W$. In another aspect, H may be greater than 10% $T_W$, such as greater than 15% $T_W$, greater than 20% $T_W$, or greater than 25% $T_W$. In another aspect, H may be within a range between and including any of the minimum and maximum values detailed above. Further, H may be at least 0.010 inches. For example, H may be at least 0.015 inches, such as at least 0.020 inches, at least 0.025 inches, at least 0.030 inches, or at least 0.035 inches. In another aspect, H is less than 0.060 inches, such as less than 0.055 inches, less than 0.050 inches, less than 0.045 inches, or less than 0.040 inches.

Figure 85:
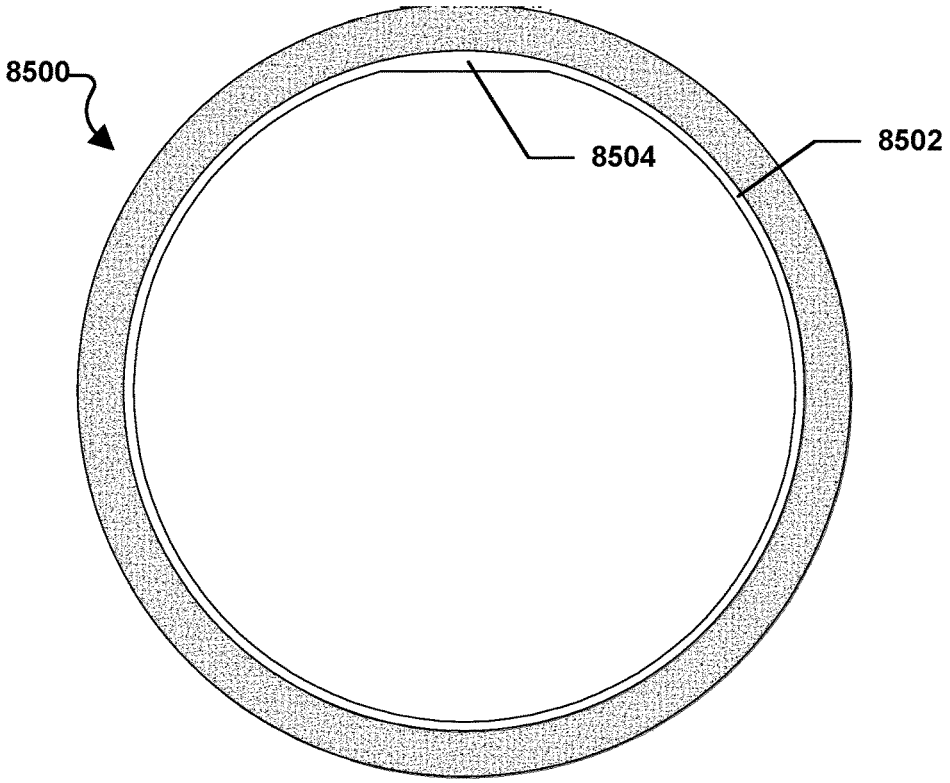
FIG. 85 includes an illustration of a top plan view of an abrasive body for a grinding wheel assembly in accordance with an embodiment.
Figure 86:
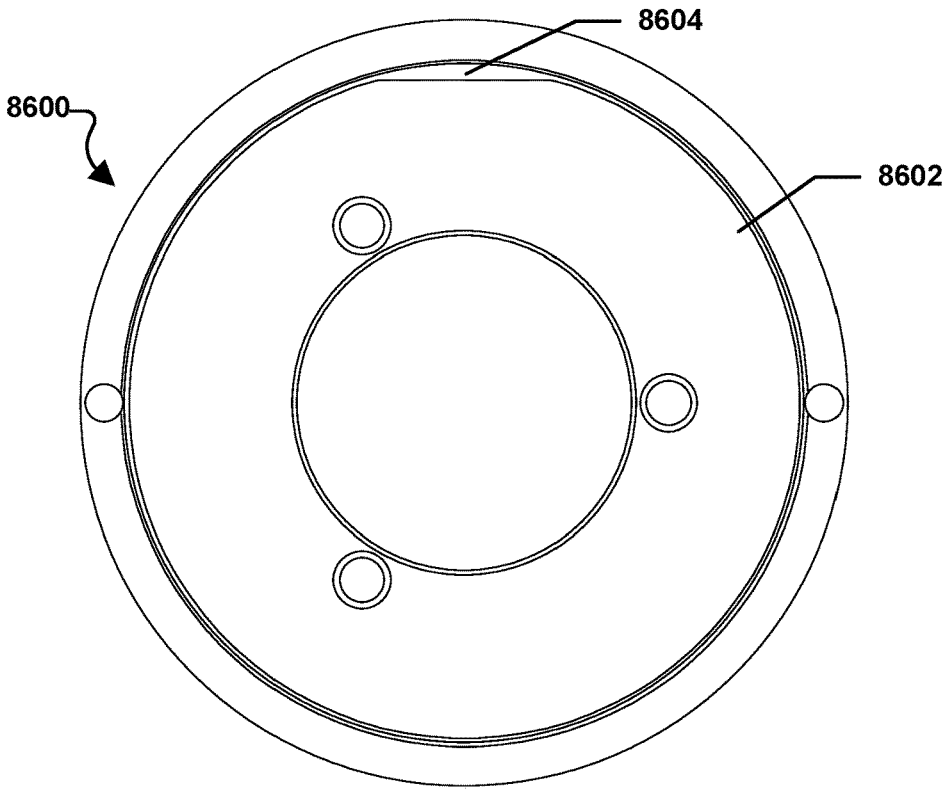
FIG. 86 includes an illustration of a top plan view of a mounting plate for a grinding wheel assembly in accordance with an embodiment.

In yet another aspect, as illustrated in FIG. 85, an abrasive body 8500 may be include a backing 8502 formed with a flat portion 8504. A mounting plate 8600, shown in FIG. 86, may include a mounting hub 8602 that may also be formed with a flat portion 8204 that can mate with the flat portion 8504 of the abrasive body 8500 when the abrasive body 8500 is fitted, or otherwise installed, over the mounting hub 8602 of the mounting plate 8600. This arrangement may prevent the abrasive body 8500 from rotating relative to the mounting plate 8600 during use.

It is to be understood that one or more rotation limiting structures may be employed on a mounting plate, on a cover plate, on an abrasive body, or on a combination thereof. It can be appreciated that the rotation limiting structure may also assist with centering and alignment of the assembly. Further, the rotation limiting structure can include any mechanical engagement between the mounting plate and the abrasive body; between the cover plate and the abrasive body; and between the mounting plate, the abrasive body, and the cover plate that can prevent rotation of the abrasive body relative to the mounting plate and the cover plate.

Head Assembly with Multiple Abrasive Bodies

Figure 87:
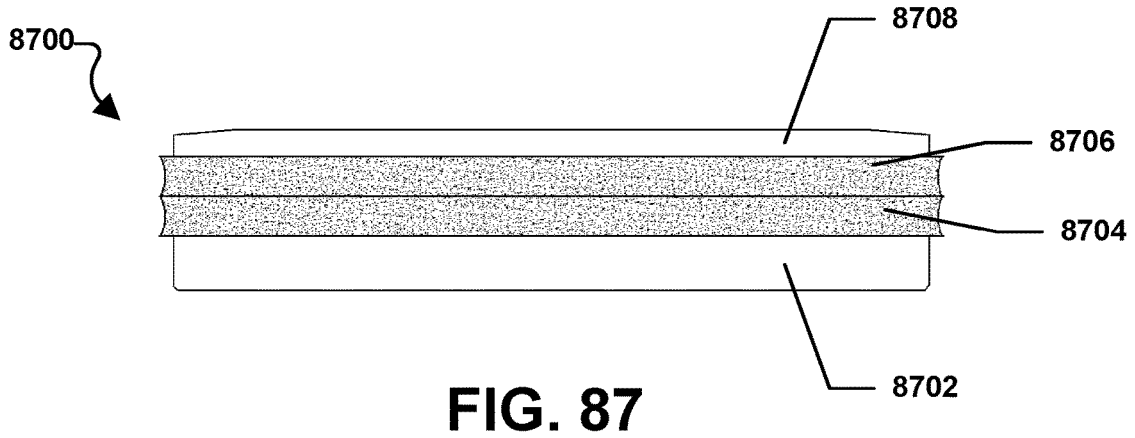
FIG. 87 includes an illustration of a side plan view of a head assembly for a grinding wheel assembly in accordance with an embodiment.
Figure 88:
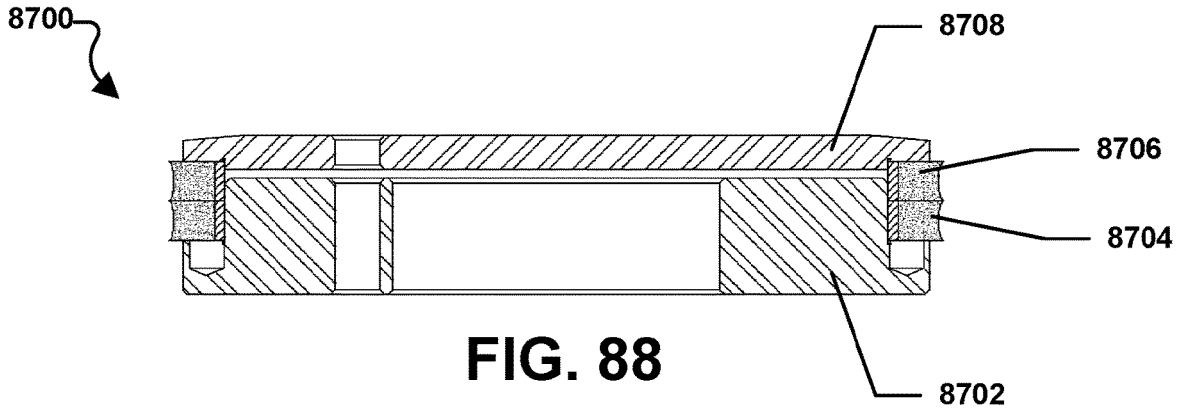
FIG. 88 includes an illustration of a cross-section view of a head assembly for a grinding wheel assembly in accordance with an embodiment.

FIG. 87 and FIG. 88 illustrate a head assembly 8700 for a grinding wheel assembly, e.g., the grinding wheel assembly 6400 illustrated in FIG. 64. The grinding wheel assembly 8700 can include a mounting plate 8702, a first abrasive body 8704, a second abrasive body 8706, and a cover plate 8708. The abrasive bodies 8704, 8706 may be constructed in a manner similar or identical to any of the abrasive bodies described herein. The cover plate 8708 can be configured similar to any of the other cover plates described herein. The mounting plate 8702 can be similar to the mounting plate 6420 described above. However, the mounting plate 8702 can have a mounting hub 8710 that is thicker than the mounting hub 6436 (FIG. 73) of the mounting hub 6420 (FIG. 73) to accommodate the multiple abrasive bodies 8704, 8706. It can be appreciated that the head assembly 8700 could include a third abrasive body (not shown) or a fourth abrasive body (not shown).

Head Assembly with Vibration Dampening Members

Figure 89:
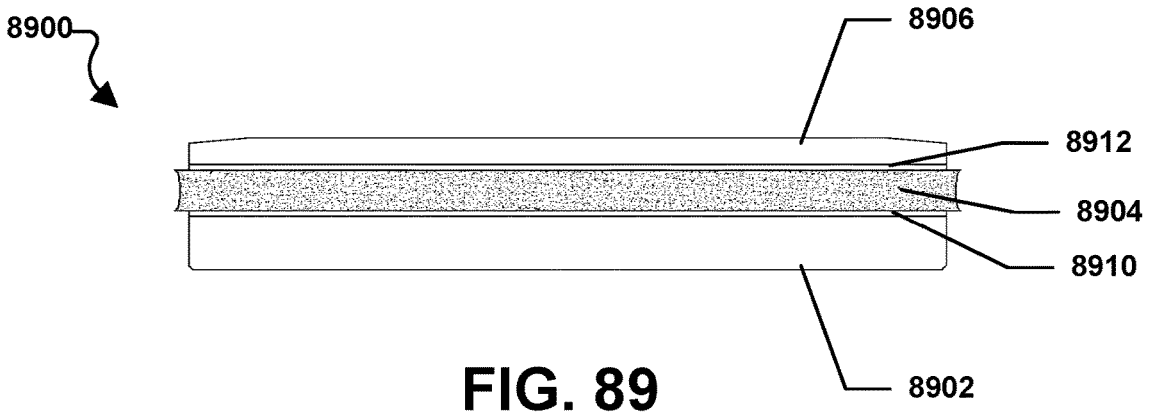
FIG. 89 includes an illustration of a side plan view of a head assembly for a grinding wheel assembly in accordance with an embodiment.
Figure 90:
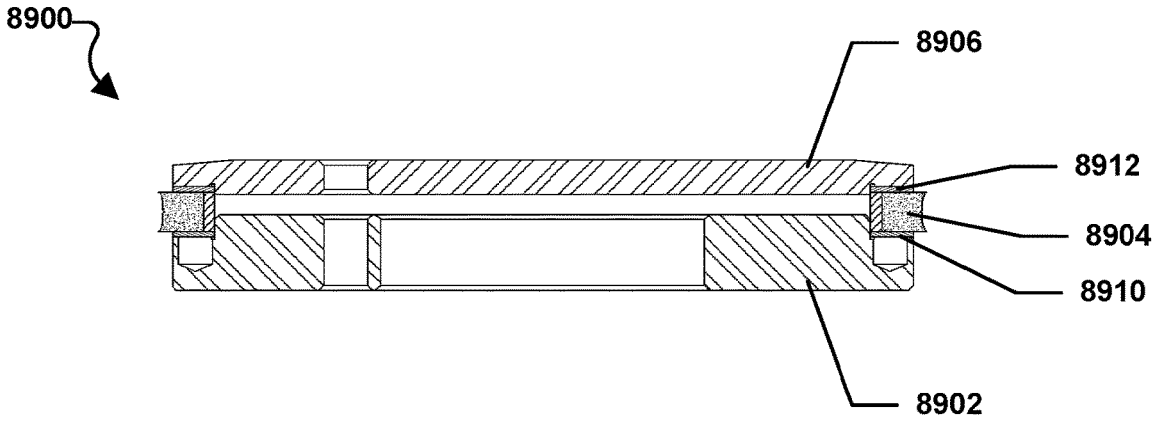
FIG. 90 includes an illustration of a cross-section view of a head assembly for a grinding wheel assembly in accordance with an embodiment.

FIG. 89 and FIG. 90 illustrate a head assembly 8900 for a grinding wheel assembly, e.g., the grinding wheel assembly 6400 illustrated in FIG. 64. The head assembly 8900 can be substantially identical to the head assembly 6406 (FIG. 67) and can include a mounting plate 8902, an abrasive body 8904, and a cover plate 8906.

Additionally, the head assembly 8900 can include a first vibration dampening member 8910 installed between the mounting plate 8902 and the abrasive body 8904 and a second vibration dampening member 8912 installed between the abrasive body 8904 and the cover plate 8906. The vibration dampening members 8910, 8912 may be identical to the vibration dampening members described elsewhere herein.

Figure 91:
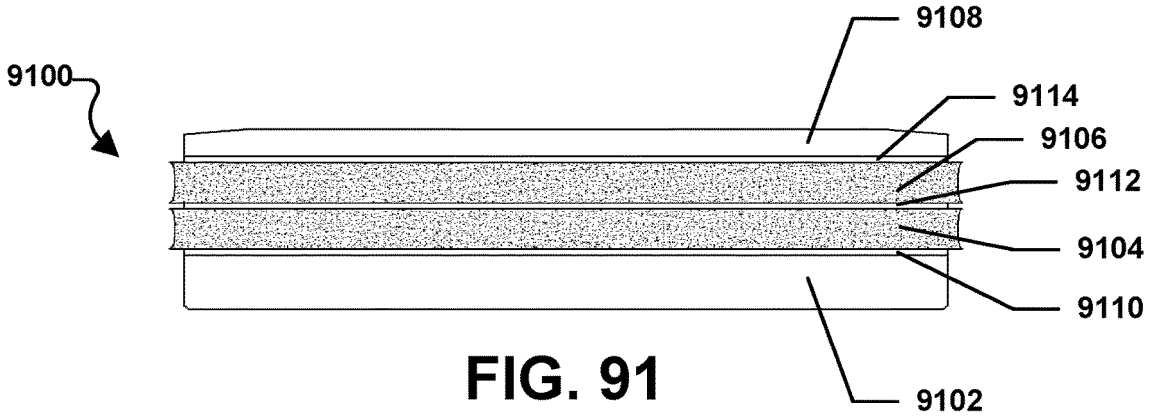
FIG. 91 includes an illustration of a side plan view of a head assembly for a grinding wheel assembly in accordance with an embodiment.
Figure 92:
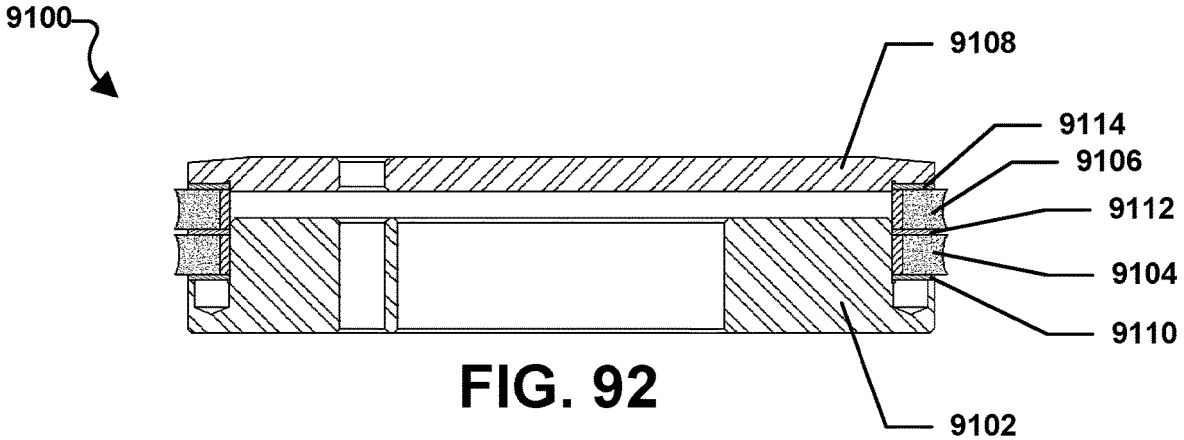
FIG. 92 includes an illustration of a cross-section view of a head assembly for a grinding wheel assembly in accordance with an embodiment.

FIG. 91 and FIG. 92 illustrate another head assembly 9100 for a grinding wheel assembly, e.g., the grinding wheel assembly 6400 illustrated in FIG. 64. The head assembly 9100 can be substantially identical to the head assembly 8700 (FIG. 87) and can include a mounting plate 9102, a first abrasive body 9104, a second abrasive body 9106, and a cover plate 9108.

Further, the head assembly 9100 can include a first vibration dampening member 9110 installed between the mounting plate 9102 and the first abrasive body 9104, a second vibration dampening member 9112 installed between the abrasive bodies 9104, 9106, and a third vibration dampening member 9114 installed between the second abrasive body 9106, and the cover plate 9108. The vibration dampening members 9110, 9112, 9114 may be identical to the vibration dampening members described elsewhere herein.

Head Assembly with a Spacer

Figure 93:
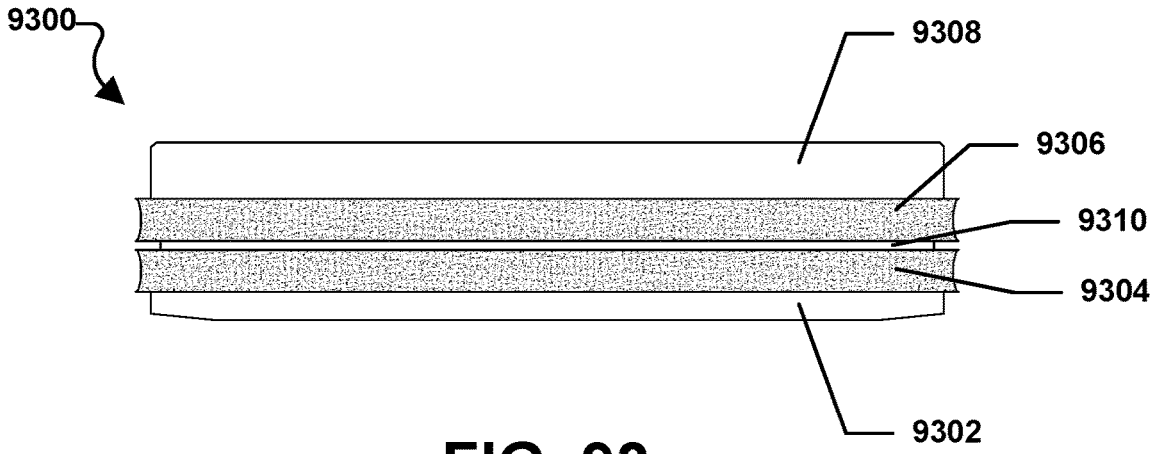
FIG. 93 includes an illustration of a side plan view of a head assembly for a grinding wheel assembly in accordance with an embodiment.
Figure 94:
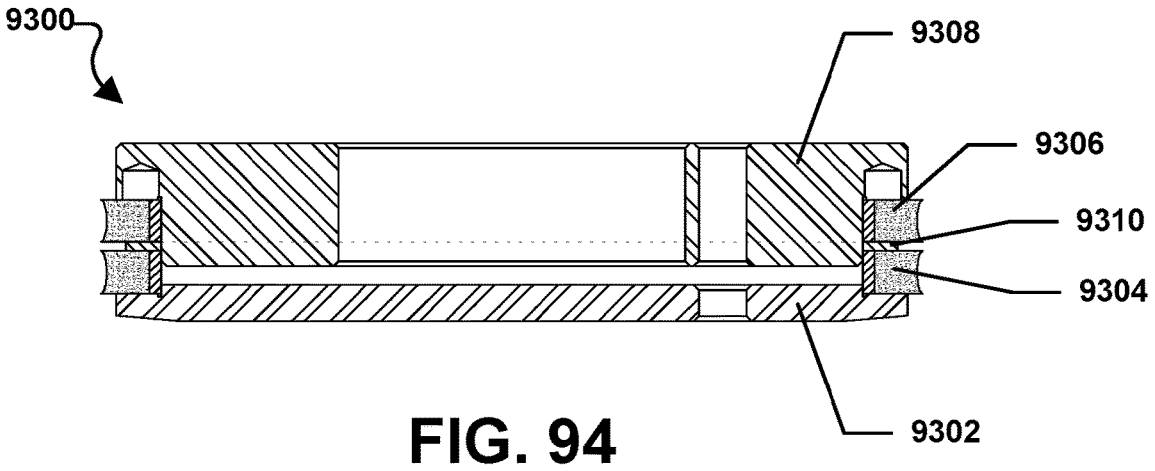
FIG. 94 includes an illustration of a cross-section view of a head assembly for a grind wheel assembly in accordance with an embodiment.

Referring to FIG. 93 and FIG. 94, a head assembly is shown and is generally designated 9300. The head assembly 9300 is configured to be used with a grinding wheel assembly, e.g., the grinding wheel assembly 6400 illustrated in FIG. 64. The head assembly 9300 can be substantially identical to the head assembly 8700 (FIG. 87) and can include a mounting plate 9302, a first abrasive body 9304, a second abrasive body 9306, and a cover plate 9308.

Additionally, the head assembly 9300 can include a spacer 9310 placed in between the first abrasive body 9304 and the second abrasive body 9306. In one aspect, the spacer 9310 may be constructed from a metal or a metal alloy. In another aspect, the spacer 9310 may be constructed from an organic material. For example, the organic material can include a polymer, such as a polyamid.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the items as listed below.

EMBODIMENTS

Embodiment 1

An abrasive article comprising:

a body including:

a mounting plate; and a cover plate, wherein the mounting plate and cover plate are configured to be coupled to each other and form a head assembly including a channel region established between the mounting plate and the cover plate, and wherein the cover plate and the mounting plate are configured to be coupled with a clamping force across the channel region to hold an abrasive body within the channel region and the clamping force is provided by at least one fastener tightened with a torque, T, of at least 20 Newton meters (N●m).

Embodiment 2

An abrasive article comprising:
a body including:
mounting plate; and
a cover plate, wherein the mounting plate and cover plate are configured to be coupled to each other and form a head assembly including a channel region disposed between the mounting plate and the cover plate, and further comprising a gap region defining a gap distance of at least 0.25 mm between the mounting plate and the cover plate in a pre-assembled state.

Embodiment 3

An abrasive article comprising:
a body including:
a mounting plate; and
a cover plate, wherein the mounting plate and cover plate are configured to be coupled to each other and form a head assembly including a channel region disposed between the mounting plate and the cover plate, and further comprising a gap region defining a gap distance of at least 0.2 mm between the mounting plate and the cover plate in an assembled state.

Embodiment 4

An abrasive article comprising:
a body including:
a mounting plate; and
a cover plate, wherein the mounting plate and cover plate are configured to be coupled to each other and form a head assembly including a channel region disposed between the mounting plate and the cover plate, and further comprising a rotation limiting structure adjacent to the channel region, the rotation limiting structure configured to engage an abrasive body and prevent rotation of the abrasive body relative to the head assembly.

Embodiment 5

An abrasive article comprising:
a body including:
a mounting plate; and
a cover plate, wherein the mounting plate and cover plate are configured to be coupled to each other and form a head assembly including a channel region disposed between the mounting plate and the cover plate, and further comprising a vibration dampening member adjacent to the mounting plate or the cover plate, the vibration dampening member configured to reduce vibration of an abrasive body installed within the channel region.

Embodiment 6

An abrasive body, comprising:
a backing;
an abrasive portion affixed to the backing, wherein the backing includes at least one rotation limiting feature configured to engage a complimentary rotation limiting feature on a mounting plate of a grinding wheel assembly.

Embodiment 7

The abrasive article of any one of embodiments 1, 2, 3, 4, and 5, wherein the cover plate comprises a metal or metal alloy.

Embodiment 8

The abrasive article of any one of embodiments 1, 2, 3, 4, and 5, wherein the mounting plate comprises a metal or metal alloy.

Embodiment 9

The abrasive article of any one of embodiments 1, 2, 3, 4, and 5, further comprising an arbor configured to be coupled to the mounting plate.

Embodiment 10

The abrasive article of embodiment 9, wherein the mounting plate is configured to be disposed between and directly contact the cover plate and the arbor in an assembled state.

Embodiment 11

The abrasive article of embodiment 9, wherein the arbor comprises a proximal end and a distal end, and wherein the proximal end comprises a central opening configured to be engaged with a pull stud.

Embodiment 12

The abrasive article of embodiment 11, wherein the distal end of the arbor comprises a central bore.

Embodiment 13

The abrasive article of embodiment 9, wherein the arbor is integrally formed with the mounting plate.

Embodiment 14

The abrasive article of embodiment 9, wherein the arbor comprises a metal or metal alloy.

Embodiment 15

The abrasive article of any one of embodiments 1, 2, 3, 4, and 5, wherein the mounting plate comprises a generally cylindrical mounting hub extending axially from a contact surface of the mounting plate, the contact surface of the mounting plate configured to engage a portion of an abrasive body and the mounting hub configured to receive the abrasive body there around.

Embodiment 16

The abrasive article of embodiment 15, wherein the mounting plate defines a thickness, TMP, and the mounting hub defines a thickness, TMH, and TMH is less than or equal to TMP.

Embodiment 17

The abrasive article of embodiment 16, wherein TMH is less than 95% TMP.

Embodiment 18

The abrasive article of embodiment 17, wherein TMH is less than 90% TMP, such as less than 85% TMP, less than 80% TMP, or less than 75% TMP.

Embodiment 19

The abrasive article of embodiment 18, wherein TMH is greater than 10% TMP.

Embodiment 20

The abrasive article of embodiment 19, wherein TMH is greater than 15% TMP, such as greater than 20% TMP, greater than 25% TMP, or greater than 27.5% TMP.

Embodiment 21

The abrasive article of embodiment 15, wherein the mounting hub defines a thickness, TMH, and TMH is less than or equal to 30 millimeters (mm).

Embodiment 22

The abrasive article of embodiment 21, wherein TMH is less than 25 mm, such as less than 20 mm, less than 15 mm, or less than 12.5 mm.

Embodiment 23

The abrasive article of embodiment 22, wherein TMH is greater than 2.5 mm.

Embodiment 24

The abrasive article of embodiment 23, wherein TMH is greater than 3 mm, such as greater than 3.5 mm or greater than 4 mm.

Embodiment 25

The abrasive article of any one of embodiments 1, 2, 3, 4, and 5, wherein the mounting plate includes at least one bore configured to receive a threaded fastener there through.

Embodiment 26

The abrasive article of embodiment 25, wherein the at least one bore formed in the mounting plate is threaded.

Embodiment 27

The abrasive article of embodiment 25, wherein the at least one bore formed in the mounting plate is smooth walled.

Embodiment 28

The abrasive article of any one of embodiments 1, 2, 3, 4, and 5, wherein the mounting plate includes at least one balancing hole.

Embodiment 29

The abrasive article of embodiment 28, wherein the mounting plate includes at least two balancing holes.

Embodiment 30

The abrasive article of embodiment 29, wherein the balancing holes are diametrically opposed.

Embodiment 31

The abrasive article of any one of embodiments 1, 2, 3, 4, and 5, wherein the cover plate comprises a generally cylindrical support hub extending axially from a contact surface of the cover plate, the contact surface of the cover plate configured to engage a portion of an abrasive body and the support hub configured to extend into the abrasive body.

Embodiment 32

The abrasive article of embodiment 31, wherein the cover plate defines a thickness, TCP, and the support hub defines a thickness, TSH, and TSH is less than or equal to TCP.

Embodiment 33

The abrasive article of embodiment 32, wherein TSH is less than 50% TCP.

Embodiment 34

The abrasive article of embodiment 33, wherein TSH is less than 45% TCP, such as less than 40% TCP, less than 35% TCP, or less than 30% TCP.

Embodiment 35

The abrasive article of embodiment 34, wherein TSH is greater than 15% TCP.

Embodiment 36

The abrasive article of embodiment 35, wherein TSH is greater than 17.5% TCP, such as greater than 20% TCP, or greater than 22.5% TCP.

Embodiment 37

The abrasive article of any one of embodiments 1, 2, 3, 4, and 5, wherein the cover plate includes at least one bore configured to receive a threaded fastener there through.

Embodiment 38

The abrasive article of embodiment 37, wherein the at least one bore formed in the cover plate is smooth walled.

Embodiment 39

The abrasive article of any one of embodiments 1, 2, 3, 4, and 5, wherein the head assembly defines a thickness, THA, and the abrasive body defines a thickness, TAB, and TAB is less than THA.

Embodiment 40

The abrasive article of embodiment 39, wherein TAB is less than 50% THA.

Embodiment 41

The abrasive article of embodiment 40, wherein TAB is less than 45% THA, such as less than 40% THA, less than 35% THA, or less than 30% THA.

Embodiment 42

The abrasive article of embodiment 41, wherein TAB is greater than 15% THA.

Embodiment 43

The abrasive article of embodiment 42, wherein TAB is greater than 17.5% THA, such as greater than 20% THA, or greater than 22.5% THA.

Embodiment 44

The abrasive article of embodiments 2 or 3, wherein the gap defines a gap thickness, TG, and an abrasive body disposed within the channel region defines a thickness, TAB, and TG is less than TAB.

Embodiment 45

The abrasive article of embodiment 44, wherein TG is less than 30% TAB.

Embodiment 46

The abrasive article of embodiment 45, wherein TG is less than 25% TAB, such as less than 22.5% TAB, less than 20% TAB, less than 17.5% TAB, or less than 15% TAB.

Embodiment 47

The abrasive article of embodiment 46, wherein TG is greater than 2.5% TAB.

Embodiment 48

The abrasive article of embodiment 47, wherein TG is greater than 5% TAB, such as greater than 7.5% TAB, greater than 10% TAB, or greater than 12.5% TAB.

Embodiment 49

The abrasive article of embodiments 2 or 3, wherein the gap defines a gap thickness, TG, and TG is less than or equal to 2.5 millimeters (mm).

Embodiment 50

The abrasive article of embodiment 49, wherein TG is less than 2.25 mm, such as less than 2 mm, less than 1.75 mm, less than 1.5 mm, or less than 1.25 mm.

Embodiment 51

The abrasive article of embodiment 50, wherein TG is greater than 0.25 mm.

Embodiment 52

The abrasive article of embodiment 51, wherein TG is greater than 0.375 mm, such as greater than 0.5 mm, greater than 0.625 mm, greater than 0.75 mm, greater than 0.875 mm, or greater than 1 mm.

Embodiment 53

The abrasive article of any one of embodiments 1, 2, 3, 4, and 5, further comprising an abrasive body disposed within the channel region between the mounting plate and the cover plate.

Embodiment 54

The abrasive article of embodiment 53, wherein the abrasive body includes an abrasive portion mounted on a backing.

Embodiment 55

The abrasive article of embodiment 54, wherein the abrasive portion comprises abrasive particles fixed in a bond material.

Embodiment 56

The abrasive article of embodiment 54, wherein the backing comprises a metal or a metal alloy.

Embodiment 57

The abrasive article of embodiment 56, wherein the backing comprises bronze.

Embodiment 58

The abrasive article of embodiment 54, wherein the backing comprises a composite material.

Embodiment 59

The abrasive article of embodiment 54, wherein the abrasive portion is brazed to the backing.

Embodiment 60

The abrasive article of embodiment 54, wherein the abrasive portion is sinter-bonded to the backing.

Embodiment 61

The abrasive article of embodiment 54, wherein the abrasive portion is adhered to the backing.

Embodiment 62

The abrasive article of embodiment 54, wherein the backing has a hardness, HB, and the cover plate has a hardness, HCP, and HB is less than HCP.

Embodiment 63

The abrasive article of embodiment 54, wherein the abrasive portion has a thickness, TA, and the backing has a thickness, TB, and TB is greater than TA.

Embodiment 64

The abrasive article of embodiment 63, wherein TB is at least 101% TA.

Embodiment 65

The abrasive article of embodiment 64, wherein TB is at least 102% TA, such as 103% TA, 104% TA, or 105% TA.

Embodiment 66

The abrasive article of embodiment 65, wherein TB is no greater than 115% TA.

Embodiment 67

The abrasive article of embodiment 66, wherein TB is at least 114% TA, such as 113% TA, 112% TA, 111% TA, or 110% TA.

Embodiment 68

The abrasive article of any one of embodiments 1, 2, 3, 4, and 5, further comprising multiple abrasive bodies disposed within the channel region between the mounting plate and the cover plate.

Embodiment 69

The abrasive article of embodiment 68, wherein the multiple abrasive bodies comprise a first abrasive body having a first abrasive grit size and a second abrasive body having a second abrasive grit size.

Embodiment 70

The abrasive article of embodiment 69, wherein the first abrasive grit size is different than the second abrasive grit size.

Embodiment 71

The abrasive article of embodiment 69, wherein the first abrasive body is separated from the second abrasive body by at least one spacer.

Embodiment 72

The abrasive article of embodiment 71, wherein the at least one spacer comprises a metal or a metal alloy.

Embodiment 73

The abrasive article of embodiment 71, wherein the at least one spacer comprises an organic material.

Embodiment 74

The abrasive article of embodiment 73, wherein the at least one spacer comprises a polymer.

Embodiment 75

The abrasive article of embodiment 74, wherein the at least one polymer comprises polyamid.

Embodiment 76

The abrasive article of embodiment 68, wherein the multiple abrasive bodies comprise a first abrasive body having a first outer profile and a second abrasive body having a second outer profile different from the first outer profile.

Embodiment 77

The abrasive article of any one of embodiments 1, 2, 3, 4, and 5, wherein the mounting plate comprises a composite material including at least two different materials selected from the group consisting of an inorganic material, an organic material, a polymer, a metal, a metal alloy, a ceramic, a glass, a thermoset, a thermoplastic, an elastomer or any combination thereof.

Embodiment 78

The abrasive article of embodiment 4, wherein the rotation limiting structure comprises a notch extending radially inwardly from a mounting hub of the mounting plate.

Embodiment 79

The abrasive article of embodiment 78, wherein the rotation limiting structure further comprises a tab extending radially inward from an abrasive body, wherein the tab is configured to extend at least partially into and engage the notch formed in the mounting plate.

Embodiment 80

The abrasive article of embodiment 4 or embodiment 6, wherein the rotation limiting structure comprises a notch extending radially into an inner wall of a backing of an abrasive body.

Embodiment 81

The abrasive article of embodiment 80, wherein the notch comprises a depth, D, and the backing comprises a wall thickness, TW, and wherein D is less than TW.

Embodiment 82

The abrasive article of embodiment 81, wherein D is less than 50% TW.

Embodiment 83

The abrasive article of embodiment 82, wherein D is less than 45% TW, such as less than 40% TW, less than 35% TW, or less than 30% TW.

Embodiment 84

The abrasive article of embodiment 83, wherein D is greater than 10% TW, such as greater than 15% TW, greater than 20% TW, or greater than 25% TW.

Embodiment 85

The abrasive article of embodiment 81, wherein D is at least 0.010 inches.

Embodiment 86

The abrasive article of embodiment 85, wherein D is at least 0.015 inches, such as at least 0.020 inches, at least 0.025 inches, at least 0.030 inches, or at least 0.035 inches.

Embodiment 87

The abrasive article of embodiment 86, wherein D is less than 0.060 inches, such as less than 0.055 inches, less than 0.050 inches, less than 0.045 inches, or less than 0.040 inches.

Embodiment 88

The abrasive article of embodiment 5, wherein the vibration dampening member comprises at least one material selected from the group consisting of an organic material, an inorganic material, a metal, a metal alloy, a ceramic, a glass, a thermoset, a thermoplastic, an elastomer, or any combination thereof.

Embodiment 89

The abrasive article of embodiment 88, wherein the vibration dampening material comprises a polymer material.

Embodiment 90

The abrasive article of embodiment 89, wherein the polymer comprises polyamid.

Embodiment 91

The abrasive article of embodiment 1, wherein T is at least 25 N●m, such as at least 30 N●m, at least 35 N●m, or at least 40 N●m.

Embodiment 92

The abrasive article of embodiment 91, wherein T is be no greater than 60 N●m, such as no greater than 55 N●m, no greater than 50 N●m, or no greater than 45 N●m.

Embodiment 93

A method of using an abrasive article, comprising:
performing at least one grinding operation on a workpiece using an abrasive article comprising a first abrasive within a channel region formed between a mounting plate and a cover plate;
removing the first abrasive;
installing a second abrasive within the channel region; and performing at least one other grinding operation on a workpiece.

Embodiment 94

The method of embodiment 93, wherein the second abrasive is a replacement of the first abrasive.

Embodiment 95

The method of embodiment 93, wherein the first abrasive is sent back to a manufacture and a new abrasive portion is formed on the backing of the first abrasive.

Embodiment 96

An abrasive body, comprising:
an abrasive portion comprising abrasive particles contained in a bond material, wherein the abrasive portion comprises an annular shape with a central opening; and
a backing affixed to an interior surface of the abrasive portion, the backing having at least one rotation limiting feature selected from the group consisting of at least one groove, at least one linear portion, at least one protrusion, or a combination thereof.

Embodiment 97

The abrasive body of embodiment 96, wherein the at least one rotation limiting feature includes at least one notch.

Embodiment 98

The abrasive body of embodiment 96, wherein the at least one rotation limiting feature includes at least one linear portion.

Embodiment 99

The abrasive body of embodiment 96, wherein the at least one rotation limiting feature includes at least one protrusion.

Embodiment 100

The abrasive body of embodiment 96, wherein the backing is formed with a channel in a surface of the backing.

Embodiment 101

The abrasive body of embodiment 100, wherein the channel is configured to receive a vibration dampening member.

Embodiment 102

The abrasive body of embodiment 101, further comprising a vibration dampening member at least partially disposed in the channel.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive article comprising:

a body including:

a mounting plate; and a cover plate, wherein the mounting plate and cover plate are configured to be coupled to each other and form a head assembly including a channel region established between the mounting plate and the cover plate;

wherein the cover plate and the mounting plate are configured to be coupled with a clamping force across the channel region to hold an abrasive body within the channel region and the clamping force is provided by at least one fastener tightened with a torque, T, of at least 20 Newton meters (N●m); and wherein the cover plate comprises a generally cylindrical support hub extending axially from a contact surface of the cover plate, the support hub configured to extend into the abrasive body, and the contact surface of the cover plate configured to engage a portion of the abrasive body.

2. The abrasive article of claim 1, wherein T is at least 25 N●m.

3. The abrasive article of claim 2, wherein T is no greater than 60 N●m.

4. The abrasive article of claim 1, further comprising an arbor configured to be coupled to the mounting plate.

5. The abrasive article of claim 4, wherein the mounting plate is configured to be disposed between and directly contact the cover plate and the arbor in an assembled state.

6. The abrasive article of claim 5, wherein the arbor comprises a proximal end and a distal end, and wherein the proximal end comprises a central opening configured to be engaged with a pull stud.

7. The abrasive article of claim 5, wherein the arbor is integrally formed with the mounting plate.

8. The abrasive article of claim 1, wherein the mounting plate comprises a generally cylindrical mounting hub extending axially from a contact surface of the mounting plate, the contact surface of the mounting plate configured to engage a portion of an abrasive body and the mounting hub configured to receive the abrasive body there around.

9. The abrasive article of claim 7, wherein the cover plate comprises at least one bore radially offset from a central axis of the cover plate configured to receive the at least one fastener, and the mounting plate comprises at least one bore aligned with the at least one bore of the cover plate configured to receive the at least one fastener.

10. An abrasive article comprising:

a body including:

a mounting plate; and a cover plate, wherein the mounting plate and cover plate are configured to be coupled to each other and form a head assembly including a channel region disposed between the mounting plate and the cover plate, and further comprising a gap region defining a gap distance of at least 0.25 mm between the mounting plate and the cover plate in a pre-assembled state;

an abrasive body disposed between the mounting plate and the cover plate, wherein the abrasive body includes an abrasive portion mounted on a backing, wherein the backing has a hardness, $H_B$, and the cover plate has a hardness, $H_{CP}$, and $H_B$ is less than $H_{CP}$.

11. The abrasive article of claim 10, wherein the backing comprises a metal, metal alloy, or a composite material.

12. The abrasive article of claim 10, further comprising an arbor including a proximal end and a distal end, wherein the mounting plate is formed integrally with the arbor at or near the distal end or the arbor, wherein the proximal end comprises a central opening configured to be engaged with a pull stud.

13. The abrasive article of claim 10, wherein the backing comprises a metal, metal alloy, or a composite material.

14. The abrasive article of claim 10, wherein the abrasive portion has a thickness, $T_A$, and the backing has a thickness, $T_B$, and $T_B$ is greater than $T_A$.

15. An abrasive article comprising:

a body including:

an arbor comprising a body defining a promixal end and a distal end, wherein the body of the arbor comprises a central flange that extends outwardly from the body and a mounting plate that extends radially outward from the body at or near the distal end of the body; and a cover plate, wherein the mounting plate and cover plate are configured to be coupled to each other and form a head assembly including a channel region disposed between the mounting plate and the cover plate, and further comprising a gap region defining a gap distance of at least 0.2 mm between the mounting plate and the cover plate in an assembled state.

16. The abrasive article of claim 15, further comprising multiple abrasive bodies disposed within the channel region between the mounting plate and the cover plate.

17. The abrasive article of claim 16, wherein the multiple abrasive bodies comprise a first abrasive body having a first abrasive grit size and a second abrasive body having a second abrasive grit size.

18. The abrasive article of claim 17, wherein the first abrasive grit size is different than the second abrasive grit size.

19. The abrasive article of claim 17, wherein the first abrasive body is separated from the second abrasive body by at least one spacer.

20. The abrasive article of claim 16, wherein the multiple abrasive bodies comprise a first abrasive body having a first outer profile and a second abrasive body having a second outer profile different from the first outer profile.

* * * * *